US009116468B2

(12) United States Patent
Terazawa et al.

(10) Patent No.: US 9,116,468 B2
(45) Date of Patent: Aug. 25, 2015

(54) POWDER STORAGE CONTAINER AND IMAGE FORMING APPARATUS IN WHICH A GRIPPING PART INCLUDES A POWDER LOADING PORT AND A SEALING MEMBER

(75) Inventors: Seiji Terazawa, Mishima (JP); Atsushi Inoue, Numazu (JP); Kaori Mitsuishi, Susono (JP); Yuki Oshikawa, Ayase (JP); Tadashi Hayakawa, Yokohama (JP); Michitaka Sasaki, Chiba (JP); Hiroyuki Iwasa, Yokohama (JP)

(73) Assignee: RICOH COMPANY, LTD., Tokyo (JP)

( * ) Notice: Subject to any disclaimer, the term of this patent is extended or adjusted under 35 U.S.C. 154(b) by 3 days.

(21) Appl. No.: 14/008,989

(22) PCT Filed: Mar. 29, 2012

(86) PCT No.: PCT/JP2012/059301

§ 371 (c)(1),
(2), (4) Date: Sep. 30, 2013

(87) PCT Pub. No.: WO2012/133940

PCT Pub. Date: Oct. 4, 2012

(65) Prior Publication Data

US 2014/0029973 A1 Jan. 30, 2014

(30) Foreign Application Priority Data

| | | |
|---|---|---|
| Mar. 30, 2011 | (JP) | 2011-075614 |
| Apr. 25, 2011 | (JP) | 2011-097308 |
| Apr. 25, 2011 | (JP) | 2011-097310 |
| Apr. 25, 2011 | (JP) | 2011-097315 |

(51) Int. Cl.
*G03G 15/08* (2006.01)

(52) U.S. Cl.
CPC ..... *G03G 15/0881* (2013.01); *G03G 15/0879* (2013.01); *G03G 15/0886* (2013.01); *G03G 2215/0129* (2013.01); *G03G 2221/1654* (2013.01)

(58) Field of Classification Search
CPC ..... G03G 15/0881
USPC ..... 399/106, 258, 160, 262, 263
See application file for complete search history.

(56) References Cited

U.S. PATENT DOCUMENTS

| | | | | |
|---|---|---|---|---|
| 5,305,064 | A * | 4/1994 | Trott et al. | 399/258 |
| 5,655,195 | A | 8/1997 | Ichikawa et al. | |

(Continued)

FOREIGN PATENT DOCUMENTS

| | | | |
|---|---|---|---|
| EP | 0 423 741 | A2 | 4/1991 |
| EP | 0 989 472 | A2 | 3/2000 |

(Continued)

OTHER PUBLICATIONS

International Search Report issued Jun. 26, 2012 in Application No. PCT/JP2012/059301.

(Continued)

*Primary Examiner* — Susan Lee
(74) *Attorney, Agent, or Firm* — Oblon, McClelland, Maier & Neustadt, L.L.P.

(57) ABSTRACT

A powder storage container capable of preventing erroneous opening of a powder loading port. The powder storage container includes a powder storage part configured to store a developer used for image forming, a powder discharge part provided on one end part of the powder storage part to discharge the developer stored in the powder storage part, a gripping part protruding through an end face of the one end part side of the powder storage part, a powder loading port causing an inner space of the powder storage part and an outer portion of the powder storage part to communicate with each other, and a sealing member capable of sealing the powder loading port. The powder loading port is enclosed by the gripping part.

17 Claims, 64 Drawing Sheets

(56) References Cited

U.S. PATENT DOCUMENTS

| | | | | |
|---|---|---|---|---|
| 5,740,507 | A | 4/1998 | Ichikawa et al. | |
| 5,842,092 | A | 11/1998 | Jyoroku | |
| 6,185,401 | B1 | 2/2001 | Kanamori et al. | |
| 6,266,505 | B1 * | 7/2001 | Ban et al. | 399/258 |
| 6,304,739 | B1 | 10/2001 | Katsuyama et al. | |
| RE37,542 | E | 2/2002 | Ichikawa et al. | |
| 6,678,492 | B1 | 1/2004 | Terazawa et al. | |
| 2001/0017998 | A1 | 8/2001 | Terazawa et al. | |
| 2001/0021325 | A1 | 9/2001 | Katsuyama et al. | |
| 2001/0041083 | A1 | 11/2001 | Terazawa et al. | |
| 2002/0102113 | A1 | 8/2002 | Kusano et al. | |
| 2003/0156861 | A1 * | 8/2003 | Nagano et al. | 399/262 |
| 2004/0022559 | A1 | 2/2004 | Kusano et al. | |
| 2004/0091289 | A1 | 5/2004 | Terazawa et al. | |
| 2004/0253023 | A1 | 12/2004 | Terazawa et al. | |
| 2005/0196180 | A1 | 9/2005 | Harumoto | |
| 2006/0099012 | A1 | 5/2006 | Kita et al. | |
| 2007/0140747 | A1 | 6/2007 | Kita et al. | |
| 2007/0147902 | A1 | 6/2007 | Taguchi et al. | |
| 2007/0177886 | A1 | 8/2007 | Taguchi et al. | |
| 2007/0206975 | A1 | 9/2007 | Koyama | |
| 2007/0212119 | A1 | 9/2007 | Kurenuma et al. | |
| 2007/0274737 | A1 | 11/2007 | Serizawa et al. | |
| 2008/0124133 | A1 | 5/2008 | Yoshizawa et al. | |
| 2008/0175628 | A1 | 7/2008 | Kita et al. | |
| 2009/0035010 | A1 | 2/2009 | Serizawa et al. | |
| 2010/0098456 | A1 | 4/2010 | Murase et al. | |
| 2010/0119264 | A1 | 5/2010 | Yamaguchi et al. | |
| 2010/0189470 | A1 | 7/2010 | Yoshizawa et al. | |
| 2010/0284710 | A1 | 11/2010 | Sasaki et al. | |
| 2011/0020014 | A1 | 1/2011 | Okamoto et al. | |
| 2011/0020039 | A1 | 1/2011 | Mitsuishi et al. | |
| 2011/0097094 | A1 * | 4/2011 | Hamano et al. | 399/258 |
| 2011/0123216 | A1 | 5/2011 | Mitsuishi et al. | |
| 2011/0243579 | A1 | 10/2011 | Oshikawa et al. | |
| 2011/0286771 | A1 | 11/2011 | Taguchi et al. | |
| 2011/0305485 | A1 | 12/2011 | Oshikawa et al. | |

FOREIGN PATENT DOCUMENTS

| | | | |
|---|---|---|---|
| EP | 1 220 052 | A2 | 7/2002 |
| EP | 2 169 474 | A1 | 3/2010 |
| JP | 7-199620 | | 8/1995 |
| JP | 7-261525 | | 10/1995 |
| JP | 10-39596 | | 2/1998 |
| JP | 2000-10389 | A | 1/2000 |
| JP | 2000-203609 | | 7/2000 |
| JP | 2003-29515 | A | 1/2003 |
| JP | 2003-57933 | | 2/2003 |
| JP | 2003-107892 | | 4/2003 |
| JP | 2003-107908 | A | 4/2003 |
| JP | 2005-250375 | | 9/2005 |
| JP | 2006-84755 | | 3/2006 |
| JP | 2007-148320 | | 6/2007 |
| JP | 2007-178969 | | 7/2007 |
| JP | 2007-240633 | | 9/2007 |
| JP | 2007-276880 | | 10/2007 |
| JP | 2007-316309 | | 12/2007 |
| JP | 2008-6823 | | 1/2008 |
| JP | 2008-201440 | | 9/2008 |
| JP | 2009-8698 | | 1/2009 |
| JP | 2009-237586 | | 10/2009 |
| JP | 2010-79073 | | 4/2010 |
| JP | 2010-91614 | | 4/2010 |
| JP | 2011-27823 | | 2/2011 |
| JP | 2011-27934 | | 2/2011 |
| JP | 2011-27936 | | 2/2011 |

OTHER PUBLICATIONS

Office Action issued Jan. 6, 2015 in Japanese Patent Application No. 2011-097315.

Office Action issued Jan. 6, 2015 in Japanese Patent Application No. 2011-097308.

Extended European Search Report issued Mar. 5, 2015 in Patent Application No. 12763677.7.

Office Action issued Apr. 28, 2015 in Japanese Patent Application No. 2011-097308.

* cited by examiner view-A view-B

POWDER STORAGE CONTAINER AND IMAGE FORMING APPARATUS IN WHICH A GRIPPING PART INCLUDES A POWDER LOADING PORT AND A SEALING MEMBER

TECHNICAL FIELD

The present invention relates to a powder storage container for storing a developer supplied to an image forming apparatus such as a copy machine, a printer, a facsimile machine, a multifunctional machine incorporating those machines, and the like, and to an image forming apparatus in which such a powder storage container is mounted. More particularly, the present invention relates to a powder storage container and an image forming apparatus, in which a RFID (Radio Frequency Identification) (called also "RFID" tag) is mounted.

BACKGROUND ART

An image forming apparatus is known that is configured to form an image by visualizing an electrostatic latent image formed on a latent image carrier by a developing device using a toner as a developer. In such an image forming apparatus, the toner in the developing device is consumed in the course of image formation. Therefore, to supply the toner to the developing device in the image forming apparatus, use of a toner container as a powder storage container storing the toner is considered. As such a toner container, one is known that has a configuration in which a powder loading port for loading the toner is provided and is plugged by attaching a sealing member thereon (refer to Patent Document 1).

SUMMARY OF INVENTION

Technical Problem

However, the toner container described above has a problem that there is a possibility that the seal member may be removed by user's erroneous operation, and thereby the powder loading port is opened, and as a result, the toner stored inside is scattered out.

It is an object of the present invention to provide a powder storage container capable of preventing a powder loading port from being opened by an erroneous operation, and an image forming apparatus including the powder storage container.

Solution to Problem

The powder storage container according to the present invention includes a powder storage part configured to store a developer used for image forming, a powder discharge port provided on one end of the powder storage part to discharge the developer stored in the powder storage part, a gripping part projecting through an end face of the one end of the powder storage part, a powder loading port causing an inner space of the powder storage part and an outer portion of the powder storage part to communicate with each other, and a sealing member capable of sealing the powder loading port, wherein the powder loading port is enclosed by the gripping part.

Advantageous Effects of Invention

In the powder storage container according to the present invention, the powder loading port is enclosed by the gripping port and sealed by the sealing element so as to prevent the powder loading port from being opened due to erroneous detachment of the sealing member therefrom.

In the powder storage container according to the present invention, the powder loading port for loading a developer is enclosed by the gripping part and sealed by the sealing element so as to prevent the powder loading port from being opened due to erroneous detachment of the sealing member therefrom.

Figure 34:
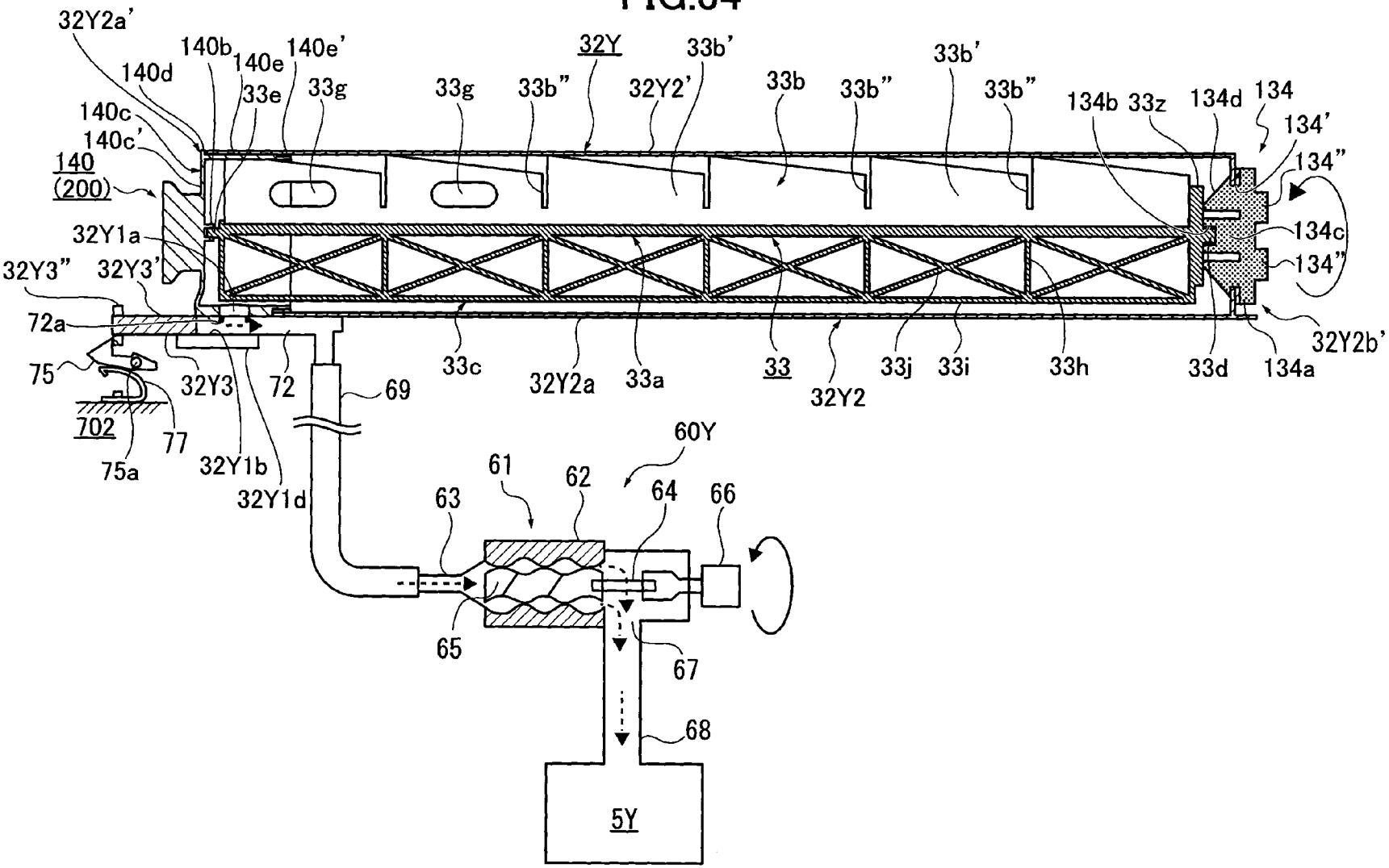
FIG. 34 is a schematic view for explaining a toner supply device.
Figure 59:
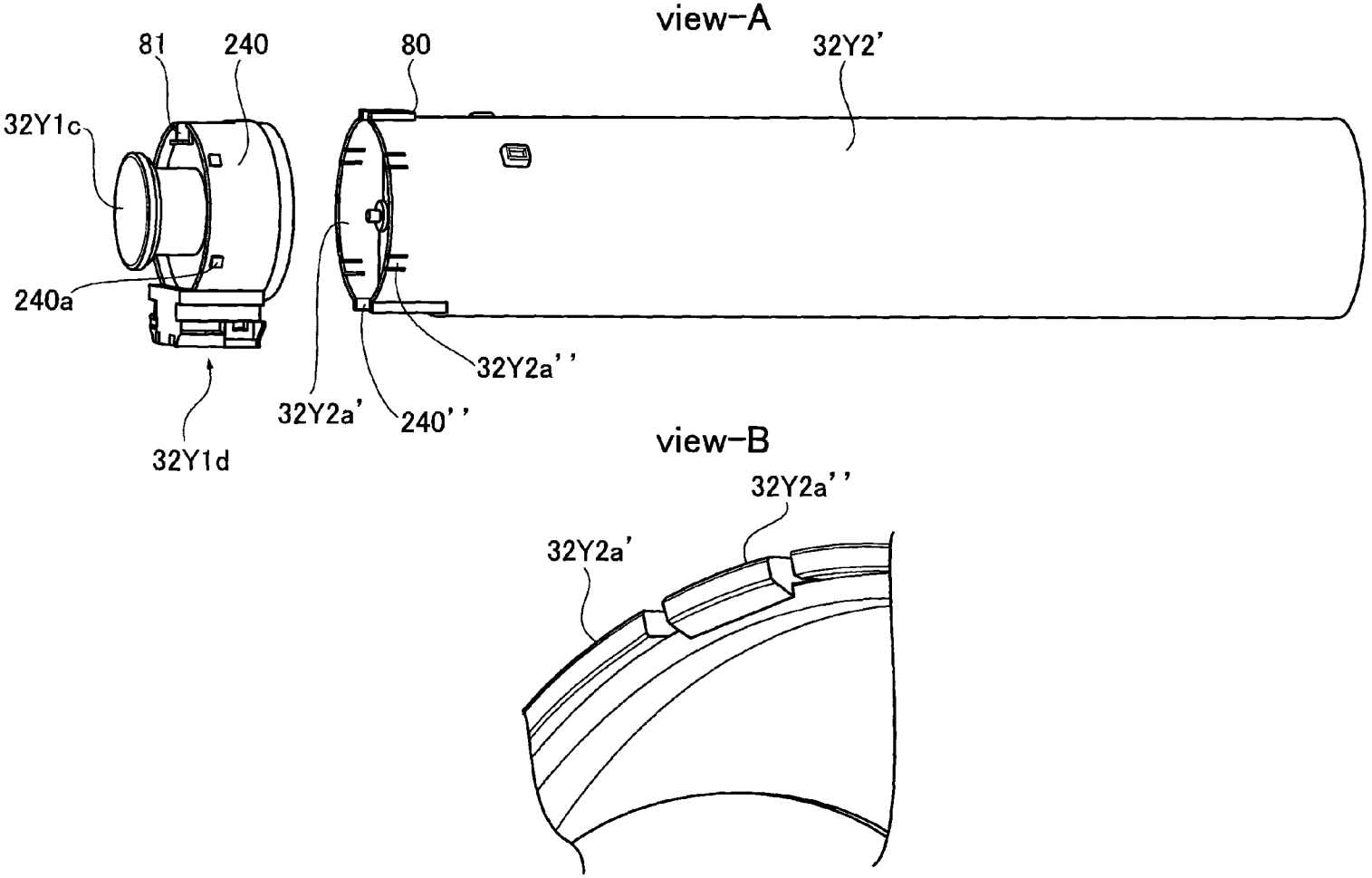

View-A of FIG. 59 is a perspective view showing an appearance of the cylindrical body and the first cap member as components comprising the container main body shown in FIG. 34, and view-B of FIG. 59 is a perspective view showing an engagement claw part provided on an end portion of the cylindrical body.

Figure 60:
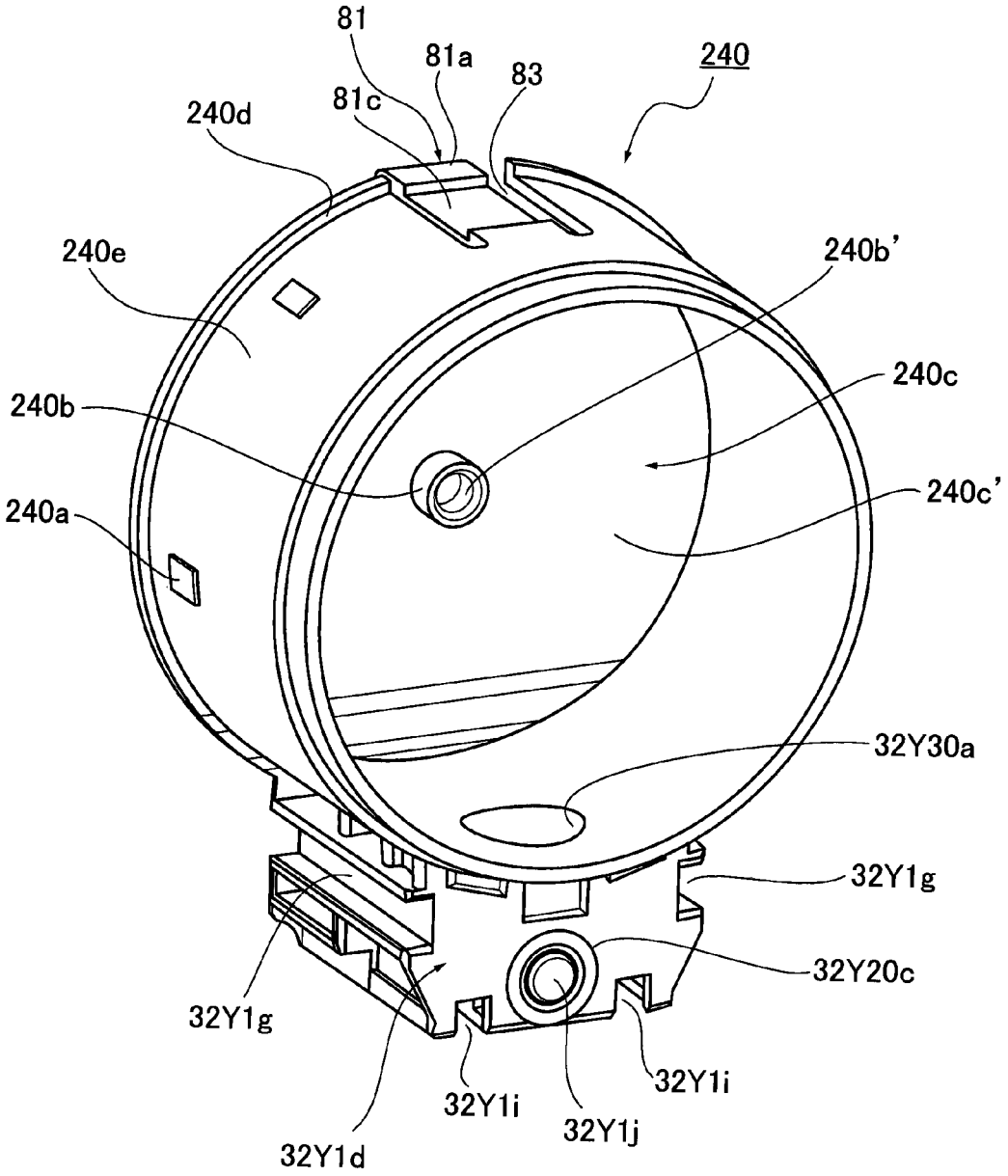

FIG. 60 is a perspective view showing an appearance of the first cap member as a component comprising the container main body shown in FIG. 34.

Figure 61:
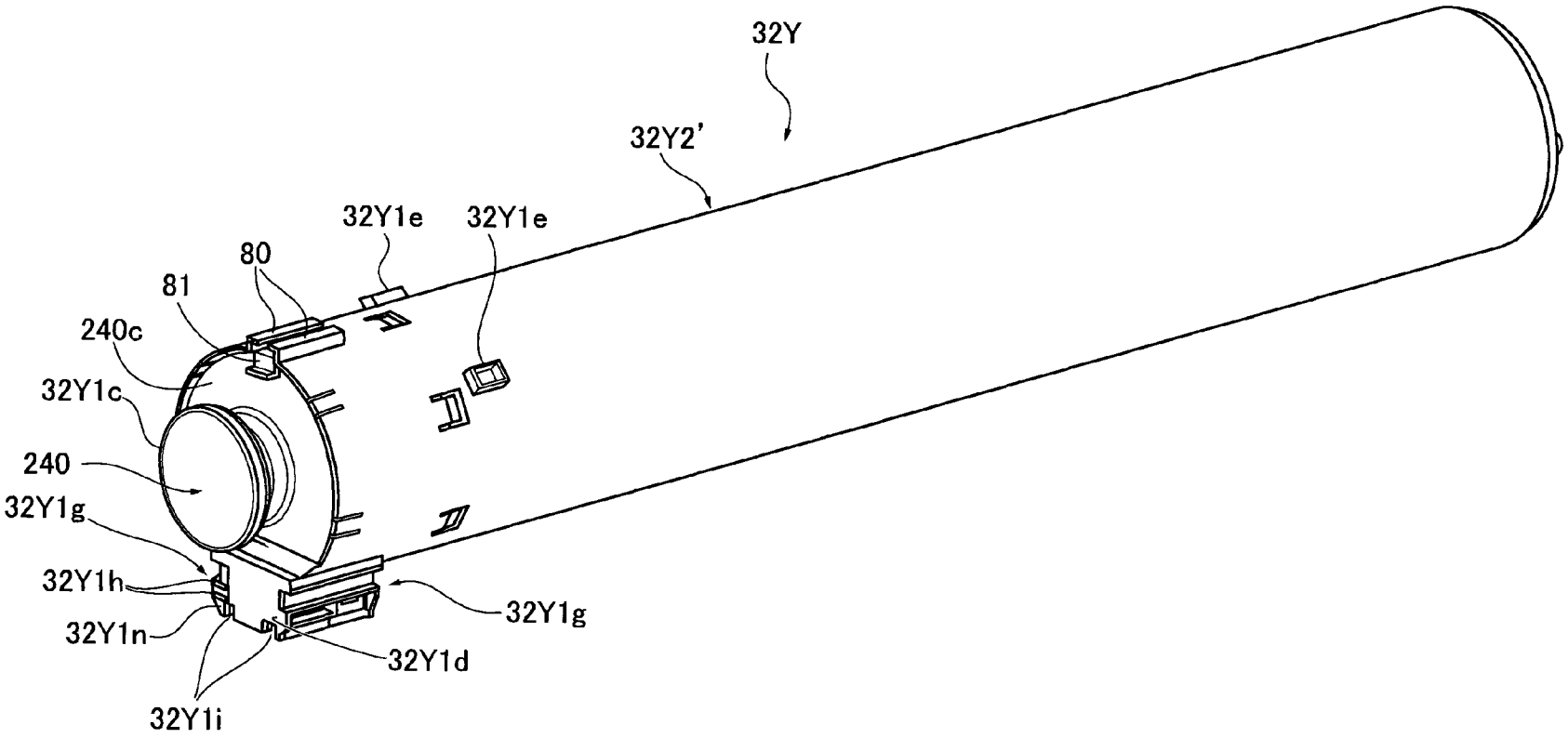

FIG. 61 is a perspective view showing an appearance of the toner container.

Figure 62:
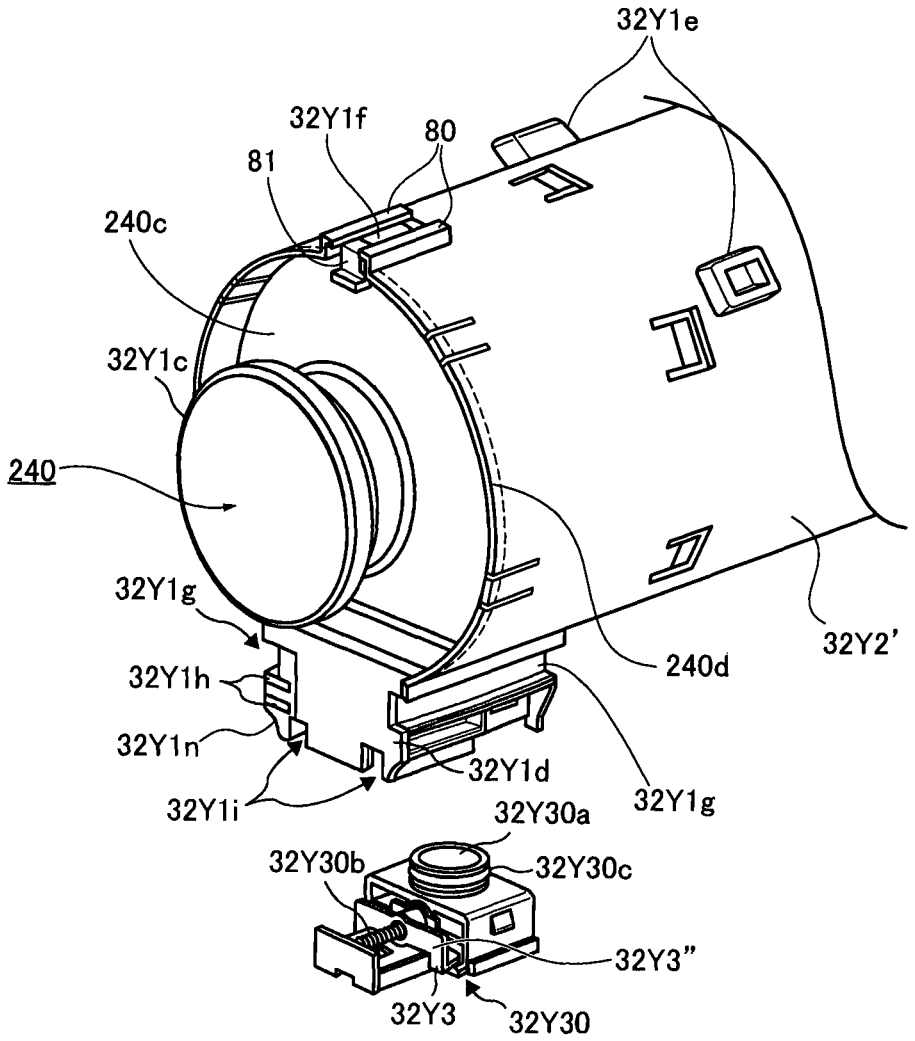

FIG. 62 is a detailed perspective view showing an appearance of the first cap element mounted to an opening at the one end side of the container main body, and a nozzle insertion port fitted to a toner discharge port of the first cap element.

Figure 63:
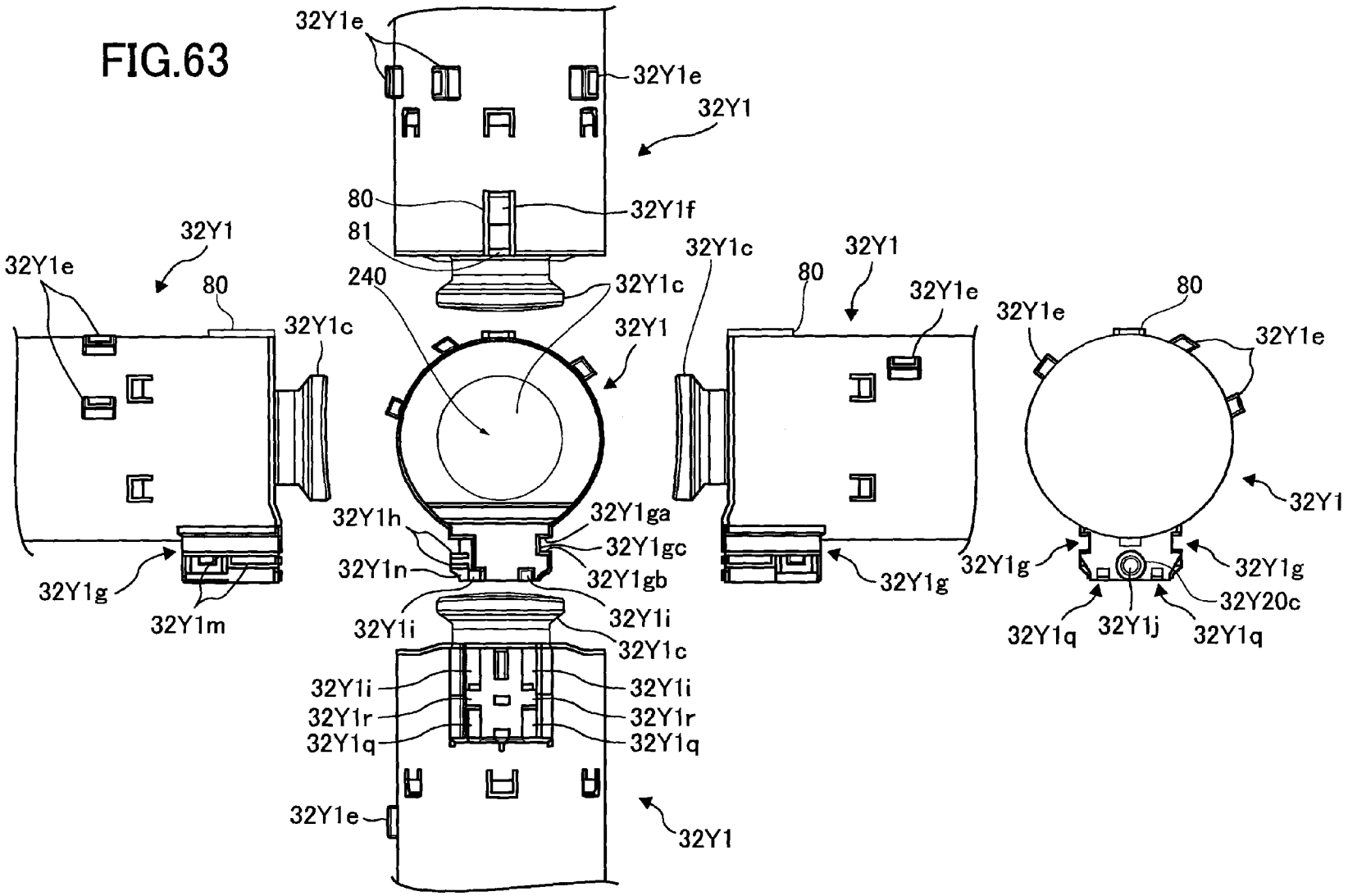

FIG. 63 is a six-sides view showing an appearance of the first cap member mounted to an opening at the one end side of the container main body, and a vicinity of an opening at the one end side of the cylindrical body.

Figure 64:
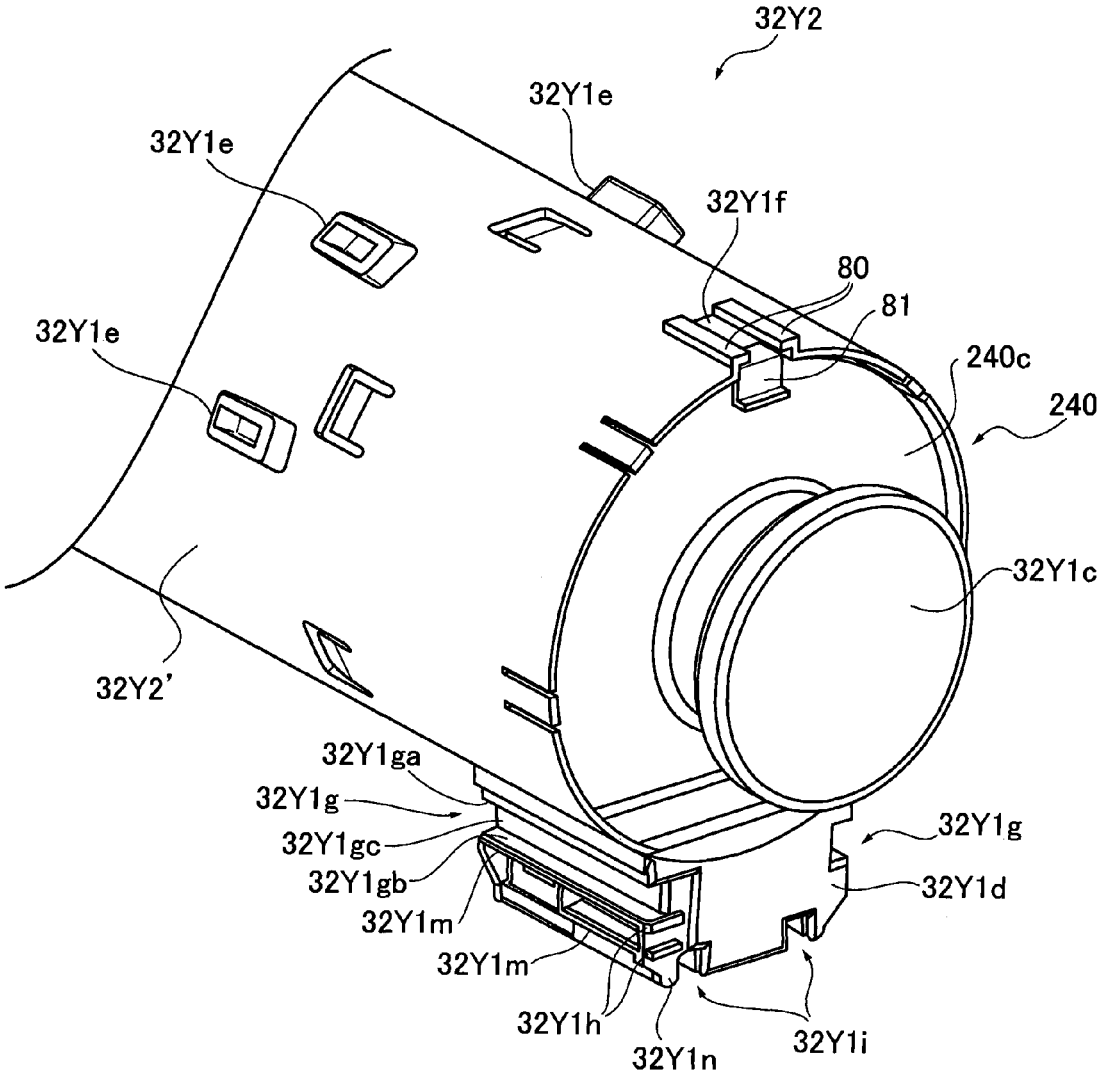

FIG. 64 is a partially enlarged perspective view showing a state when the first cap member is mounted to an opening at one end side of the cylindrical body.

Figure 65:
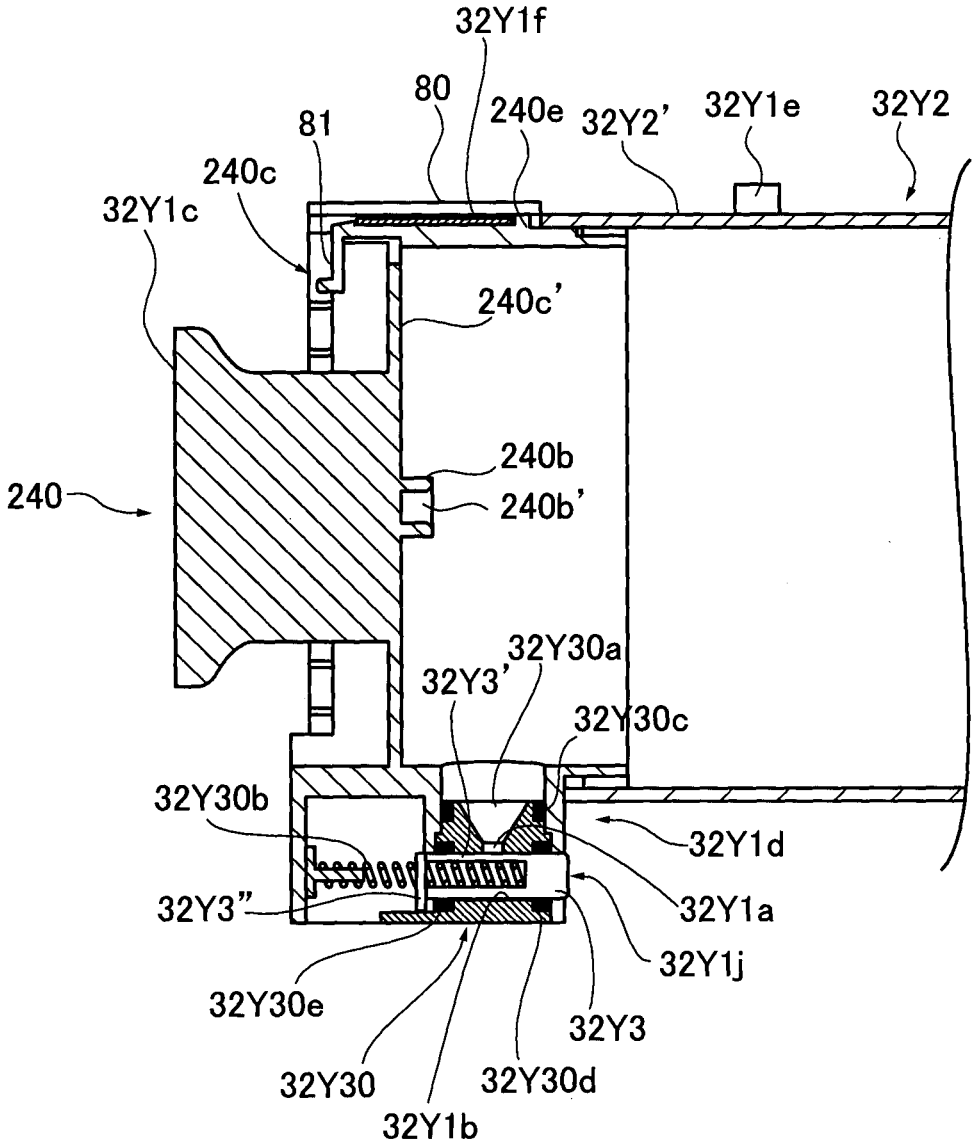

FIG. 65 is a partial cross-sectional view showing a state when the first cap member and an opening at one end side of the cylindrical body are fitted to each other.

Figure 66:
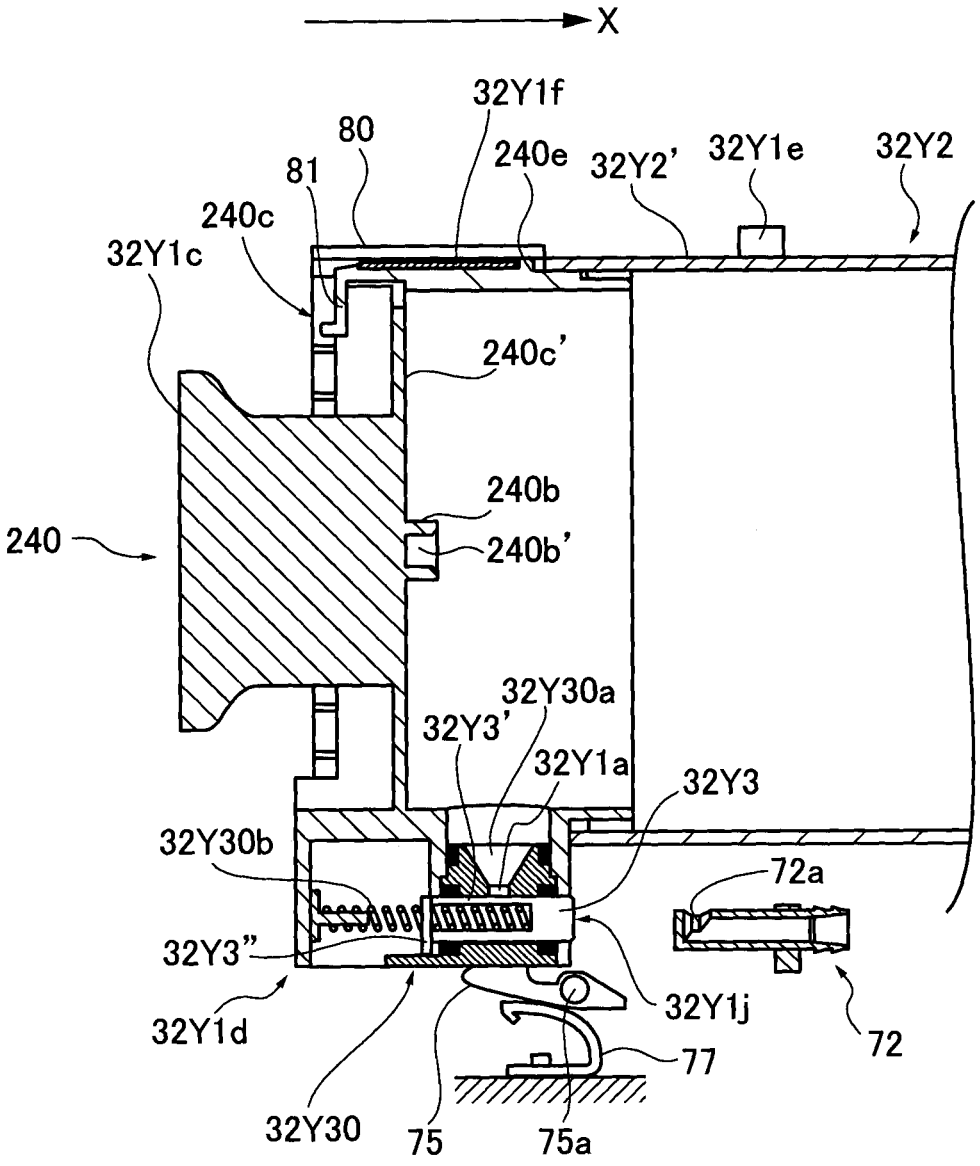

FIG. 66 is a partial cross-sectional view showing a state when the toner container is mounted to the toner container storage part.

Figure 22:
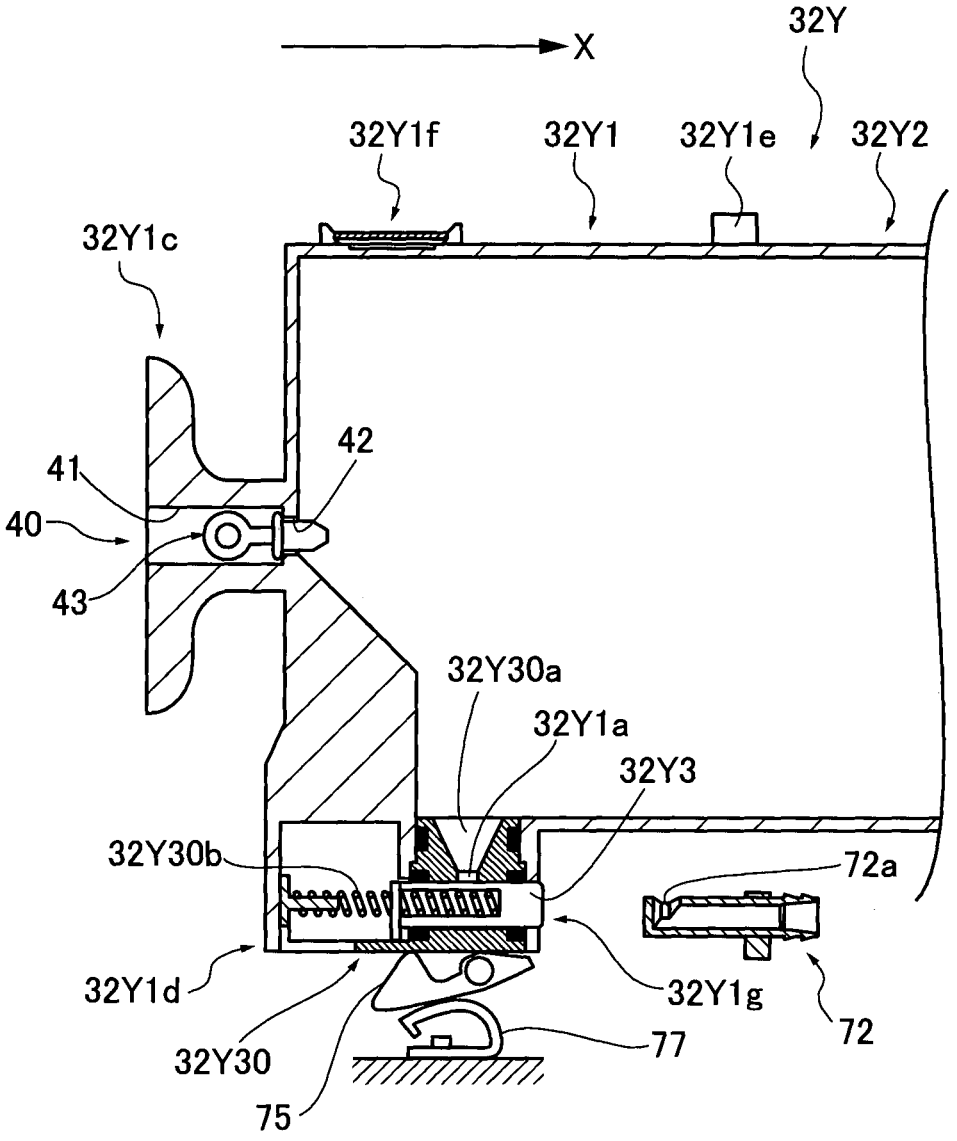
FIG. 22 is a cross-sectional view showing a state of the inserted toner container following FIG. 21.
Figure 67:
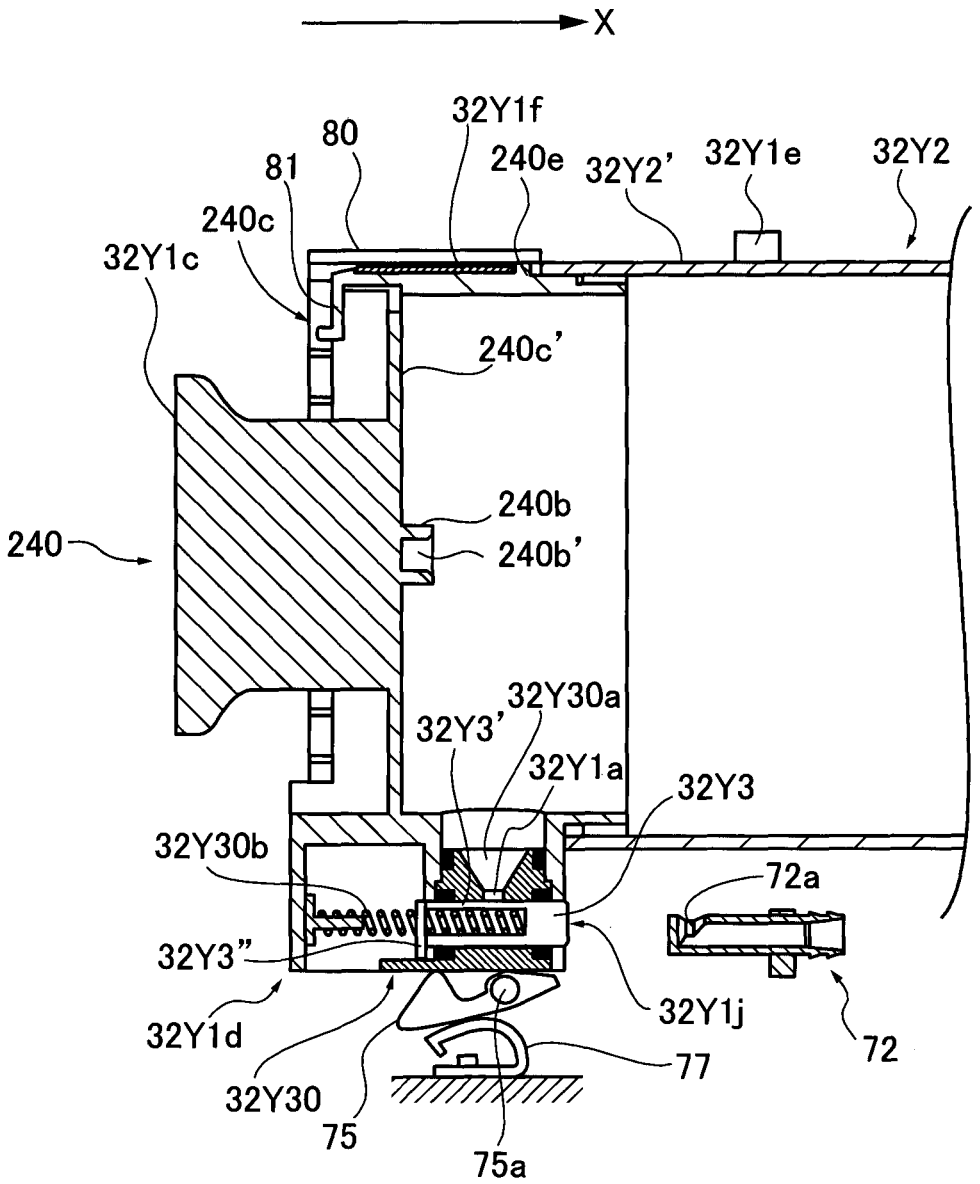

FIG. 67 is a cross-sectional view showing a state following FIG. 22 when the toner container is mounted.

Figure 23:
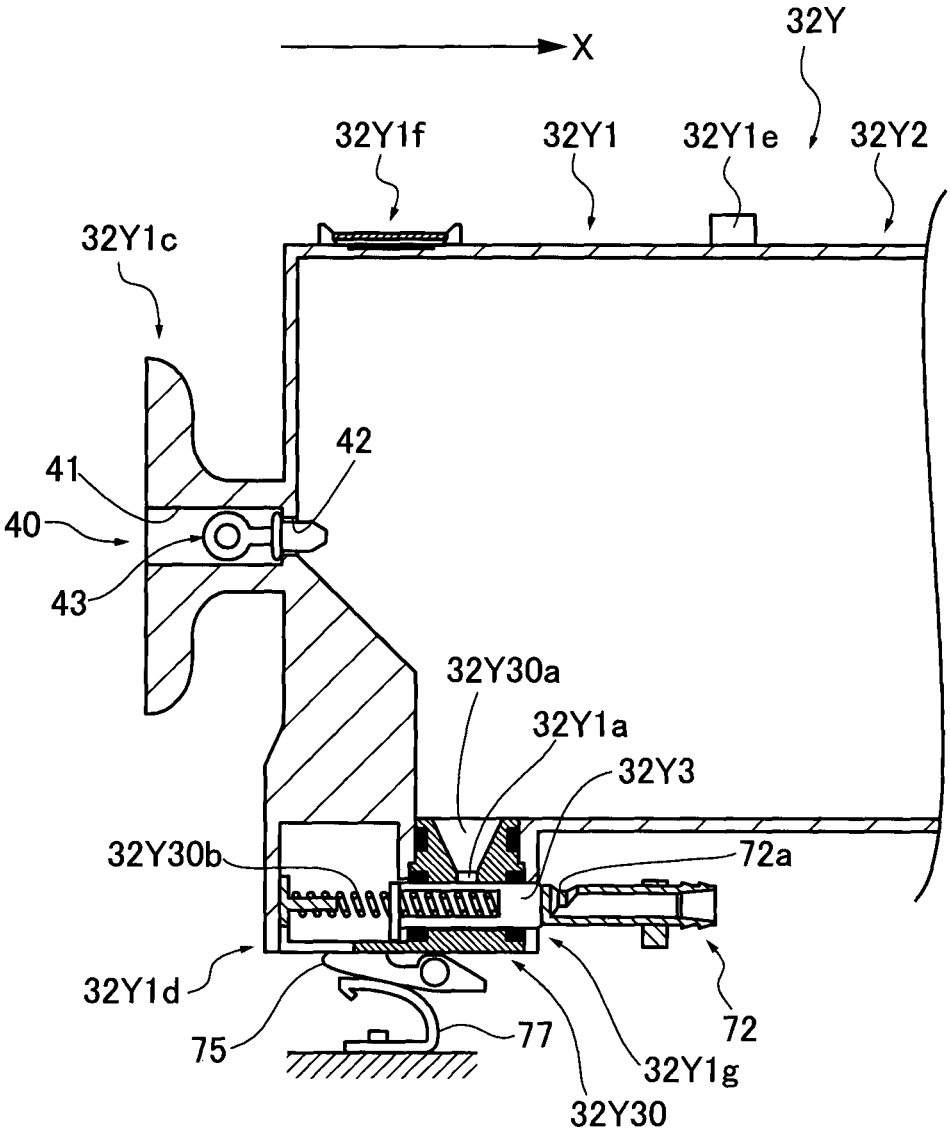
FIG. 23 is a cross-sectional view showing a state of the inserted toner container following FIG. 22.
Figure 68:
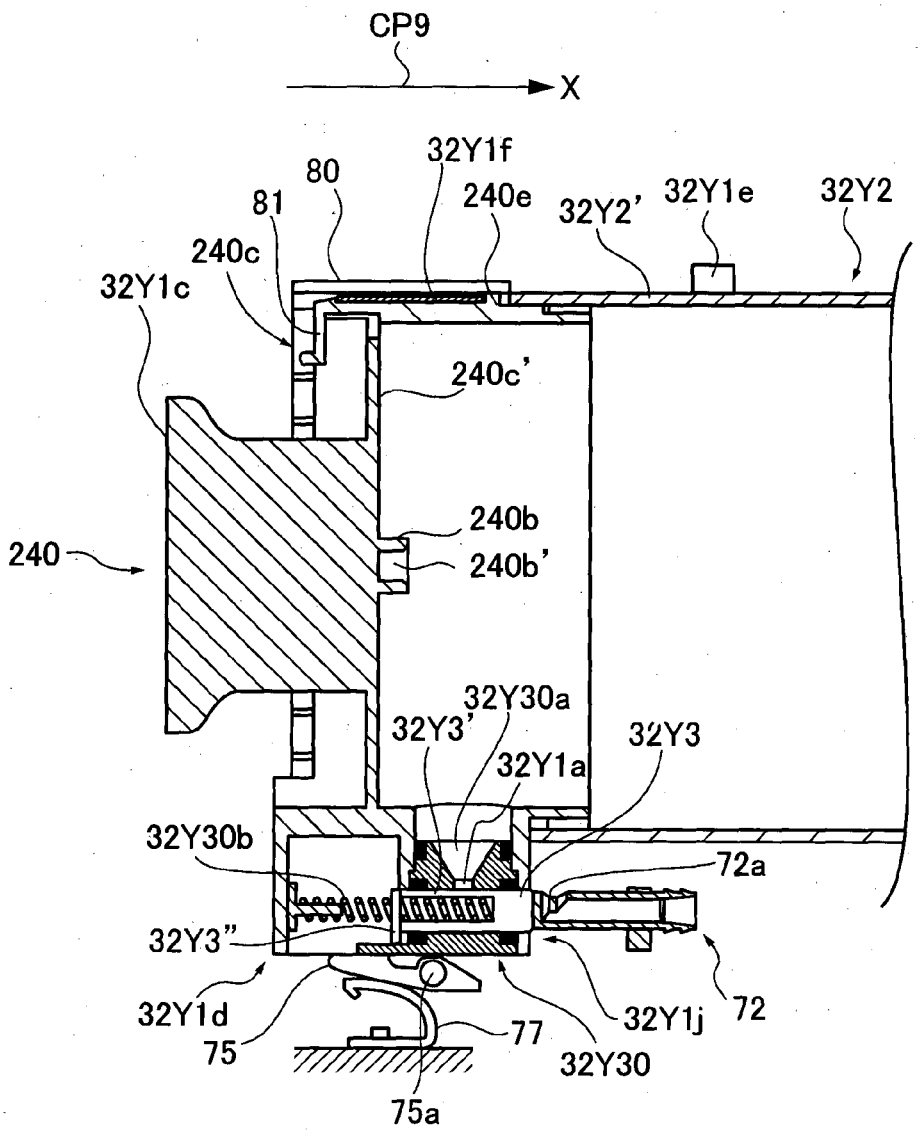

FIG. 68 is a cross-sectional view showing a state when a nozzle tube shown in FIG. 22 and FIG. 23 comes into contact with a cylindrical portion of the plug member.

Figure 69:
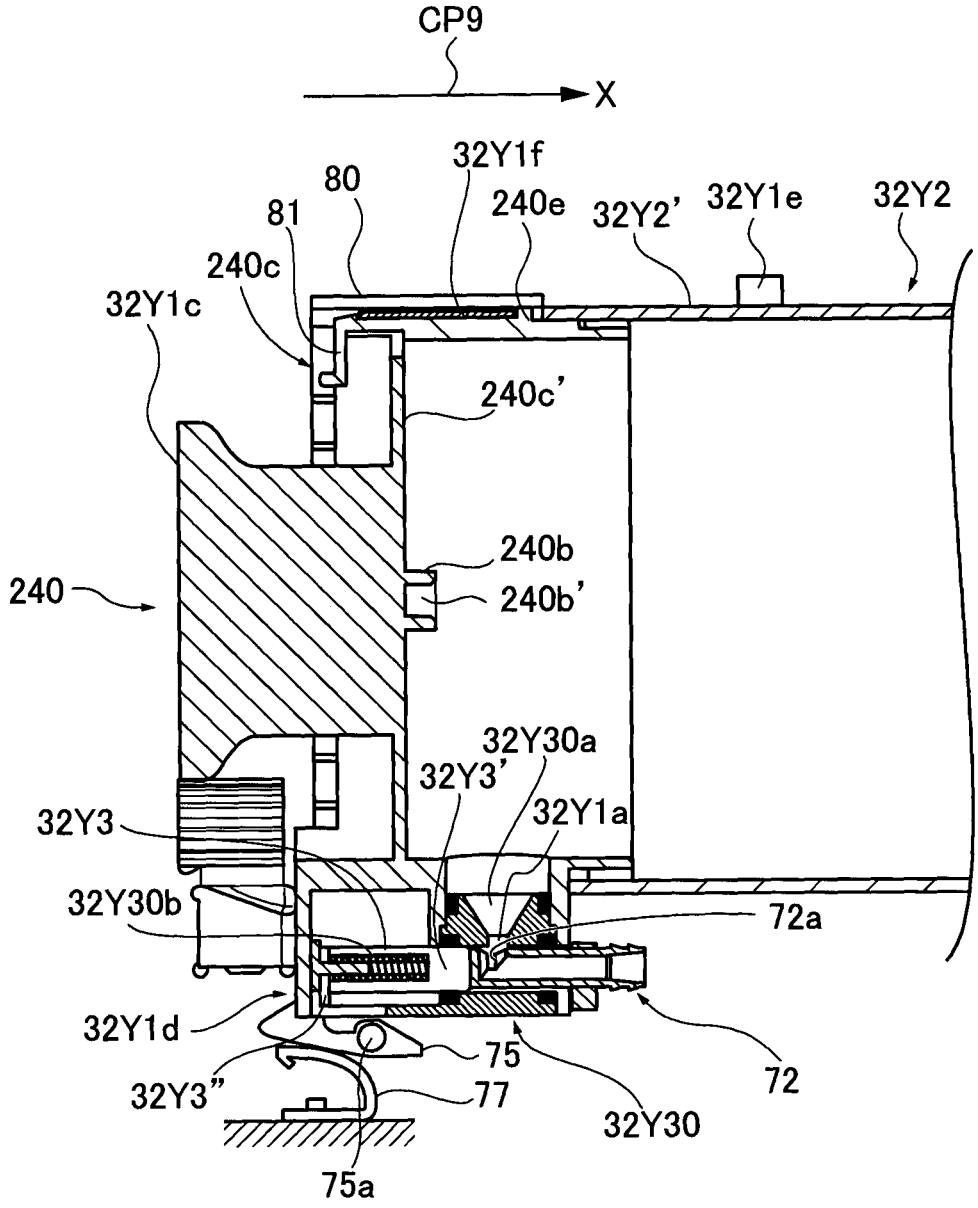

FIG. 69 is a cross-sectional view showing a state when the toner container is finally mounted to the toner container storage part.

Figure 70:
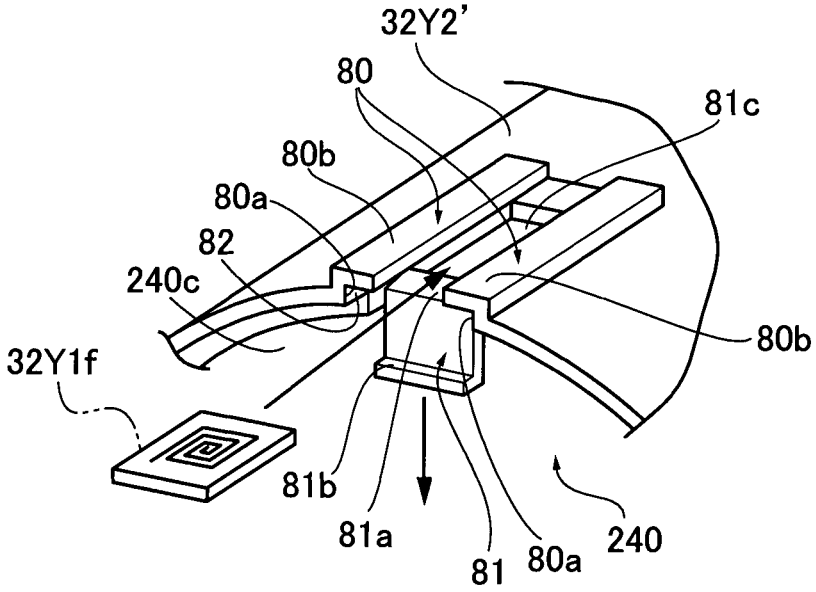

FIG. 70 is a schematic perspective view showing a RFID chip holding configuration according to Embodiment 10 of the present invention.

Figure 71:
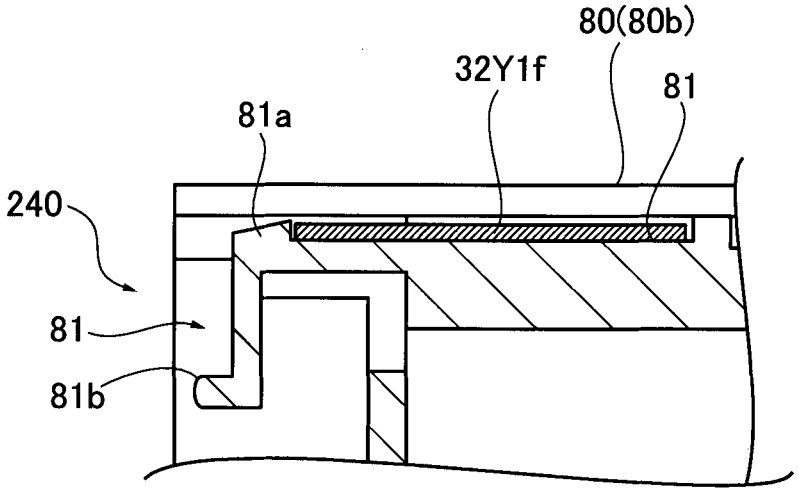

FIG. 71 is an enlarged cross-sectional view showing a state how the RFID chip is held.

Figure 72:
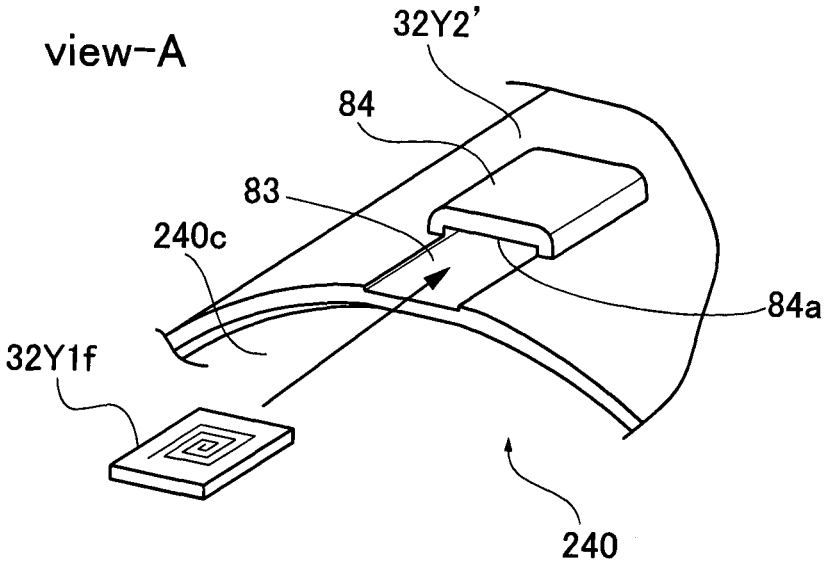
Figure 72:
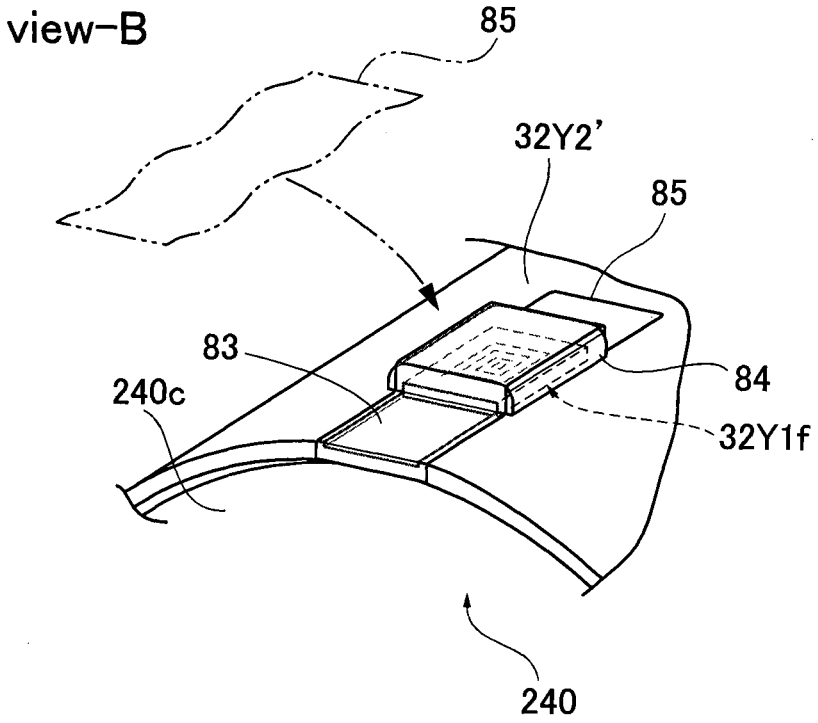

View-A and view-B of FIG. 72 are schematic perspective views showing a RFID chip holding configuration according to Embodiment 11 of the present invention.

Figure 73:
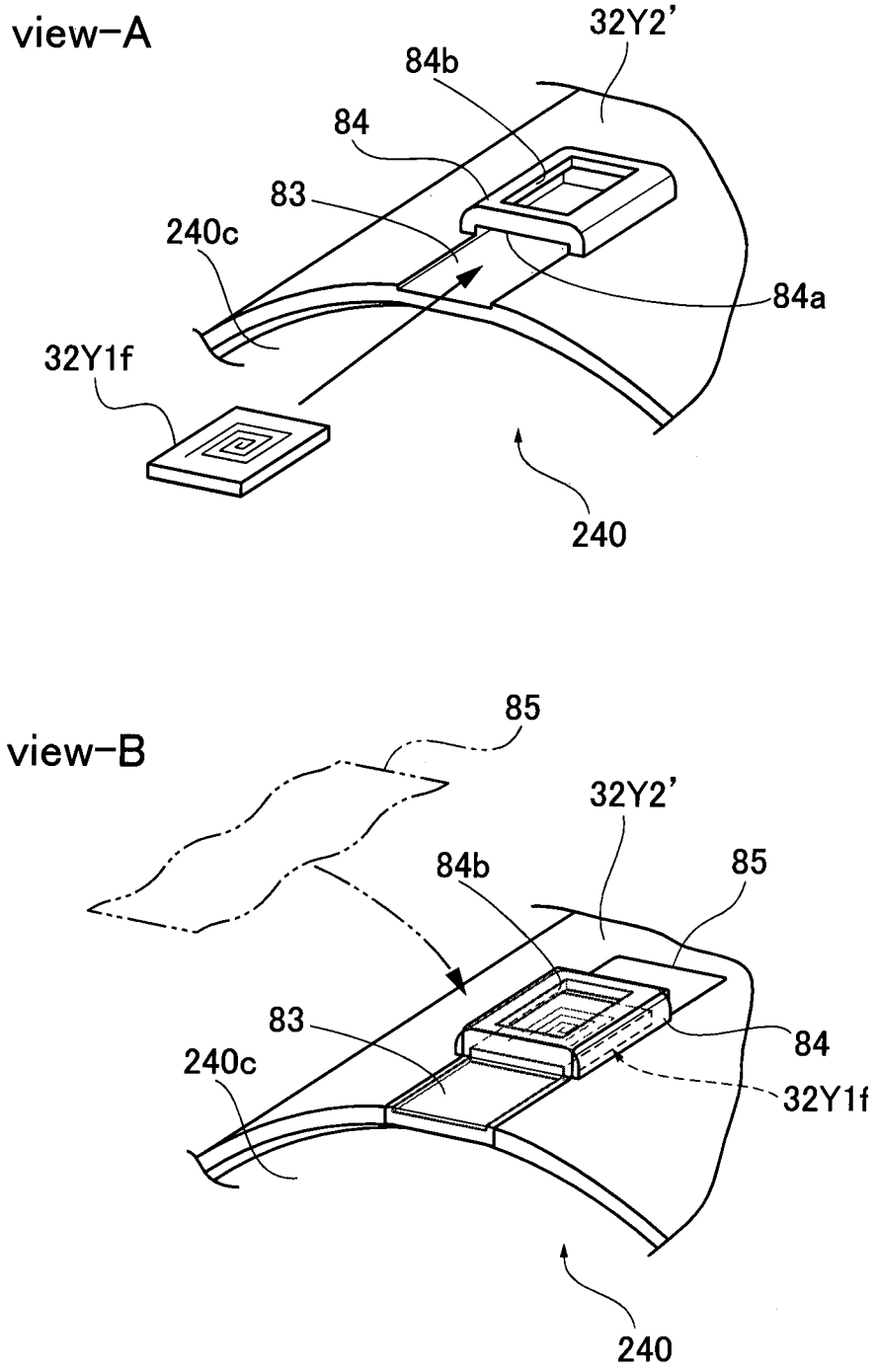

View-A and view-B of FIG. 73 are schematic perspective views showing a RFID chip holding configuration according to Embodiment 12 of the present invention.

Figure 74:
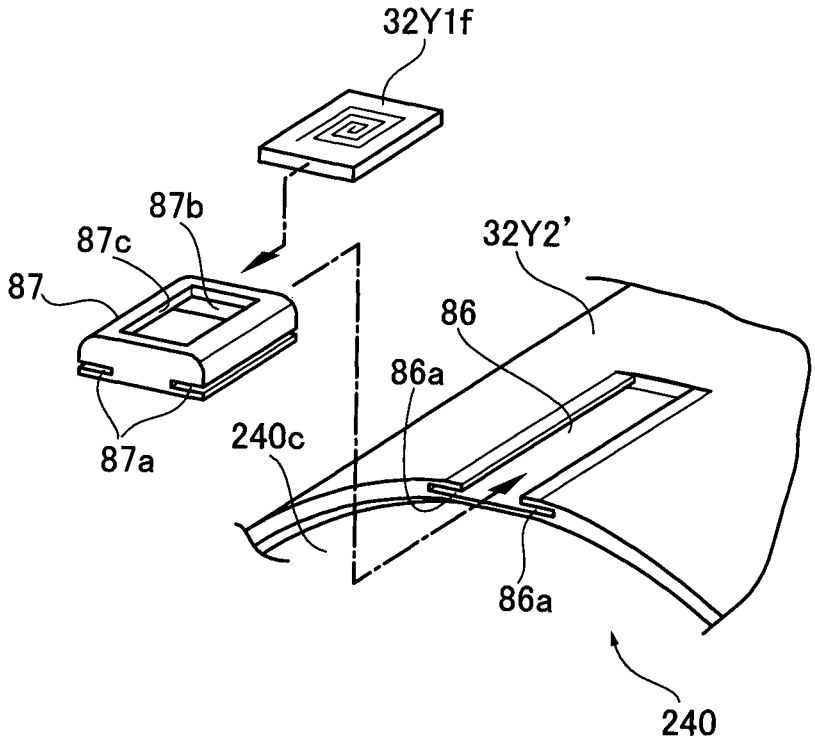
Figure 74:
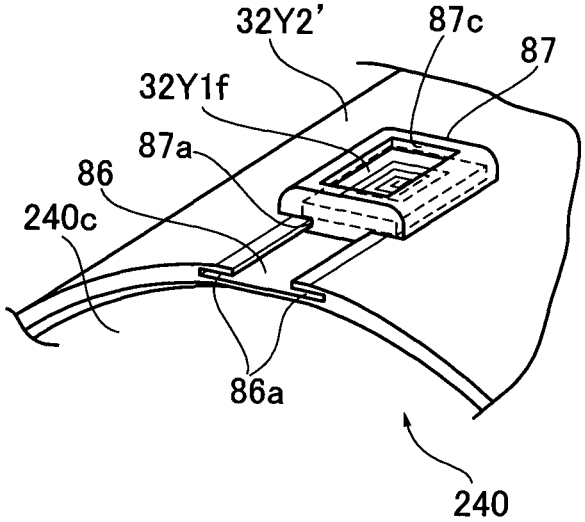

View-A and view-B of FIG. 74 are schematic perspective views showing a RFID chip holding configuration according to Embodiment 13 of the present invention.

Figure 75:
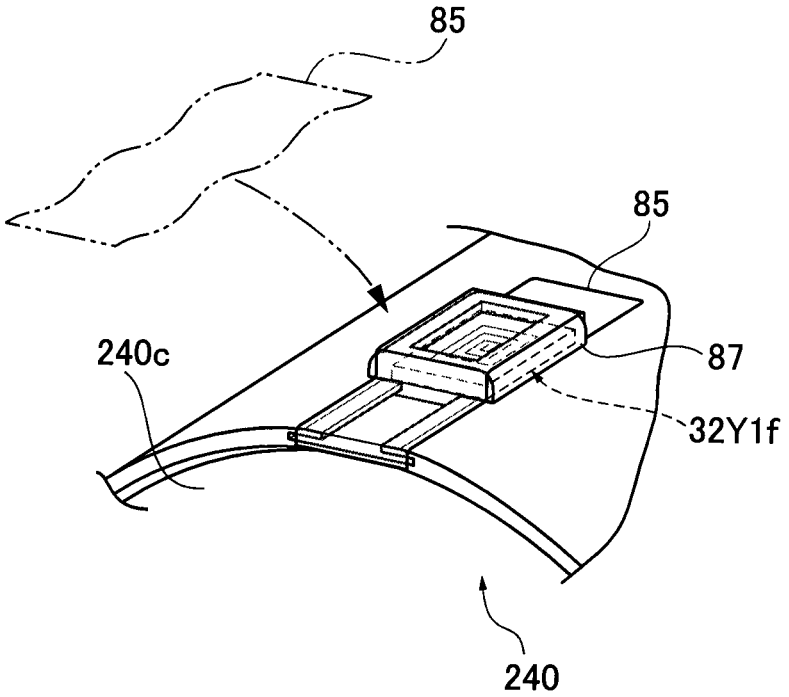

FIG. 75 is a schematic perspective view showing a modified example of a RFID chip holding configuration according to Embodiment 13.

DESCRIPTION OF EMBODIMENTS

Hereinafter, embodiments of the powder storage container according to the present invention are described with reference to the accompanying drawings. In the drawings, same or corresponding parts are denoted with same reference numerals to simplify or omit duplicate description thereof in an appropriate manner.

Embodiment 1

Configurations of toner containers (32Y, 32M, 32C, 32K) according to one embodiment of the powder storage container of the present invention and an image forming apparatus 100 to which the toner containers can be mounted are described. First, the configuration of the image forming apparatus 100 and its operation are described.

Figure 1:
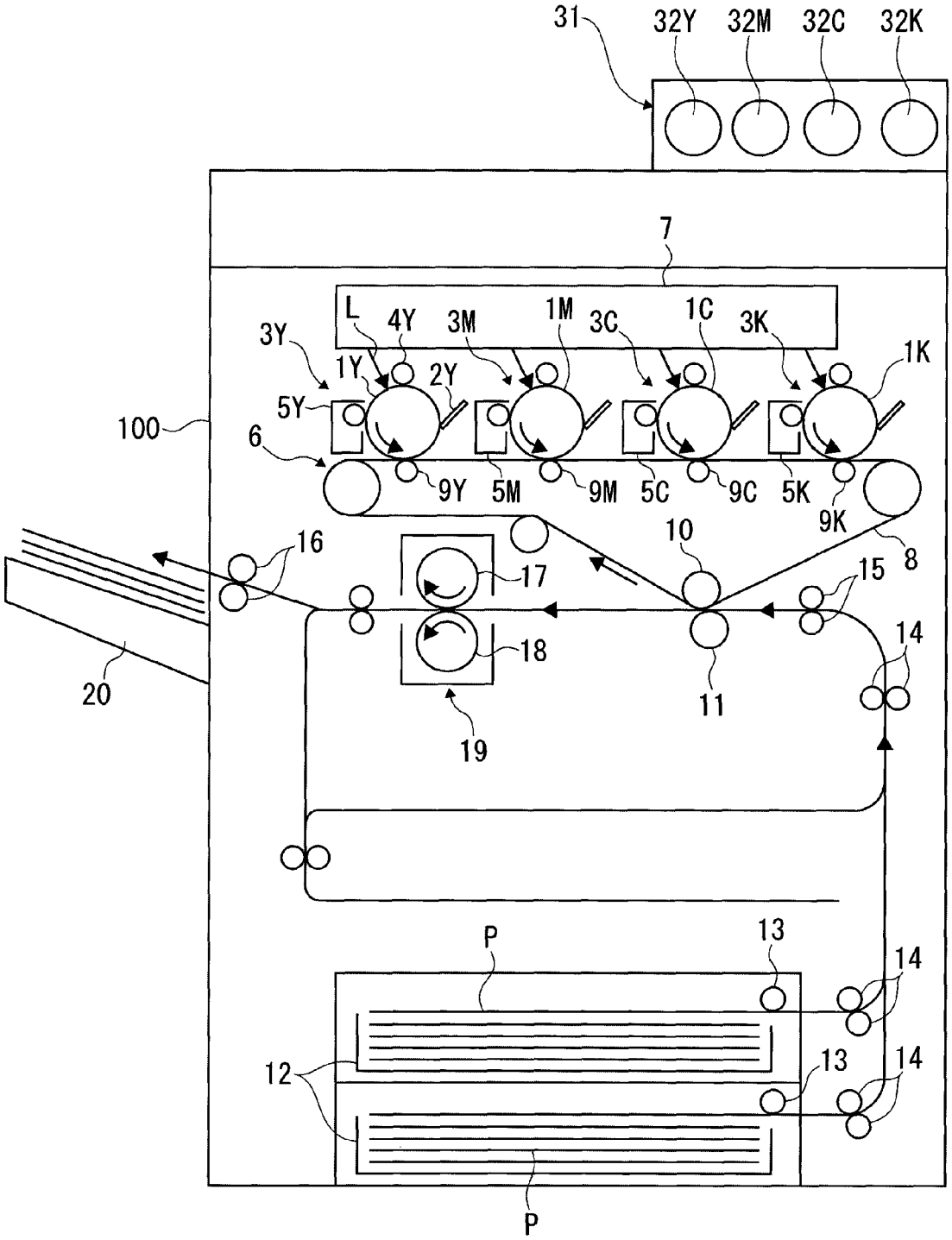
FIG. 1 is an overall configuration view of an image forming apparatus according to Embodiment 1 of the present invention.

The image forming apparatus 100 according to Embodiment 1 is a color printer as shown in FIG. 1, which is configured in a box-shaped housing. In the image forming apparatus 100, a toner container storage part 31 is provided on an upper part thereof. In the toner container storage part 31, four toner containers (powder storage containers) 32Y, 32M, 32C and 32K corresponding to respective colors (yellow, magenta, cyan and black) are installed in a detachable (replaceable) manner, and are configured so as to be exposed to outside of the image forming apparatus 100 by opening a main body cover (not shown) provided on the front side of the image forming apparatus 100 (housing thereof).

The toner container storage part 31 supplies the toner from toner containers 32Y, 32M, 32C and 32K installed therein in an appropriate manner depending on toner consumption in developing devices of respective colors. The configuration of the toner container storage part 31 will be described in detail later. In the toner container storage part 31, each of the toner containers 32Y, 32M, 32C and 32K is removed and a new toner container is mounted therein when the toner container reaches the end of operation life thereof (when the toner container has run out of the toner stored inside substantially consumed). This configuration will be also described in detail later. Note that in the image forming apparatus 100, four units of imaging part (3) and the like as well as the toner container are mounted therein corresponding to respective colors (yellow, magenta, cyan and black). Since those units have basically the same configuration, description below is made for the configuration for any one color, and description of configurations for the other colors is omitted.

Figure 3:
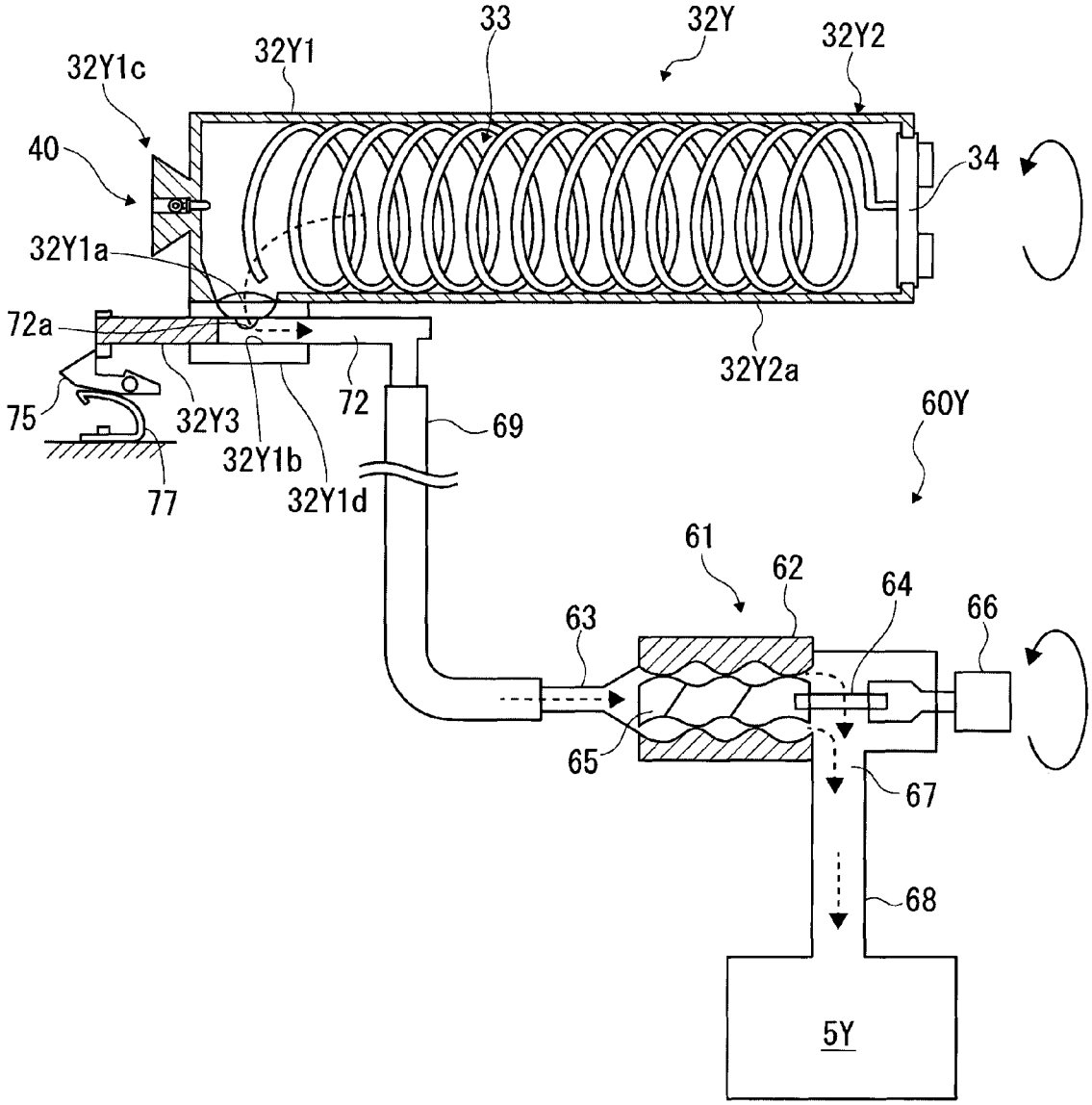
FIG. 3 is a schematic view showing a toner supply device.

The image forming apparatus 100 according to the present invention includes four imaging parts 3Y, 3M, 3C and 3K corresponding to the respective colors (yellow, magenta, cyan and black). The imaging parts 3Y, 3M, 3C and 3K are configured in a manner detachable from the image forming apparatus 100. Although not shown, toner supply devices (only 60Y corresponding to yellow is shown in FIG. 3) are disposed above the imaging parts 3Y, 3M, 3C and 3K. The toner supply devices (refer to numeral 60Y in FIG. 3) supply the toner as a powder stored in toner containers 32Y, 32M, 32C and 32K into developing devices 5Y, 5M, 5C and 5K of imaging parts 3Y, 3M, 3C and 3K in an appropriate manner.

In the image forming apparatus 100, en exposing part 7 and an intermediate transfer unit 6 are disposed below the toner container storage part 31. The intermediate transfer unit 6 includes an intermediate transfer belt 8, four primary transfer bias rollers 9Y, 9M, 9C and 9*k*, a secondary transfer backup roller 10, a plurality of tension rollers and an intermediate transfer cleaning part. In the intermediate transfer unit 6, the intermediate transfer belt 8 is supported by being suspended by a plurality of rollers and moved endlessly in an arrow direction by rotation and drive of the secondary transfer backup roller 10. Opposite to the intermediate transfer belt 8, the imaging parts 3Y, 3M, 3C and 3K corresponding to the respective colors (yellow, magenta, cyan and black) are disposed in parallel.

Figure 2:
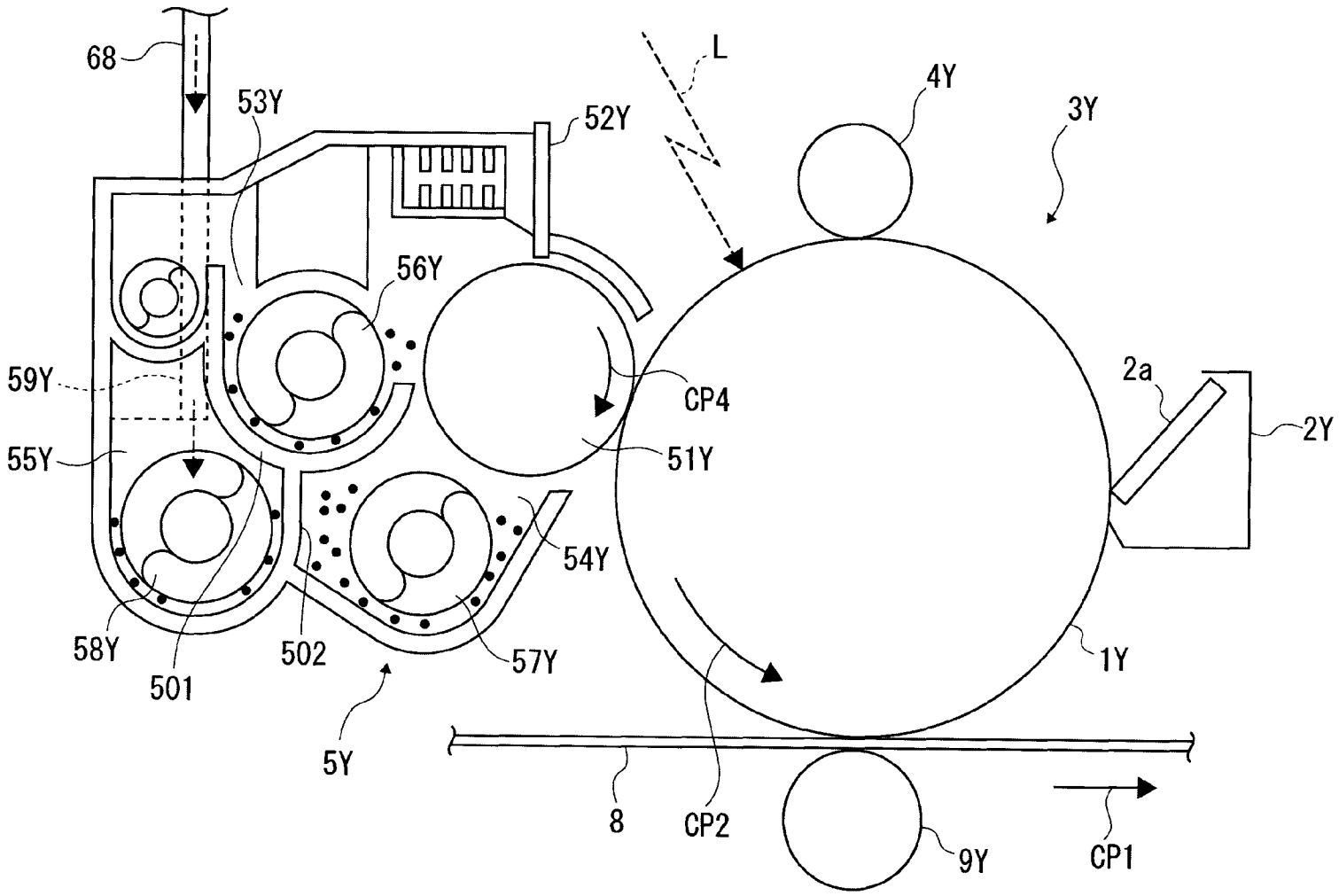
FIG. 2 is an enlarged view for explaining one example of an imaging part shown in FIG. 1.

Referring to the imaging part 3Y corresponding to yellow, the imaging part includes, as shown in FIG. 2, a photosensitive drum 1Y, a charging part 4Y disposed around the photosensitive drum 1Y, a developing device 5Y (developing part), a cleaning part 2Y, and discharging part (not shown). In the imaging part 3Y, an imaging process (charging process, exposing process, developing process, transfer process and cleaning process) is performed on the photosensitive drum 1Y so as to form a yellow image.

The photosensitive drum 1Y is rotated and driven by a drive motor (not shown) in a counterclockwise direction as viewed from front side of FIG. 2. The surface of the photosensitive drum 1Y is evenly charged at a position opposite to the charging part 4Y (charging process). Thereafter, the surface of the photosensitive drum 1Y reaches a position to which laser light L emitted from the exposing part 7 (refer to FIG. 1) is irradiated. At this position, an electrostatic latent image corresponding to yellow is formed by exposure scanning (exposing process).

Thereafter, the surface of the photosensitive drum 1Y reaches a position opposite to the developing device 5Y (developing roller 51Y thereof described later), where the electrostatic latent image is developed (visualized) to form a yellow toner image (developing process). Thereafter, when surface of the photosensitive drum 1Y reaches a position opposite to the intermediate transfer belt 8 and the primary transfer bias roller 9Y, the toner image on the photosensitive drum 1Y is transferred onto the intermediate transfer belt 8 thereto (primary transfer process). At that time, a small amount of the toner not transferred remains on the photosensitive drum 1Y (surface).

Thereafter, the surface of the photosensitive drum 1Y reaches a position opposite to the cleaning part 2Y, where the remaining toner not transferred is mechanically removed by a cleaning blade 2*a* (cleaning process). Finally, the surface of the photosensitive drum 1Y reaches a position opposite to the discharge part (not shown), where residual potential is removed. Thus, a series of the imaging process performed on the photosensitive drum 1Y (surface) ends.

As shown in FIG. 1, this series of the imaging process is performed in a similar manner in the other three imaging parts 3M, 3C and 3K. For the imaging process in the imaging parts, the exposing part 7 emits laser light L from a light source based on image information (although not shown) and irradiates the laser light L onto the photosensitive drums 1Y, 1M, 1C and 1K via a plurality of optical elements while scanning the laser light L with a rotated and driven polygon mirror. In such a manner, the imaging part 3M forms a magenta toner image, the imaging part 3C forms a cyan toner image, and the imaging part 3K forms a black toner image.

Here, in the intermediate transfer unit 6, four primary transfer bias rollers 9Y, 9M, 9C and 9K form a primary transfer nip by nipping the intermediate transfer belt 8 in conjunction with the corresponding photosensitive drums 1Y, 1M, 1C and 1K. A transfer bias reverse to a polarity of the toner is applied to the primary transfer bias rollers 9Y, 9M, 9C and 9K. The intermediate transfer belt 8 travels in an arrow direction and sequentially passes through the primary transfer nip formed by primary transfer bias rollers 9Y, 9M, 9C and 9K and photosensitive drums 1Y, 1M, 1C and 1K, whereby toner images of respective colors on photosensitive drums 1Y, 1M, 1C and 1K are transferred onto the intermediate transfer belt 8 in a manner superposed to each other. In such a manner, a color image is formed on the intermediate transfer belt 8.

Thereafter, a portion of the intermediate transfer belt 8 where toner images of respective colors are transferred in a superposed manner (a portion where a color image is formed) reaches a position opposite to a secondary transfer roller 11, where the secondary transfer backup roller 10 forms a secondary transfer nip by nipping the intermediate transfer belt 8 in conjunction with the secondary transfer roller 11. This causes a toner image of four colors (color image) formed on the intermediate transfer belt to be transferred onto a recording medium P (transfer receiving object) such as a transfer paper or the like conveyed to the position of the secondary transfer nip. At that time, a toner not transferred onto the recording medium P remains on the intermediate transfer belt 8.

Thereafter, a portion of the intermediate transfer belt 8 where a toner not transferred remains reaches a position where an intermediate cleaning part (not shown) is provided. At this position, the toner not transferred and remaining on the intermediate transfer belt 8 is recovered by the intermediate cleaning part. In such a manner, a series of transfer process performed on the intermediate transfer belt 8 ends.

Here, the recording medium P conveyed to the position of the second transfer nip is conveyed from a paper feeding part 12 provided on a lower portion of the image forming apparatus 100 via a paper feeding roller 13, a pair of conveying rollers 14, a pair of registration rollers 15, and the like. In the paper feeding part 12, the recording medium P such as a transfer paper or the like is stored by stacking a plurality of sheets. In the paper feeding part 12, the paper feeding roller 13 is rotated and driven in a counterclockwise direction as viewed from the front side and thereby an uppermost sheet of the recording medium stored therein is discharged from the paper feeding part 12 and conveyed toward the pair of conveying rollers 14.

The discharged recording medium P is conveyed by the pair of conveying rollers 14 toward the pair of registration rollers 15. The pair of registration rollers 15 stop its rotation and drive to have the conveyed recording medium P once stop at the position of the roller nip. Thereafter, the pair of registration rollers 15 are rotated and driven in synchronization with passing of a portion of the endlessly moved intermediate transfer belt 8 on which a color image is formed, to convey the recording medium P toward the second transfer nip. In such a manner, a desired color image is transferred onto the recording medium P.

Thereafter, the recording medium P to which the color image is transferred at the position of the second transfer nip is conveyed to a position of a fixing part 19. In the fixing part 19, the color image transferred onto the surface is fixed on the recording medium P with heat and pressure applied by a fixing roller 17 and a pressing roller 18. Thereafter, the recording medium P is discharged to the outside of the apparatus after passing through between a pair of paper discharging rollers 16. The recording medium P discharged by the pair of paper discharging rollers 16 is stacked one by one at a stack part 20 as an output image. In such a manner, a series of image forming process in the image forming apparatus 100 ends.

Next, a configuration and operation of the developing device 5Y in the imaging part 3Y are described with reference to FIG. 2. The developing device 5Y includes: a developing roller 51Y disposed opposite to the photosensitive drum 1Y; a doctor blade 52 disposed opposite to the developing roller 51Y; developer conveyance paths 53Y, 54Y and 55Y for conveying the developer; a supply screw 56Y, a recovery screw 57Y and a stirring screw 58Y disposed respectively in the developer conveyance paths 53Y, 54Y and 55Y; and a density detention sensor (not shown) configured to detect toner density in the developer. The developing roller 51Y includes, although not shown, a magnet fixed therein and a sleeve rotating around the magnet. The developer conveyance paths 53Y, 54Y and 55Y contain two-component developer comprising a carrier and a toner. That is, in the image forming apparatus 100 according to Embodiment 1, an image is formed by using the two-component developer. The developer conveyance path (stirring conveyance path) 55Y communicates with a toner conveyance pipe 68 via an opening 59Y disposed thereabove. The toner conveyance pipe 68 forms a part of the toner supply device (refer to reference numeral 60Y in FIG. 3) described later and is a portion where the toner is supplied in an appropriate manner to keep a ratio of the toner (toner density) with respect to the developer in the developing device 5Y within a predetermined range. In other words, depending on toner consumption in the developing device 5Y, the toner stored in the toner container 32Y is supplied into the stirring conveyance path 55Y from the toner supply device (refer to reference numeral 60Y in FIG. 3) via the toner conveyance pipe 68. A configuration and operation of the toner supply device and the toner container are described in detail later.

Arrangements of respective components are described in further detail. The developing device 5Y includes, at a position opposite to the developing roller 51Y, the developer conveyance path (supply conveyance path) 53Y configured to store the developer supplied to the developing roller 51Y. The supply conveyance path 53Y includes a supply screw 56Y as a supply conveyance member which conveys the developer into an inner side as viewed from the front side of FIG. 2 along an axial direction of the developing roller 51Y. In the developing device 5Y, the doctor blade 52Y is provided on the developing roller 51Y on a downstream side in a surface movement direction of a portion thereof facing the supply screw 56Y. The doctor blade 52Y serves as a developer restricting means for restricting the developer supplied to the developing roller 51Y to a thickness appropriate for developing.

The developer conveyance path (recovery conveyance path) 54Y is arranged so as to face the developing roller 51Y at a downstream side in a surface movement direction from a developing region which faces the photosensitive drum 1Y of the developing roller 51Y. The recovery conveyance path 54Y passes the developing region and recovers the developer already used and detached from the surface of the developing roller 51Y. The recovery conveyance path 54Y serves as a recovery conveyance member which conveys the developer recovered into the recovery conveyance path 54Y in a direction same as the supply screw 56Y along an axial direction of the developing roller 51Y. For this reason, in the developing device 5Y, the supply conveyance path 53Y provided with the supply screw 56Y is disposed in a transverse direction with respect to the developing roller 51Y, and the recovery conveyance path 54Y provided with the recovery screw 57Y is arranged below the developing roller 51Y.

In the developing roller 51Y, the developer can be separated and removed by setting the aforementioned magnet in the developing sleeve not to form magnetic field only at a portion from where the developer is removed. The developing device 5Y may have an alternative configuration which uses a magnet having a magnetic field arranged so as to form a repulse magnetic field at a portion from where the developer is removed.

In the developing device 5Y, the developer conveyance path (stirring conveyance path) 55Y is provided in parallel with the recovery conveyance path 54Y and below the supply conveyance path 53Y. The stirring conveyance path 55Y includes a spiral stirring screw 58Y disposed in parallel in the axial direction. The stirring screw 58Y serves as a stirring conveyance member which conveys the developer toward the front side of FIG. 2 in a direction reverse to the supply screw 56Y while stirring the developer along the axial direction of the developing roller 51Y.

The supply conveyance path 53Y and the stirring conveyance path 55Y are separated from each other by a first partition wall 501 as a partition member. At a portion of the first partition wall 501 separating the supply conveyance path 53Y and the stirring conveyance path 55Y from each other, an opening (not shown) is provided on each end of the front and inner sides of FIG. 2. Therefore, the supply conveyance path 53Y and the stirring conveyance path 55Y communicate with each other at both ends in an extending direction (a direction orthogonal with respect to a paper surface of FIG. 2). Although the supply conveyance path 53Y and the recovery conveyance path 54Y are also separated from each other by the first partition wall 501, no opening is provided on a portion of the first partition wall 501 separating the supply conveyance path 53Y and the recovery conveyance path 54Y from each other. Therefore, the supply conveyance path 53Y and the recovery conveyance path 54Y do not communicate with each other.

Further, the stirring conveyance path 55Y and the recovery conveyance path 54Y are partitioned to each other by a second partition wall 502 as a partition member. An opening part (not shown) is provided on an inner side of the second partition wall 502 as viewed from the front side of FIG. 2, through which the stirring conveyance path 55Y and the recovery conveyance path 54Y communicate with each other.

The developer is supported on the developing roller 51Y by the toner adsorbed to the carrier due to its frictional charging with the carrier and a magnetic field formed by the magnet inside the developing roller 51Y. In the developing roller 51Y, the sleeve (not shown) rotates in an arrow direction of FIG. 2. Then, the developer supported on the developing roller 51Y by a magnetic field formed by the magnet (not shown) moves on the developing roller 51Y as the sleeve rotates.

Here, the developer in the developing device 5Y is adjusted in such a manner that a ratio of the toner (toner density) with respect to the developer is within a predetermined range. That is, depending on toner consumption in the developing device 5Y, the toner stored in the toner container 32Y is supplied into the stirring conveyance path 55Y via the toner supply device 60Y (refer to FIG. 3). A configuration and operation of the toner supply device is described in detail later.

The toner supplied into the stirring conveyance path 55Y is conveyed in the stirring conveyance path 55Y toward a front side of FIG. 2 as viewed from the front side thereof while being mixed and stirred with the developer by the stirring screw 58Y. The developer conveyed up to downstream in a conveyance direction of the stirring screw 58Y is supplied to the supply conveyance path 53Y via openings (not shown) of the first partition wall 501 formed at a downstream side in a conveyance direction of the first stirring screw 58Y and at an upstream side in a conveyance direction of the supply screw 56Y.

In the supply conveyance path 53Y, the developer supplied from the stirring conveyance path 55Y is conveyed to a downstream side in a conveyance direction of the supply screw 56Y while being supplied to the developing roller 51Y. Then, a surplus developer conveyed up to a downstream end in a conveyance direction of the supply conveyance path 53Y without being supplied to the developing roller 51Y is supplied to the stirring conveyance path 55Y through openings of the first partition wall 501.

On the other hand, the developer supplied to the developing roller 51Y is conveyed in an arrow direction of FIG. 2 and reaches a position of the doctor blade 52Y. Thereafter, the developer on the developer roller 51Y is adjusted to an appropriate amount by the doctor blade 52Y thereto and then conveyed up to a position (developing region) opposite to the photosensitive drum 1Y. Thereafter, the toner is adsorbed to a latent image formed on the photosensitive drum 1Y by an electric field formed in the developing region. Thereafter, a developer remaining on the developing roller 51Y is removed and separated from the developing roller 51Y and delivered to the recovery conveyance path 54Y. In the recovery conveyance path 54Y, the delivered recovery developer is conveyed up to a downstream end in a conveyance direction of the recovery conveyance path 54Y and supplied to the stirring conveyance path 55Y via openings (not shown) of a second partition wall 502.

In the stirring conveyance path 55Y, the surplus developer and the recovery developer thus supplied are supplied, together with the toner supplied in an appropriate manner as described above, toward a front side of FIG. 2 as viewed from the front side thereof while being mixed and stirred by the stirring screw 58Y, and are supplied to the supply conveyance path 53Y through openings (not shown) of the first partition wall 501. Below the stirring conveyance path 55Y, a toner density detection sensor (not shown) comprising a magnetic permeability sensor is provided. The toner density detection sensor is used to determine whether or not to supply the toner from the toner container 32Y by the toner supply device 60Y.

Next, the toner supply device (refer to reference numeral 60Y in FIG. 3) introducing the toner stored in the toner container 32Y into the developing device 5Y is described with reference to FIG. 3. The toner supply device includes the toner container storage part 31 (refer to FIG. 4, etc.) and supplies the toner from toner containers 32Y, 32M, 32C and 32K in an appropriate manner depending on toner consumption in developing devices. A configuration of the toner container storage part 31Y is described later.

In the toner supply device 60Y, when the toner container 32Y is mounted to the toner container storage part 31, a nozzle (tubular member) 72 of the toner container storage part 31 is inserted into a hole 32Y1*b* of the toner container 32Y by interlocking the mounting operation as shown in FIG. 3. At that time, a plug member 32Y3 (a cylindrical portion) as an opening member of the toner container 32Y nipped between the nozzle 72 and a claw member 75 opens a toner discharge port 32Y1*a* (powder discharge port). Thus, the toner discharge port 32Y1*a* and a toner receiving port 72*a* (powder receiving port) provided in the nozzle 72 communicate with each other, and the toner stored in a container main body 32Y2 (powder storage part) of the toner container 32Y is conveyed into the nozzle 72 via the toner discharge port 32Y1*a*. The other end of the nozzle 72 is connected to the one end of a tube 69 as a toner supply path.

The tube 69 is made of a flexible material having a good toner resistance, and the other end thereof is connected to a screw pump 61 (mono pump) of the toner supply device. The tube 69 is formed so as to have an inner diameter of 4 to 10 mm. As a material of the tube 69, a rubber material such as polyurethane, nitrile, EPDM and the like or a resin material such as polyethylene, nylon and the like may be used. The flexible tube 69 formed in such a manner increases freedom degree in the layout of the toner supply path, whereby downsizing of the image forming apparatus 100 can be achieved.

The screw pump 61 is a suction type uniaxial eccentric screw pump comprising a rotor 65, a stator 62, a suction port 63, a universal joint 64 and a motor 66. The rotor 65, stator 62 and universal joint 64 are housed in a casing, although not shown. The stator 62 is a female threaded member made of an elastic material such as rubber and the like, and a double-pitched spiral groove is formed on an inner wall thereof. The rotor 65 is a male threaded member having a spirally twisted shape, made of a rigid material such as metal or the like, and fitted into the stator 62 in a rotatable manner. One end of the rotor 65 is coupled with the motor 66 via the universal joint 64.

The screw pump 61 causes the motor 66 to rotate and drive the rotor 65 in the stator 62 in a predetermined direction to evacuate air from the tube 69 and thereby generates a negative pressure in the tube 69 and a suction force at the suction port 63. Thus, the toner (yellow) in the toner container 32Y is suctioned together with air into the suction port 63 via the tube 69. The toner suctioned up to the suction port 63 is sent into a clearance between the stator 62 and the rotor 65 and sent out to the other end of the stator 62 (opposite to the suction port) along rotation of the rotor 65. The toner thus sent out is discharged through a discharge port 67 of the screw pump 61, and supplied into the developing device 5Y via a toner conveyance pipe 68 (refer to an arrow indicated with dashed line in FIG. 3). A hopper for temporarily storing the toner to be supplied to the developing device 5Y may be provided between the screw pump 61 and the developing device 5Y.

Here, referring to FIG. 3, the toner container 32Y according to Embodiment 1 includes the container main body 32Y2 which is a substantially cylindrical toner bottle. A conveyance member 33 is provided in the container main body 32Y2. The conveyance member 33 is supported at one end at the bottom of the container main body 32Y2 (right side as viewed from front side of FIG. 3) in a rotatable manner, and has a coil-like shape in the container main body 32Y2. A drive input part 34 (driven coupling) which is engageable with a drive coupling 91 (refer to FIG. 5, etc.) described later and is rotatable with respect to the container main body 32Y2 is provided on the bottom of the conveyance member 33. The conveyance member 33 is coupled with the drive input part 34. With such configuration, when receiving a drive force from the drive coupling 91 of the image forming apparatus 100, the conveyance member 33 rotates in a predetermined direction to convey the toner stored in the container main body 32Y2 (toner container 32Y) in a longitudinal direction (left side as viewed from front side of FIG. 3). Thus, in the toner container 32Y, the toner is discharged from the toner discharge port 32Y1*a* toward the nozzle 72. A detailed configuration of the toner container 32Y is described in detail later.

Figure 4:
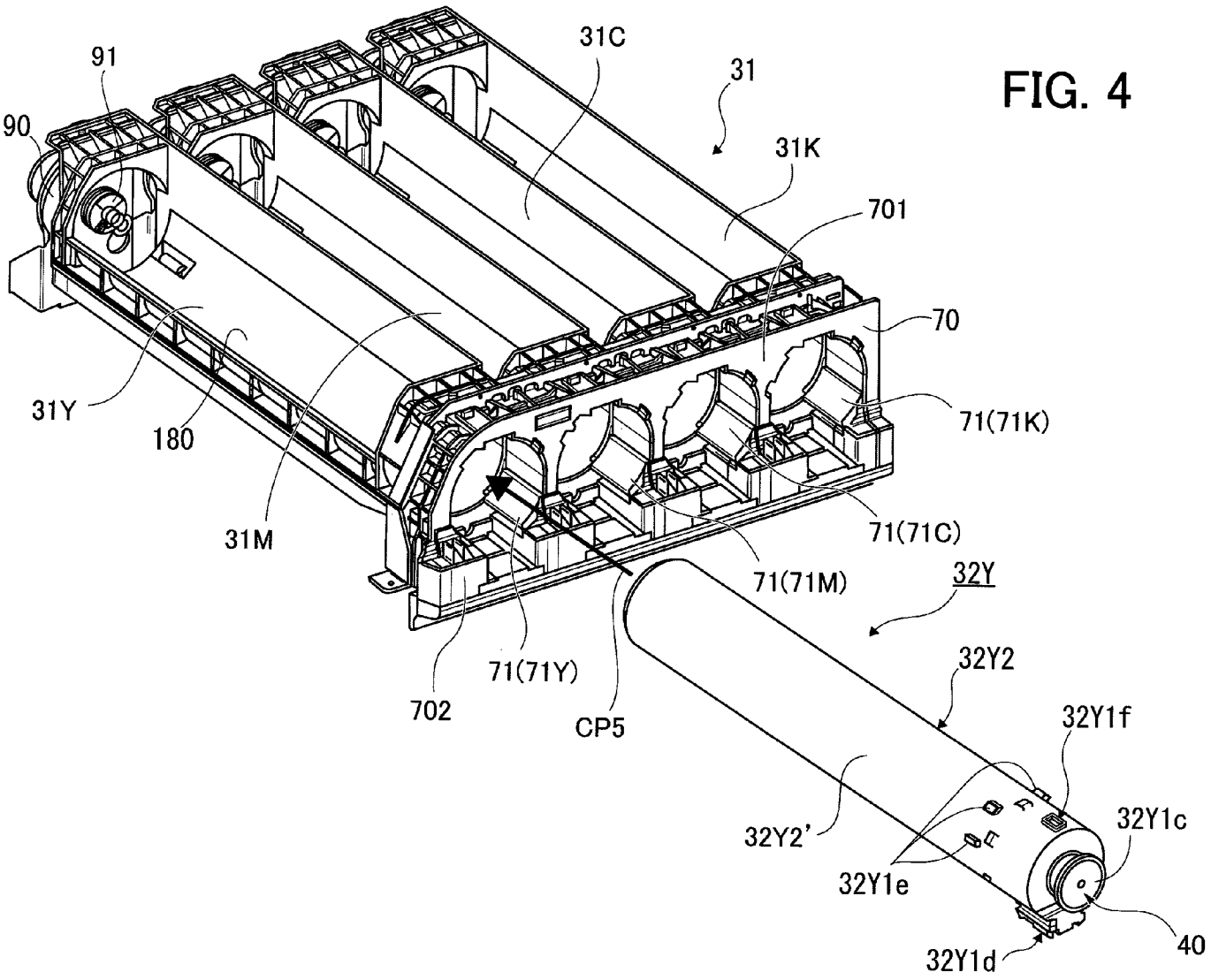
FIG. 4 is a perspective view showing a general configuration of a toner container storage part.

Next, the toner container storage part 31 in which toner containers 32Y, 32M, 32C and 32K are mounted is described. FIG. 4 is an overall perspective view of the toner container storage part 31. The toner container storage part 31 is a powder storing container storage part and includes a toner container holding part 70 (powder storing container holding part), a toner container guide part 180 (powder storing container guide part) and a toner container drive part 90 (powder storing container drive part). The toner container 32Y is mounted through the toner container holding part 70 into the toner container storage part 31 with a longitudinal direction thereof as a mounting and removing direction. Hereinafter, the insertion direction (refer to an arrow in FIG. 4) of the toner container 32Y through the toner container holding part 70 with respect to the toner container storage part 31 is called a mount direction of the toner container 32Y.

Figure 5:
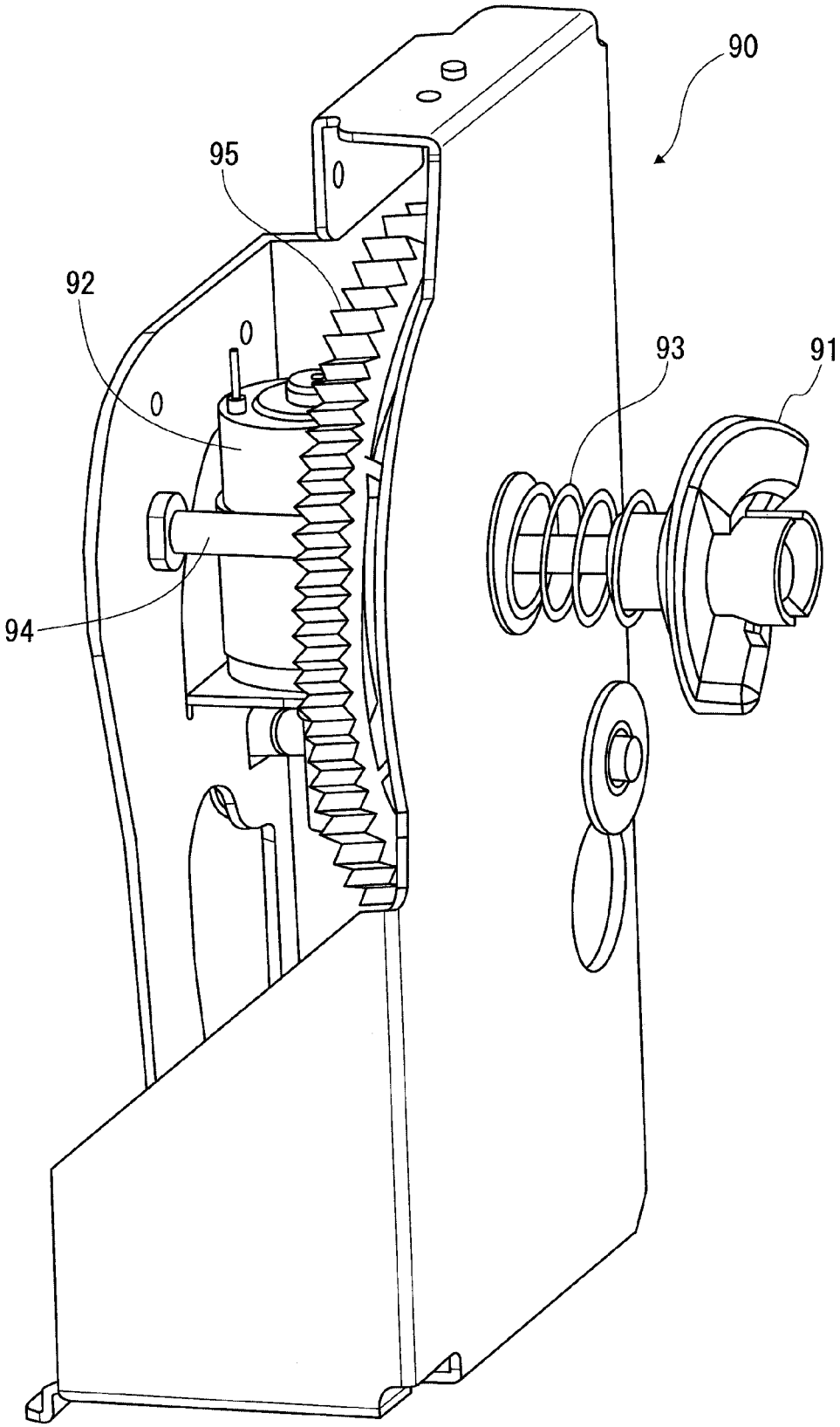
FIG. 5 is a perspective view showing a toner container drive part.

In the toner container storage part 31, the toner container drive part 90 is provided on an inner side in the mount direction of respective toner containers. As shown in FIG. 5, the toner container drive part 90 includes a drive coupling 91, a drive motor 92, a spring 93, a shaft 94 and a gear 95. The drive coupling 91 is disposed so as to engage with a drive input part 34 (refer to FIG. 3) provided on the bottom of the container main body 32Y2. The drive coupling 91 and the drive motor 92 are coupled with each other via the shaft 94 and the gear 95 provided thereat. In the toner container 32Y, a drive force of the drive motor 92 is transmitted to the drive coupling 91 via the shaft 94 and the gear 95, and the conveyance member 33 (refer to FIG. 3) is rotated and driven in a predetermined direction via the drive input part 34 engaging with the drive coupling 91. A spring 93 is attached around the shaft 94 to press the drive coupling 91 to the front side in the mounting direction of the toner container 32Y (a direction against the mounting).

Figure 6:
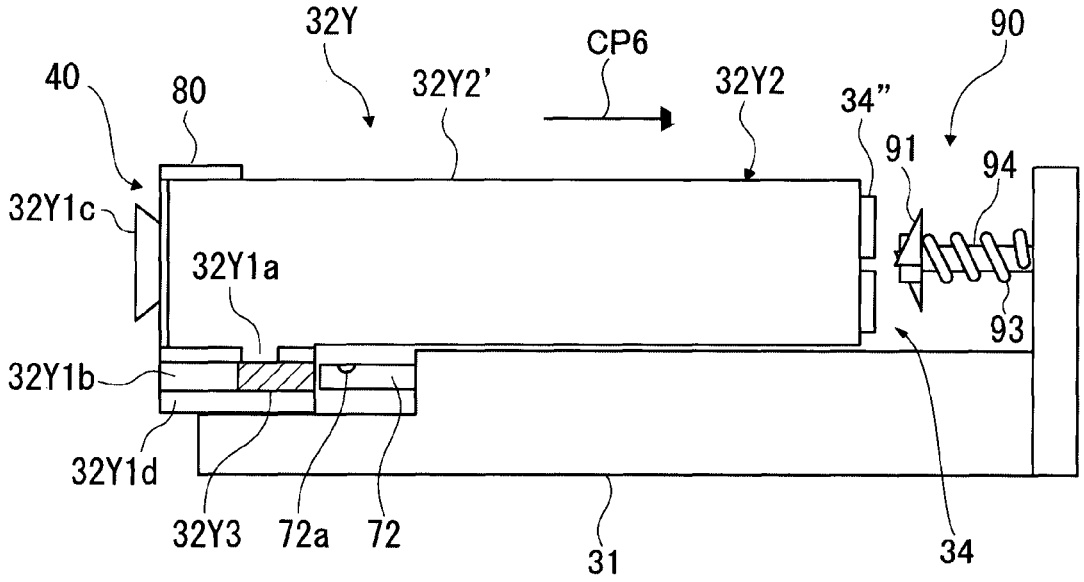
FIG. 6 is a schematic view showing a state of a drive part of the toner container before the toner container is coupled therewith.
Figure 7:
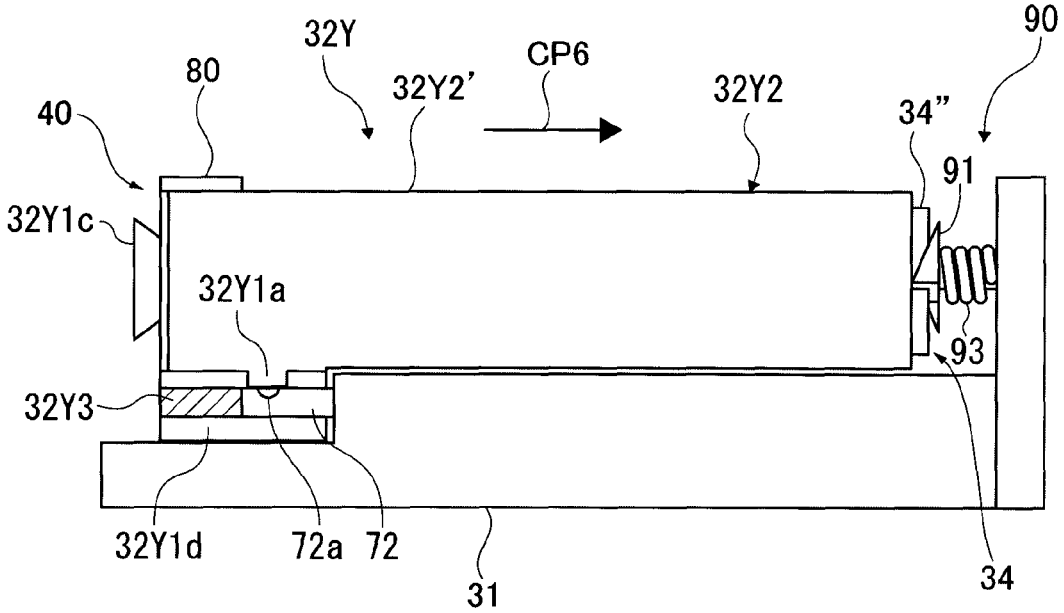
FIG. 7 is a schematic view showing a state of the drive part of the toner container after the toner container is coupled therewith.

That is, as shown in FIG. 6 and FIG. 7, the drive coupling 91 is provided in a reciprocally movable manner in parallel with the mounting (removing) direction of the toner container 32Y, and is pressed to a front side in the mounting direction of the toner container 32Y (left side as viewed from front side of FIG. 6) by the spring 93. When the toner container 32Y is mounted to the toner container storage part 31 by moving in an arrow direction shown in FIG. 6, the drive coupling 91 pressed by the toner container 32Y moves to an inner side in the mounting direction (refer to FIG. 7) while engaging with the drive input part 34 (refer to FIG. 3). Thus, due to a force of the spring 93, the drive coupling 91 presses the toner container 32Y to a front side in the mounting direction (in a left direction as viewed from front side of FIG. 7).

When the toner container 32Y is removed, upon opening the toner container 32Y from the toner container storage part 31, the toner container 32Y is pushed in the removing direction (in a left direction in FIG. 7) due to a pressing force of the spring 93. That is the toner container 32Y pops up (pop-up action) through a toner container insertion port 71Y, so that the user can easily remove the toner container 32Y from the image forming apparatus 100 by gripping a gripping part 32Y1C described later.

Next, the toner container holding part 70 is described in detail with reference to FIG. 8 and FIG. 9. The toner container holding part 70 includes a toner container insertion port 71, the nozzle 72 as a tubular member, an antenna base plate 74, a claw member 75, a toner container release lever 76 (powder storing container release member), and a positioning member 78. The claw member 75 is a pressing member (refer to FIG. 3) which presses the plug member 32Y3 in a direction closing the toner discharge port 32Y1*a* of the toner container 32Y. The toner container release lever 76 is configured in a manner enabling to hold the toner container 32Y to the toner container storage part 31 and to release the holding.

Figure 10:
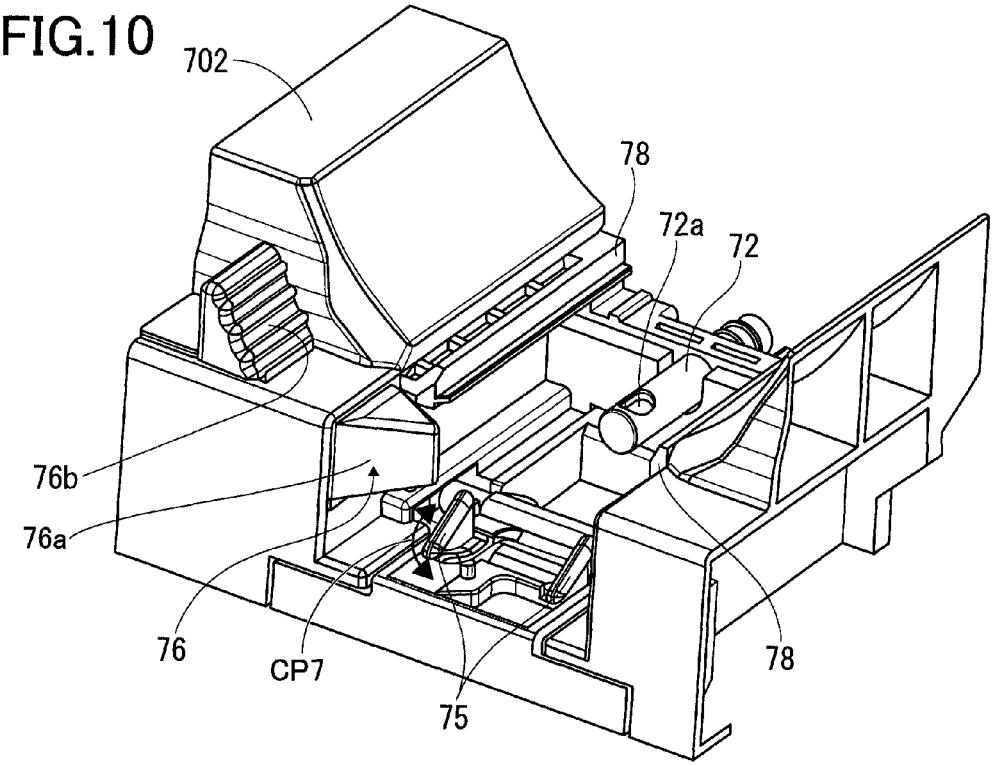
FIG. 10 is a perspective view showing an enlarged vicinity of a lower front case shown in FIG. 8.
Figure 11:
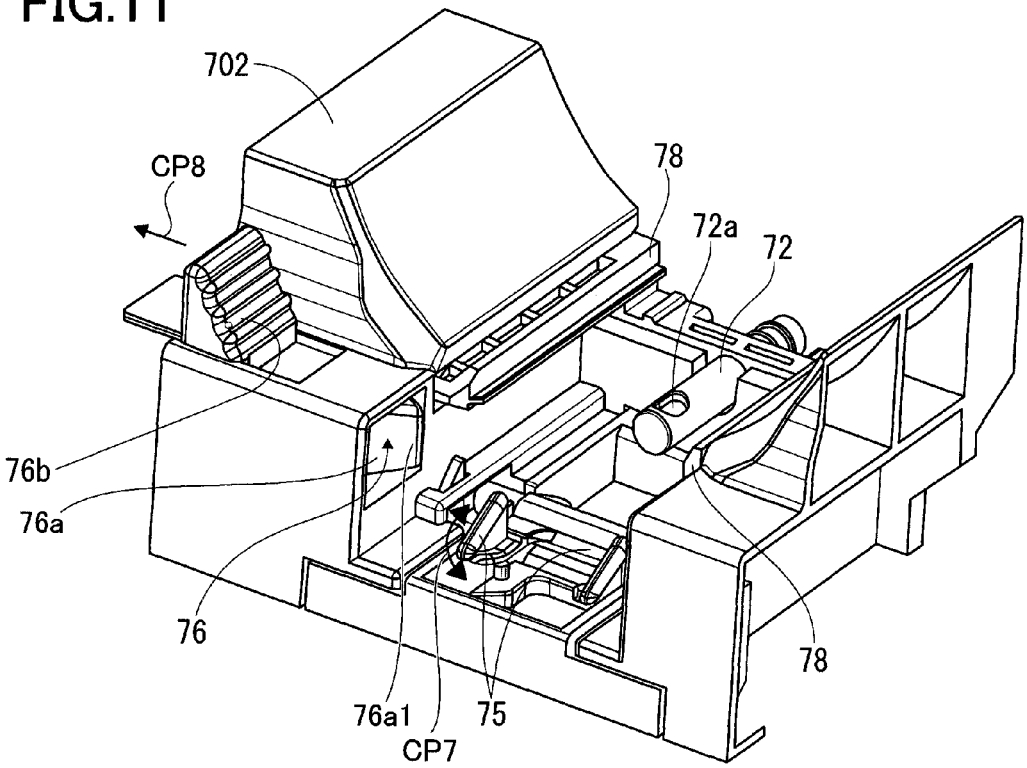
FIG. 11 is a perspective view showing an enlarged vicinity of the lower front case shown in FIG. 8, and an illustrative view showing a state when a claw part of a toner container release lever shown in FIG. 10 is recessed.

The toner container holding part 70 holds toner containers 32Y, 32M, 32C and 32K in a non-rotatable manner. The toner container holding part 70 includes an upper front case 701, a lower front case 702, and the like. FIG. 10 and FIG. 11 are enlarged perspective views of the lower front case 702.

As shown in FIG. 10, the lower front case 702 is provided with a positioning member 78 which positions the toner container 32Y by interlocking with the mounting operation of the toner container 32Y. The positioning member 78 is a concave part extending along the mounting and removing direction of the toner container 32Y and is provided symmetrically with a vertical line passing a center axis of the nozzle 72 as a center.

In the toner container holding part 70, the nozzle 72 is disposed by extending in a horizontal direction and in the mounting and removing direction of the toner container 32Y. Above the nozzle 72, the toner receiving port 72*a* as a powder receiving port is provided with an open surface facing up.

In the toner container holding part 70, a claw member 75 is provided on a bottom portion thereof which is a portion located below the toner discharge port 32Y1*a* (refer to FIG. 3) when the toner container 32Y is held at the toner container holding part 70. The claw member 75 presses the plug member 32Y3 in a direction closing the toner discharge port 32Y1*a* by interlocking with the removing operation of the toner container 32Y. The claw member 75 is held in the lower front case 702 in a manner rotatable with a rotary support axis as a center. The claw member 75 is pressed in a direction projecting from a position not preventing mounting and removal of the toner container 32Y to a position engaging with the plug member 32Y3 by a leaf spring 77 (refer to FIG. 3). That is, the claw member 75 is pressed in a projecting direction from a position preventing mounting and removing of the toner container 32Y to a position engaging with the plug member 32Y3 by the leaf spring 77 (refer to FIG. 3). That is, the claw member 75 is pressed from a lower part toward an upper part.

Figure 12:
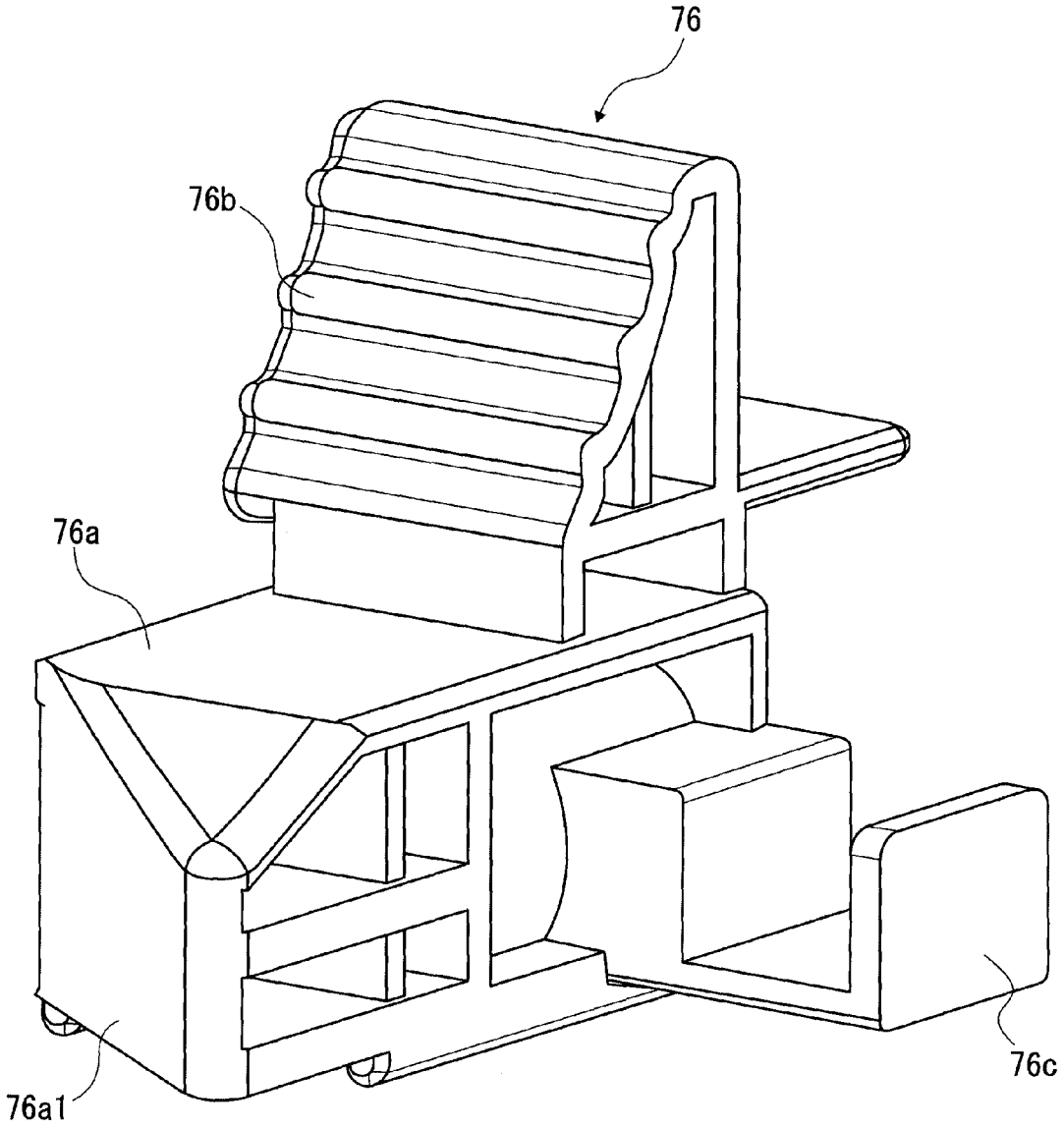
FIG. 12 is a perspective view showing the toner container release lever.

At a front side (front side in the mounting direction) of the toner container insertion port 71Y of the toner container holding part 70, a toner container release lever 76 for holding and releasing the toner container 32Y to and from the toner holding part 70 is provided. FIG. 12 is a perspective view showing the toner container release lever 76. As shown in FIG. 12, toner container release lever 76 includes a claw member 76*a* configured to fix and hold the toner container 32Y, a lever part 76*b*, and a rib 76*c*. The toner container release lever 76 is disposed in a horizontal direction in a manner capable of reciprocally moving in a direction substantially orthogonal to the mounting and removing direction of the toner container 32Y (refer to an arrow direction indicating a vicinity of the lever part 76*b* in FIG. 11), and is pressed to a toner container insertion port 71Y side (to a side opposite to an arrow shown in FIG. 11) by a spring 76*d* (refer to FIG. 13 and FIG. 14). The toner container release lever 76 can be moved up to a position not projecting to the toner container insertion port 71Y by sliding in a direction opposite to a pressing direction of the spring 76*d* (refer to an arrow shown in FIG. 11) with a user's finger hooked to the lever part 76*b*.

Figure 13:
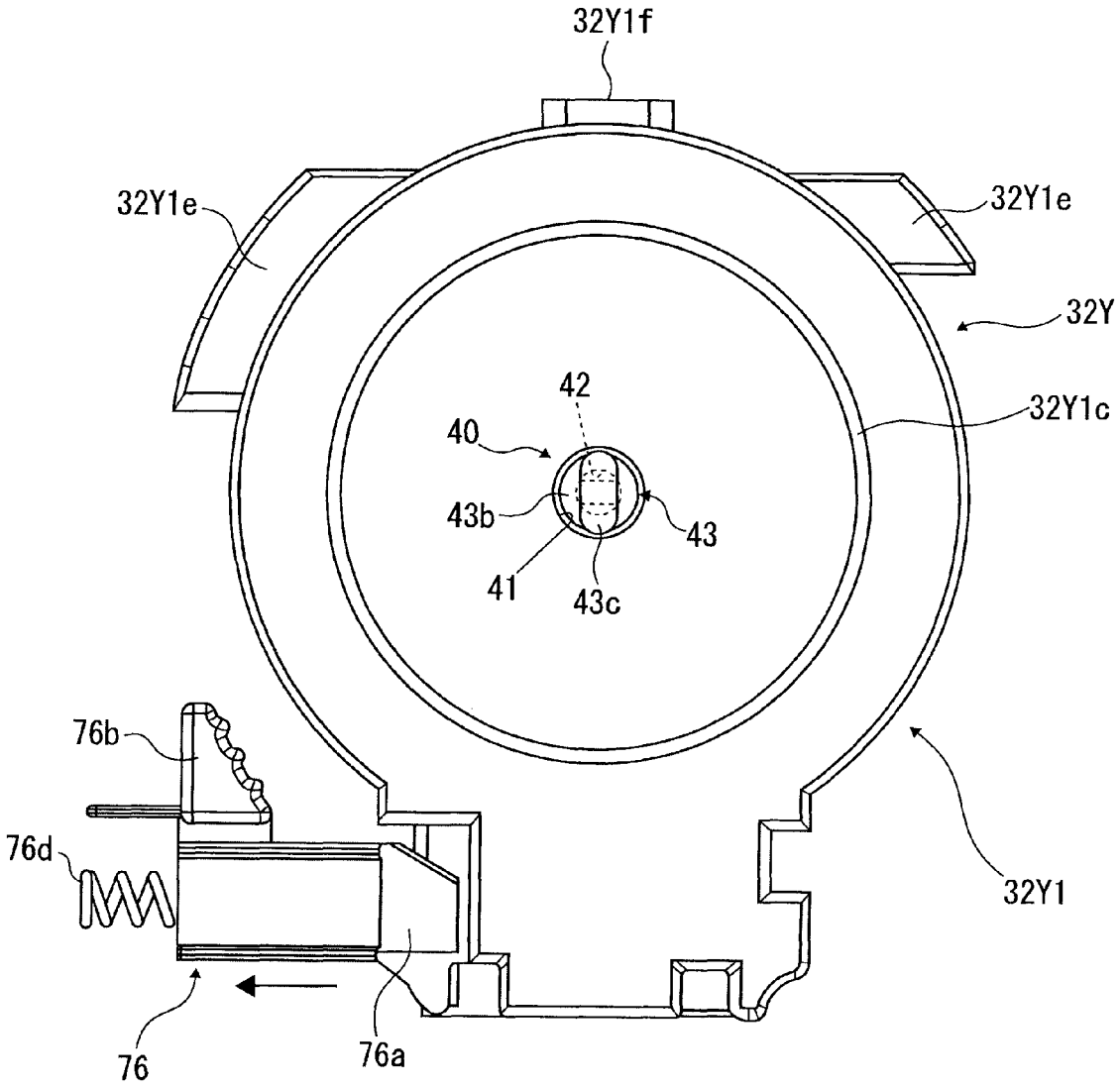
FIG. 13 is a front view showing a state of the toner container release lever 76 when the toner container is mounted to the toner container storage part.
Figure 14:
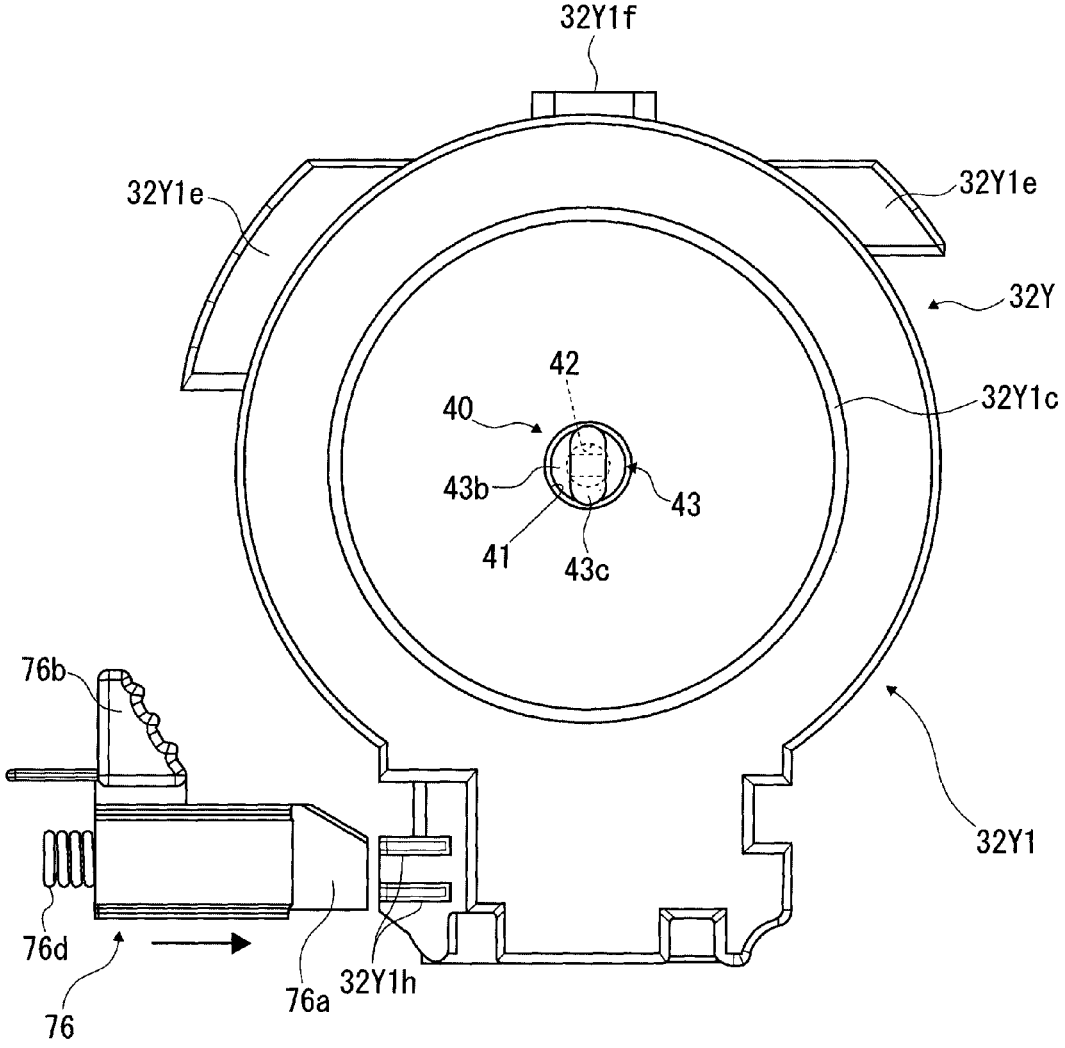
FIG. 14 is a front view showing a state of the toner container release lever 76 when the toner container is mounted to or released from the toner container storage part.

FIG. 13 and FIG. 14 shows a positional relation between the toner container 32Y stored in the toner container storage part 31Y and the toner container release lever 76 as viewed from a front side in the toner container mounting direction. FIG. 13 shows a state when the toner container 32Y is fixed and held to the toner container holding part 70 by the toner container release lever 76, and FIG. 14 shows a state when holding of the toner container 32Y is released with the toner container release lever moved to a left side of FIG. 14 (in an arrow direction in FIG. 13).

As described above, the toner container 32Y mounted to the toner container storage part 31 is pressed to a front side in the mount direction (as viewed from the front side of FIG. 13) by the drive coupling 91. However, when the toner container release lever 76 is at a position shown in FIG. 13, that is, when the toner container release lever 76 (claw part 76*a* thereof) protrudes to the toner container insertion port 71 by a pressing force of the spring 76*d*, the toner container release lever 76 prevents the toner container 32Y from being removed from the toner container storage part 31Y, so that the toner container 32Y can be held to the toner container storage part 31Y. Further, when the toner container release lever 76 is slid in a direction opposite to the pressing direction by the spring 76*d* with a user's finger hooked to the lever part 76*b*, the claw part 76*a* moves up to a position not protruding from the toner insertion port (release position) to release the hold state described above, the toner container 32Y is pressed by the drive coupling 91 (refer to FIG. 6, FIG. 7, etc.) of the toner container drive part 90, so that the toner container 32Y pops up from the toner container insertion port 71Y. Thereafter, when the toner container 32Y is pulled out by moving in a removing direction (a direction opposite to arrow X) by gripping the gripping part 32Y1*c*, contact between the claw part 76*a* and the toner discharge part 32Y1*d* is released, so that the toner container release lever 76 returns to the hold position by a pressing force of the spring 76*d* (refer to FIG. 9 and FIG. 11).

The toner container insertion port 71 is configured to expose toner container storage parts 31Y, 31M, 31C and 31K (toner container storage part 31) when a main body cover (not shown) disposed at a front side of the image forming apparatus 100 is opened. Specifically, when the main body cover is opened, as shown in FIG. 9, the toner container holding part 70 in which the four toner container insertion ports 71Y, 71M, 71C and 71K are formed is exposed. Thus, toner containers 32Y, 32M, 32C and 32K can be mounted and removed from a front side of the image forming apparatus 100 (mounting and removing with a longitudinal direction of toner containers as the mounting and removing direction). The shape of toner container insertion ports 71Y, 71M, 71C and 71K is different depending on the color.

That is, first guide grooves 71Y1, 71M1, 71C1 and 71K1 each having a shape, a location and a number different from each other are formed in toner container insertion ports 71Y, 71M, 71C and 71K. The first guide groove 71Y1 is configured so as to be engageable with a projection part 32Y1*e* disposed in the toner container 32Y as described later. Although not shown, the first guide grooves 71M1, 71C1 and 71K1 are configured so as to be engageable with projection parts formed in the toner containers 32M, 32C and 32K. With this configuration, erroneous mounting of a toner container of a wrong color is prevented in toner container insertion ports 71Y, 71M, 71C and 71K.

Figure 8:
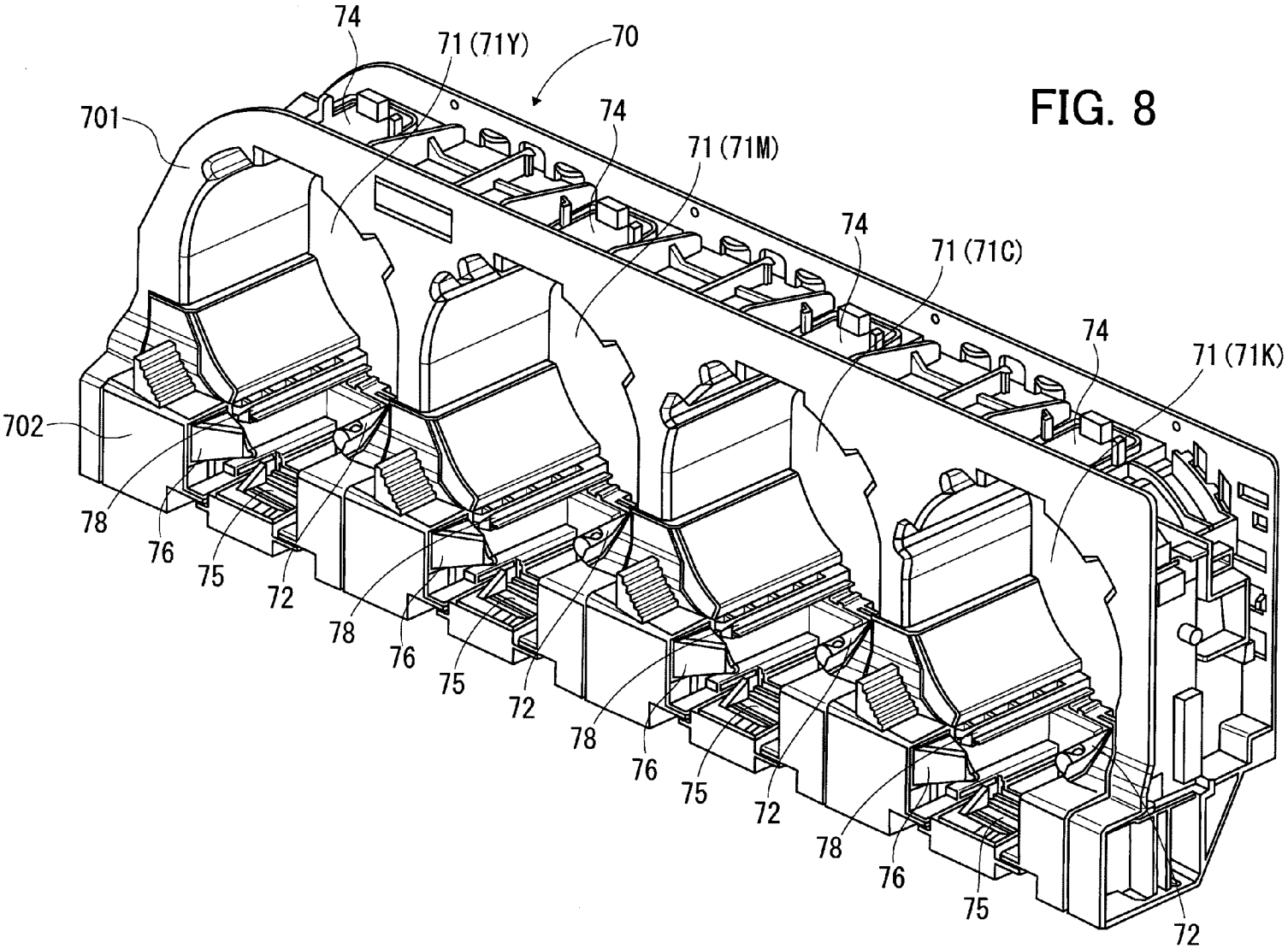
FIG. 8 is a perspective view showing a toner container holding part.
Figure 9:
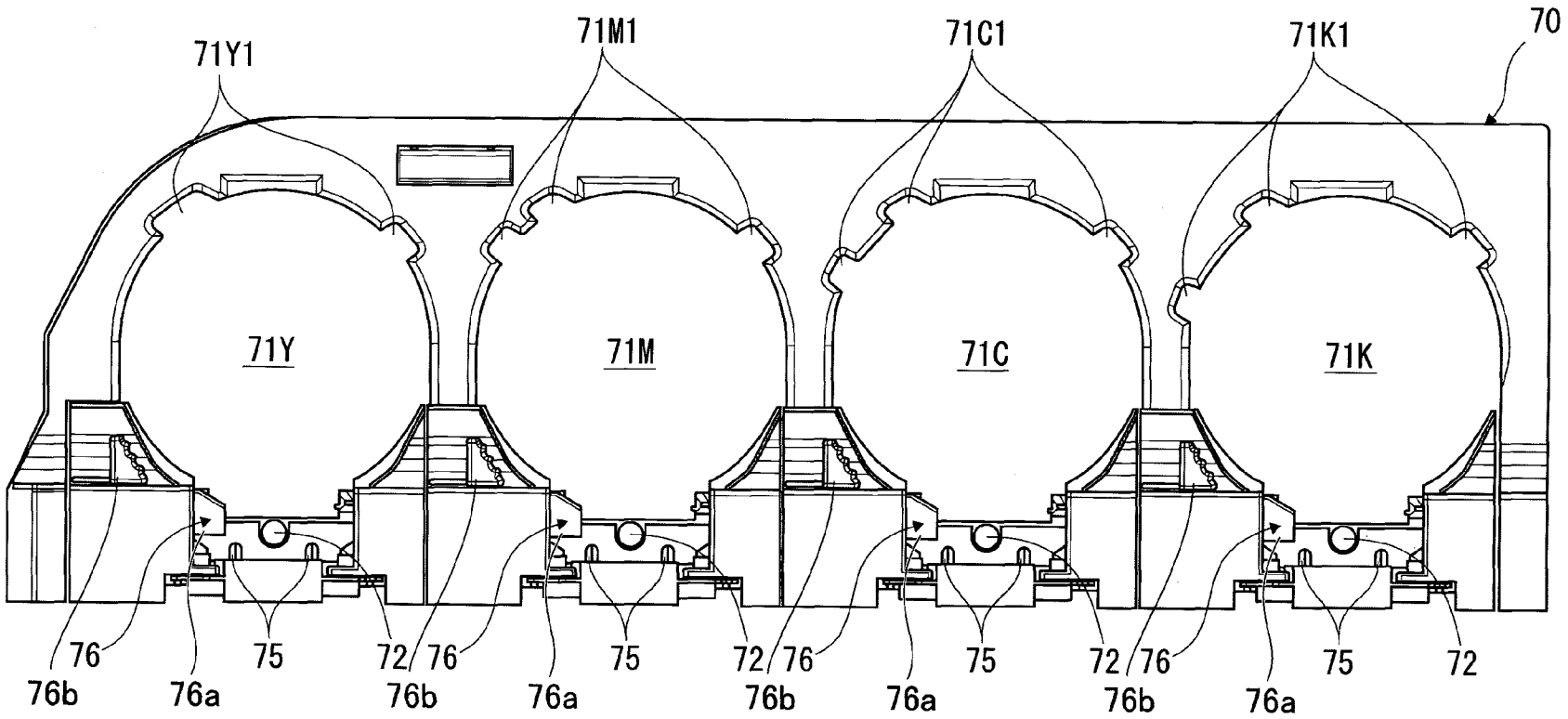
FIG. 9 is a front view showing a toner container insertion port shown in FIG. 8.
Figure 15:
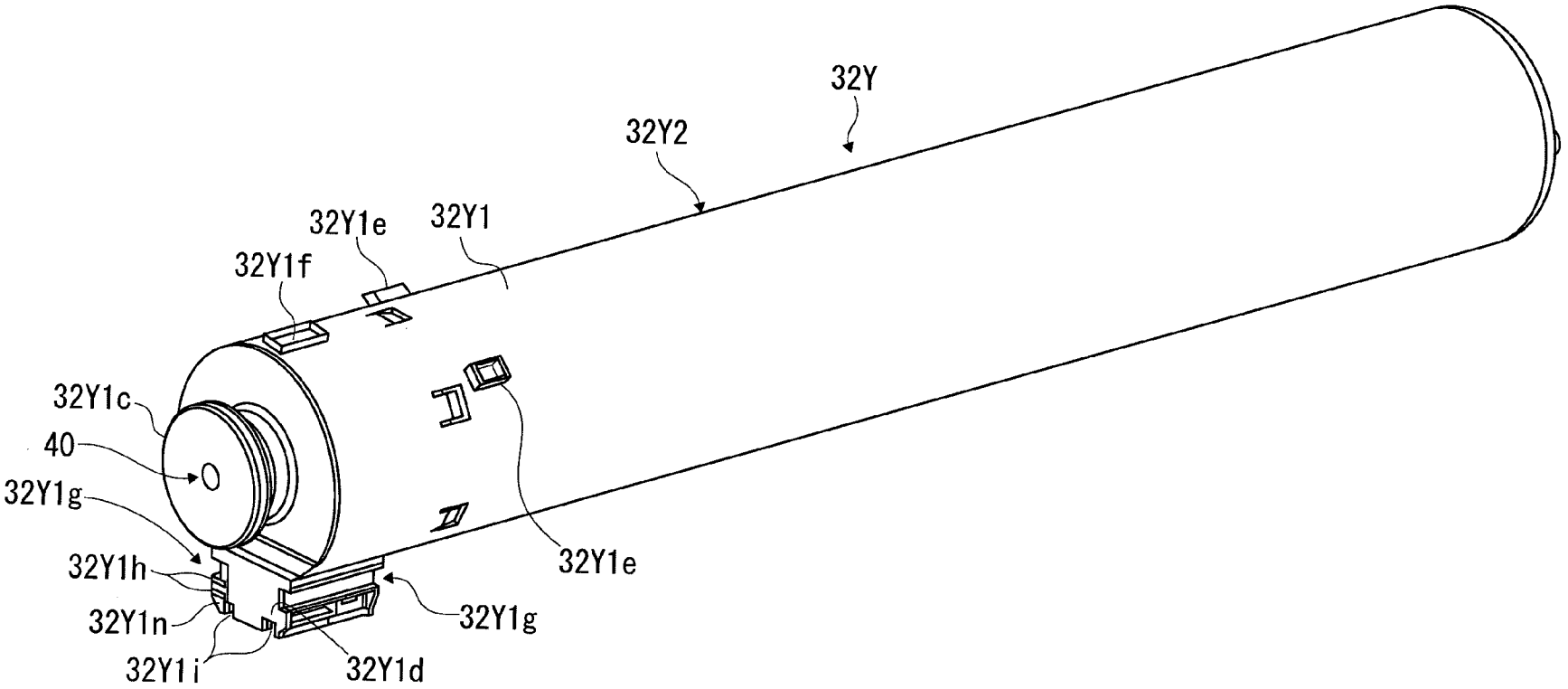
FIG. 15 is a perspective view showing an appearance of the toner container.
Figure 16:
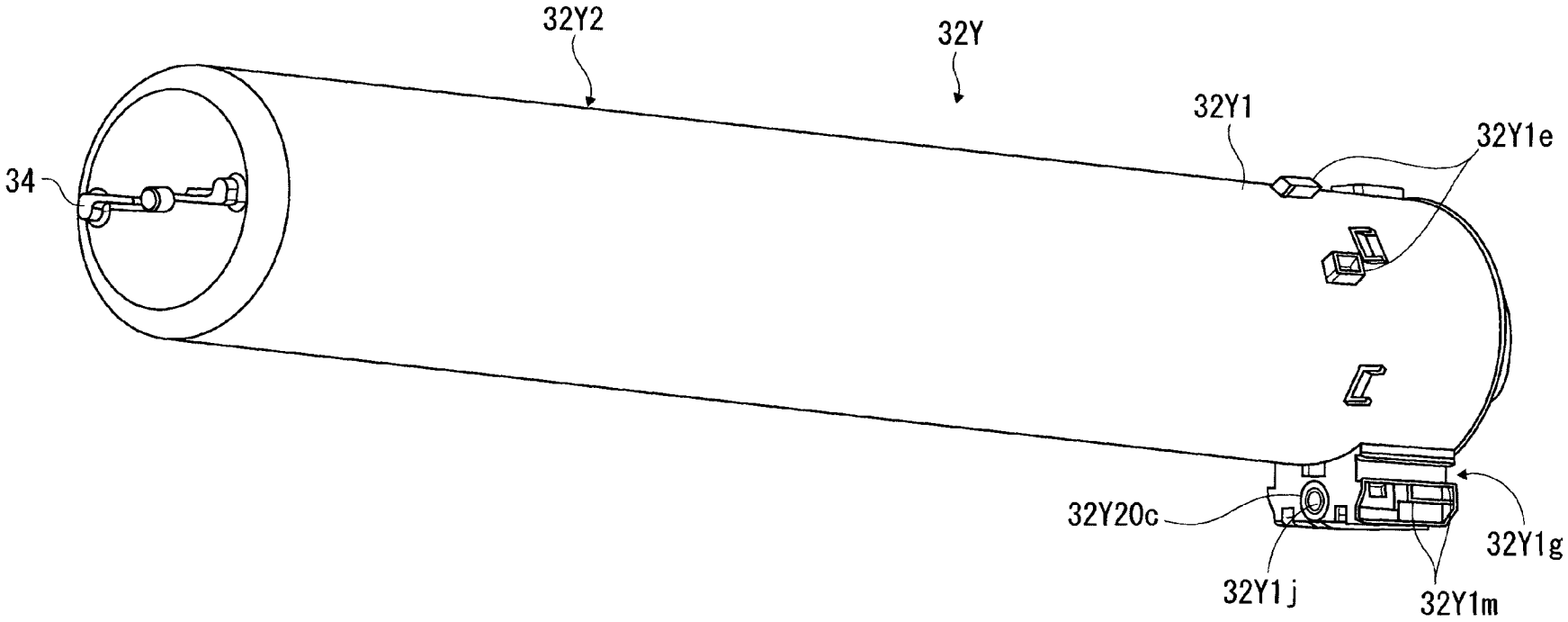
FIG. 16 is a perspective view showing the appearance of the toner container viewed from a different angle.
Figure 17:
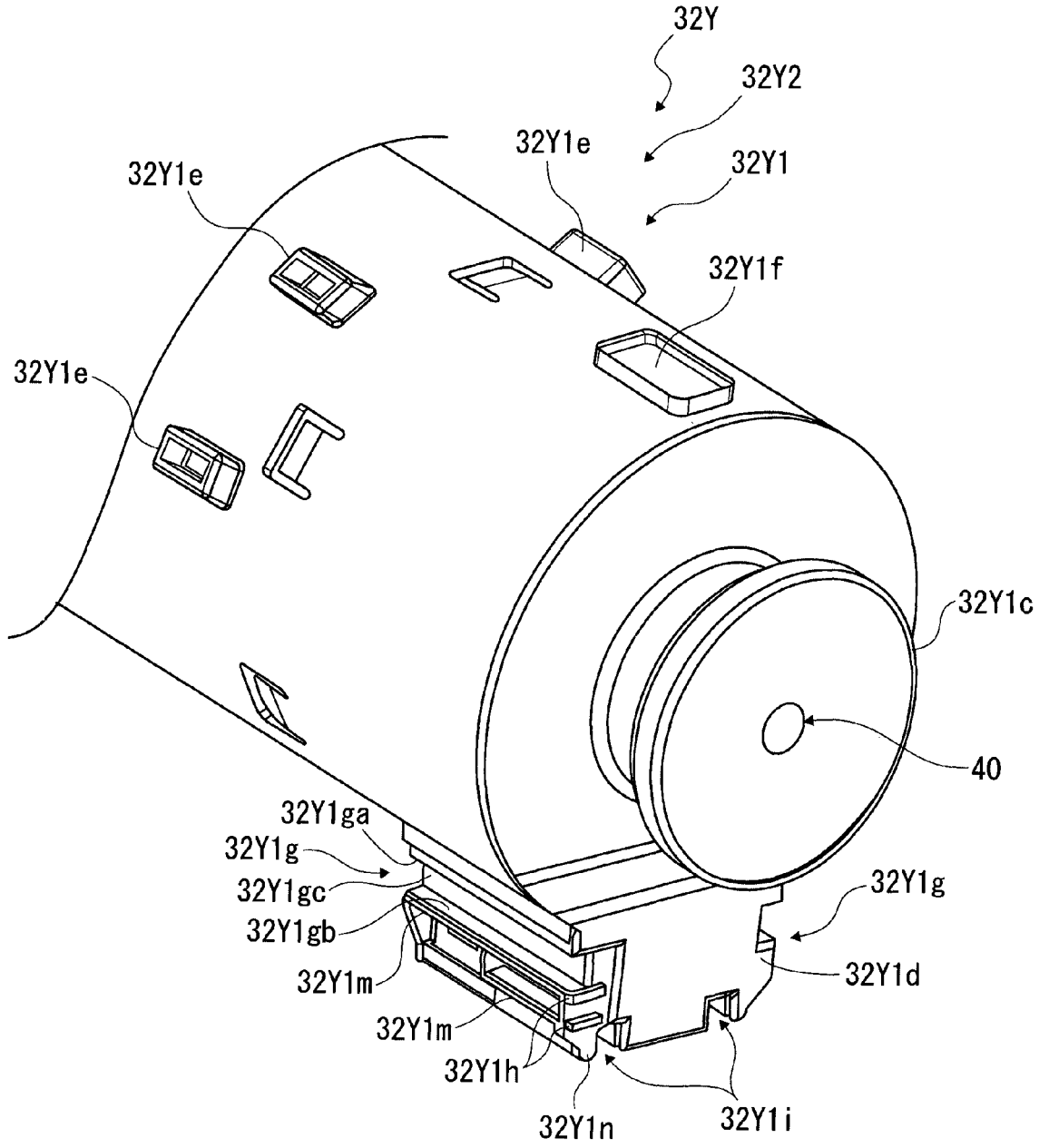
FIG. 17 is a perspective view showing an appearance of one end of a container main body of the toner container.

Further, in the toner container holding part 70 (toner supply devices 60Y, 60M, 60C and 60K), antenna base plates 74 are disposed in an upper front case 701 thereof as shown in FIG. 8. The antenna base plates 74 are disposed in parallel in the upper portion of the upper front case 701 on the same plane to face electronic substrates (only 32Y1*f* of the toner container 32Y is shown (Refer to FIG. 15)). disposed around the four toner containers 32Y, 32M, 32C and 32K disposed in parallel and inserted through the toner container holding part 70 partly formed by the upper front case 701.

The antenna base plate 74 is configured so as to enable information transmission and reception between electronic substrates (refer to FIG. 15) of mounted toner containers 32Y, 32M, 32C and 32K and the image forming apparatus 100 (control part thereof, not shown). Information communicated therebetween include the manufacturing number and recycling frequency of the toner container, the lot number, the color, the use history of the image forming apparatus 100, and the like. Further, according to toner consumption in a toner container, information relating to a remaining quantity of the toner in the toner container and the like is written into electronic substrates (refer to 32Y1*f* in FIG. 15) in an appropriate manner. The antenna base plate 74 is disposed above toner containers 32Y, 32M, 32C and 32K in such a manner that a reception surface thereof faces downward in a vertical direction, whereby a drop of the toner onto the reception surface can be prevented and deterioration of the communication sensitivity due to intervention of the toner can be prevented as well.

Next, a configuration of the toner container 32Y is described in detail with reference to FIG. 15 to FIG. 24. The toner container 32Y is a cylindrical toner container comprising a container main body 32Y2 and a nozzle insertion part 32Y30 (refer to FIG. 19). The container main body 32Y2 has a cylindrical shape as described above and includes therein a conveyance member 33 (refer to FIG. 3) which is disposed in a manner rotatable via a drive input part 34. In the container main body 32Y2, when the conveyance member 33 is rotated and driven as described above, toner (yellow) stored therein is conveyed toward the toner discharge port 32Y1*a*.

As described above, the toner container 32Y is fixed and held to the toner container storage part 31 (image forming apparatus 100) by the mounting operation with respect to the toner container storage part 31 (image forming apparatus 100). That is, the toner container 32Y which has been mounted to the toner container storage part 31 is not rotated and driven, but only the conveyance member 33 and the drive input part 34 disposed in the toner container 32Y in a rotatable manner are rotated and driven.

In the toner container 32Y, a toner discharge port 32Y1*a* is disposed at a one end part 32Y1 of the container main body 32Y2. At the one end part 32Y1, an electronic substrate 32Y1*f*, a color identification projection member 32Y1*e* (projection part), a gripping part 32Y1*c* and a toner discharge part (powder discharge part) 32Y1*d* are disposed. On both side faces of the toner discharge part 32Y1*d* at the one end part 32Y1, a first groove part 32Y1*g* is disposed. The first groove part 32Y1*g* is configured so as to be engageable with a positioning member 78 (refer to FIG. 8) of the toner container storage part 31. The first groove part 32Y1*g* is formed by two horizontal surfaces 32Y1*ga* and 32Y1*gb* facing to each other and a vertical surface 32Y1*gc* disposed between the two horizontal surfaces 32Y1*ga* and 32Y1*gb*, which extend in a mounting direction of the toner container 32Y with respect to the image forming apparatus 100 (refer to FIG. 17 and FIG. 18). With the groove part 32Y1*g* engaging with the positioning member 78, the one end part 32Y1 is held to the container holding part 70 of the toner container storage part 31 in a non-rotatable manner without interlocking with the rotation of the conveyance member 33 (drive input part 34).

According to the present embodiment, the gripping part 32Y1*c* disposed at the one end part 32Y1 is formed by protruding through the cylindrical container main body 32Y2 in a mounting and removing direction (to a rear end side of the mounting direction). The gripping part 32Y1*c* is provided to facilitate user's handling of the toner container 32Y by allowing the user to grip when replacing (mounting or removing) the toner container 32Y. In the gripping part 32Y1*c*, an insertion hole 41 communicating with a toner loading port 42 (refer to FIG. 25 and FIG. 26) described later is disposed. The insertion hole 41 and the toner loading port 42 are described in detail later.

In the toner discharge part 32Y1*d* disposed at the one end part 32Y1, a pressed part 32Y1*h* and a nozzle insertion port 32Y1*j* (refer to FIG. 16) are disposed. At the end part of the nozzle insertion port 32Y1*j*, a sealing member 32Y20*c* (refer to FIG. 16) enclosing the opening edge thereof is disposed. The sealing member 32Y20*c* prevents toner leakage through a clearance between a nozzle 72 and the nozzle insertion port 32Y1*j* when the toner container 32Y is mounted to the toner container storage part 31Y. The sealing member has a function of absorbing impact applied when the toner container 32Y is completely mounted by sliding in the toner container storage part 31Y.

Figure 19:
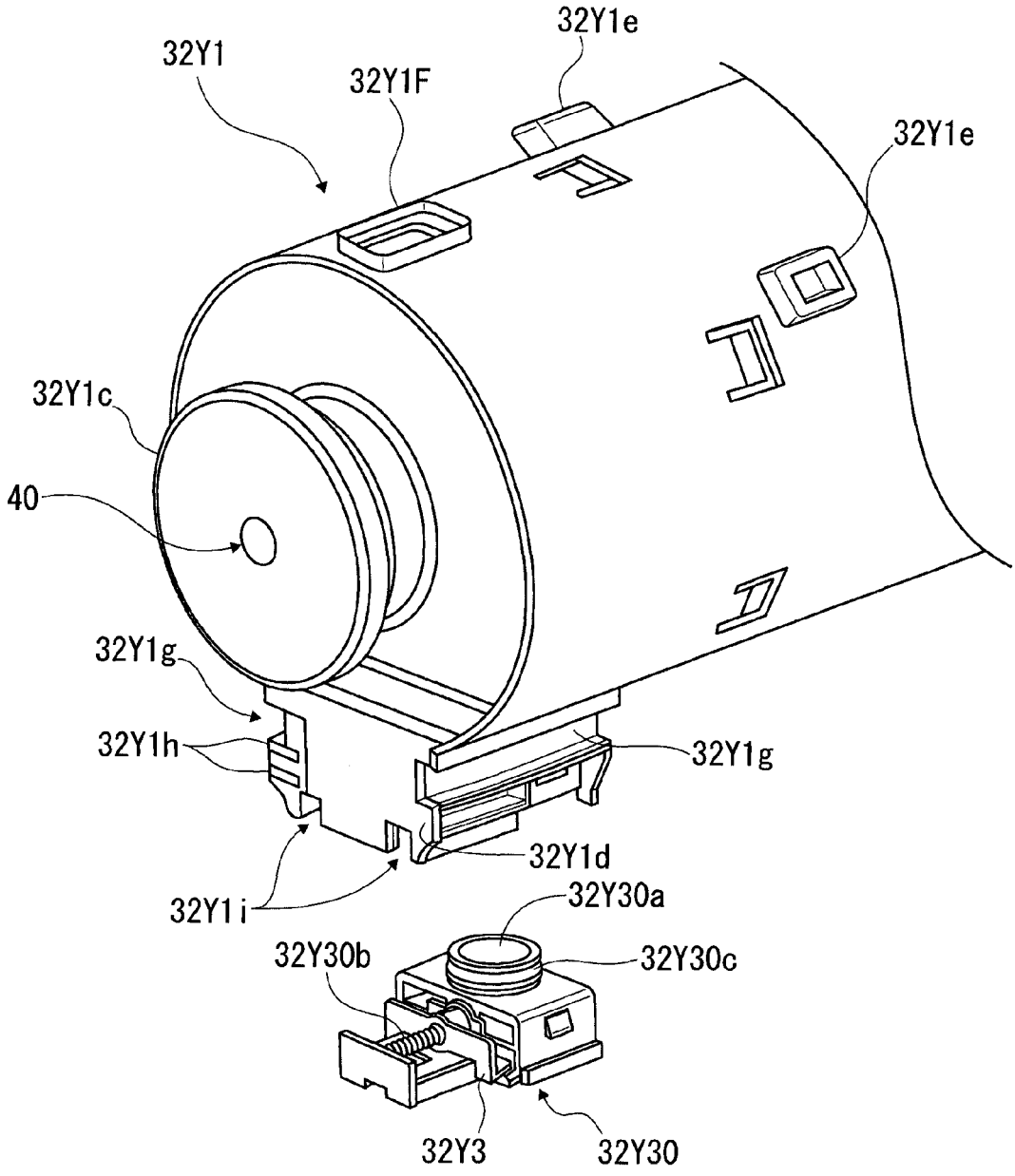
FIG. 19 is a detailed perspective view showing a vicinity of the one end.
Figure 20:
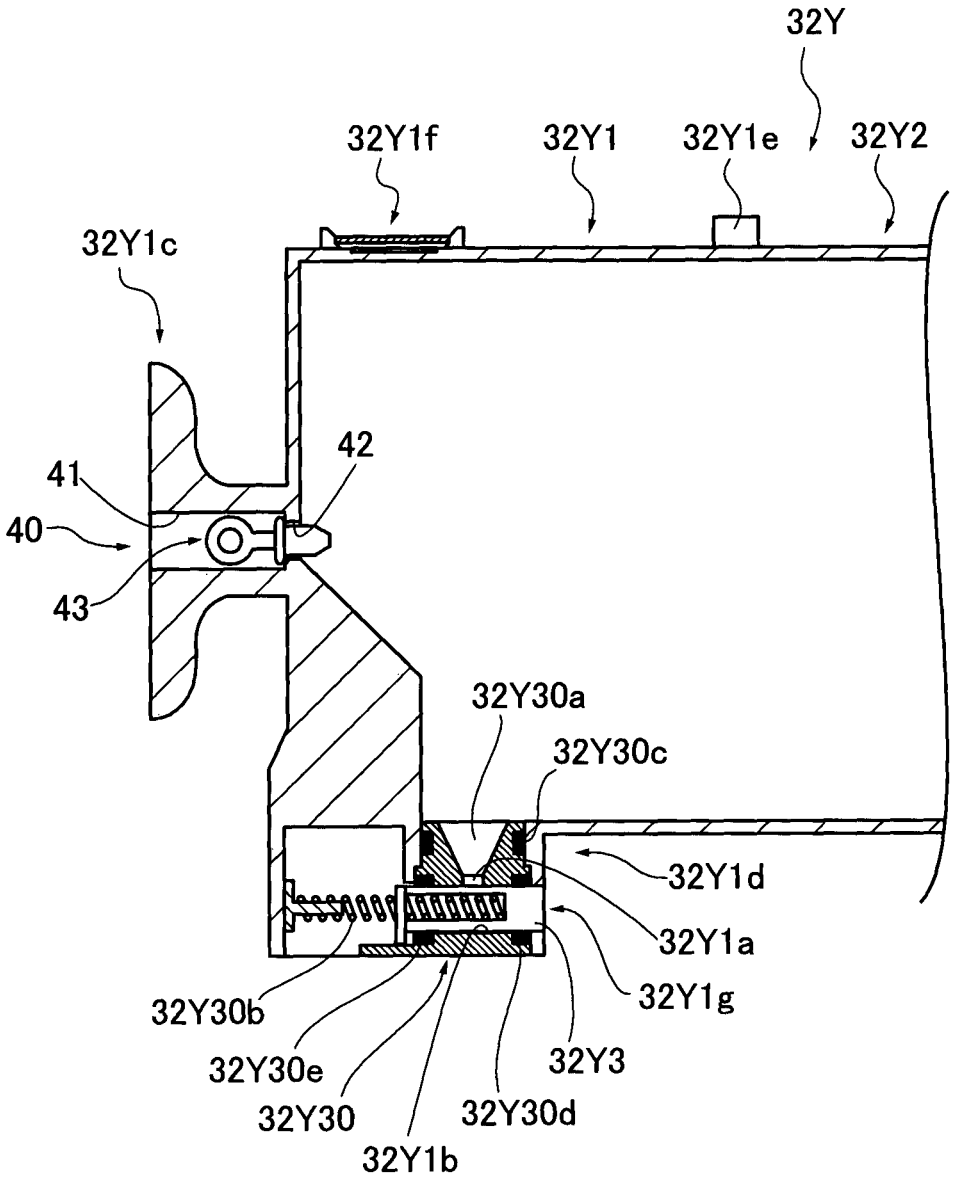
FIG. 20 is a cross-sectional view showing the vicinity of the one end.

At a lower part in a vertical direction of the one end part 32Y1, a concave is formed, and into which the nozzle insertion part 32Y30 is fitted (refer to FIG. 19). As shown in FIG. 20, the nozzle insertion part 32Y30 restricts a hole part 32Y1*b*, a toner discharge port 32Y1*a* and a toner discharge path 32Y30*a*. The hole part 32Y1*b* accommodates the plug member 32Y3 (cylindrical section thereof) in a movable manner. The toner discharge port 32Y1*a* is formed above a peripheral surface of the hole part 32Y1*b* to allow communication of the hole part 32Y1*b* and the toner discharge path 32Y30*a* to each other. The toner discharge path 32Y30*a* is formed above the toner discharge port 32Y1*a* to allow communication between each inner space of the toner discharge port 32Y1*a* and the container main body 32Y2. The nozzle insertion part 32Y30 is configured in such a manner that when the nozzle insertion part 32Y30 is fitted into a concave provided on the toner discharge part 32Y1*d* of the one end part 32Y1, the hole part 32Y1*b* is communicated with the nozzle insertion port 32Y1*j* of the toner discharge part 32Y1*d*.

The plug member 32Y3 is housed in the hole part 32Y1*b*. The plug member 32Y3 includes a cylindrical portion which can be fitted into the hole part 32Y1*b* and a sheet shaped projection portion which protrudes to an end portion thereof (refer to FIG. 19). The plug member 32Y3 is configured to open and close the toner discharge port 32Y1*a* disposed at a peripheral surface of the hole part 32Y1*b* by displacing the position thereof in the hole part 32Y1*b*. The projection portion is provided on a front end of the plug member 32Y3 in a mounting direction of the toner container 32Y and extends horizontally in a direction orthogonal to a center axis of the cylindrical portion. The projection portion causes the cylindrical portion to be displaced to a close position of the toner discharge port 32Y1*a* in the hole part 32Y1*b* when the claw member 75 pressed by a sheet spring of the toner container storage part 31 is engaged thereto when removing the toner container 32Y.

Alternatively, a spring 32Y30*b* (refer to FIG. 20, etc.) may be provided on the nozzle insertion part 32Y30 as a pressing member which presses the toner discharge port 32Y1*a* in a closing direction with respect to the plug member 32Y3. Similarly with the claw member 75, the spring 32Y30*b* has a function of displacing the cylindrical portion to a close position of the toner discharge port 32Y1*a* in the hole part 32Y1*b* when removing the toner container. Further, the spring 32Y30*b* is capable of accelerating an initial operation of the plug member 32Y3 when moving in a direction closing the toner discharge port 32Y1*a*, whereby toner leakage from the toner discharge port 32Y1*a* can be suppressed. According to Embodiment 1, the nozzle insertion part 32Y30 has a configuration comprising both the claw member 75 and the spring 32Y30*b*.

As shown in FIG. 20, O-rings 32Y30*d* and 32Y30*e* are provided on both ends of the hole part 32Y1*b*. The O-rings 32Y30*d* and 32Y30*e* suppress toner leakage through a clearance between the plug member 32Y3 and the hole part 32Y1*b*. Further, an O-ring 32Y30*c* is provided on the nozzle insertion part 32Y30 by enclosing an outer peripheral surface of a portion where the toner discharge path 32Y30*a* is disposed. The O-ring 32Y30*c* suppresses toner leakage through a clearance between a concave at the one end part 32Y1 and the nozzle insertion part 32Y30.

Figure 18:
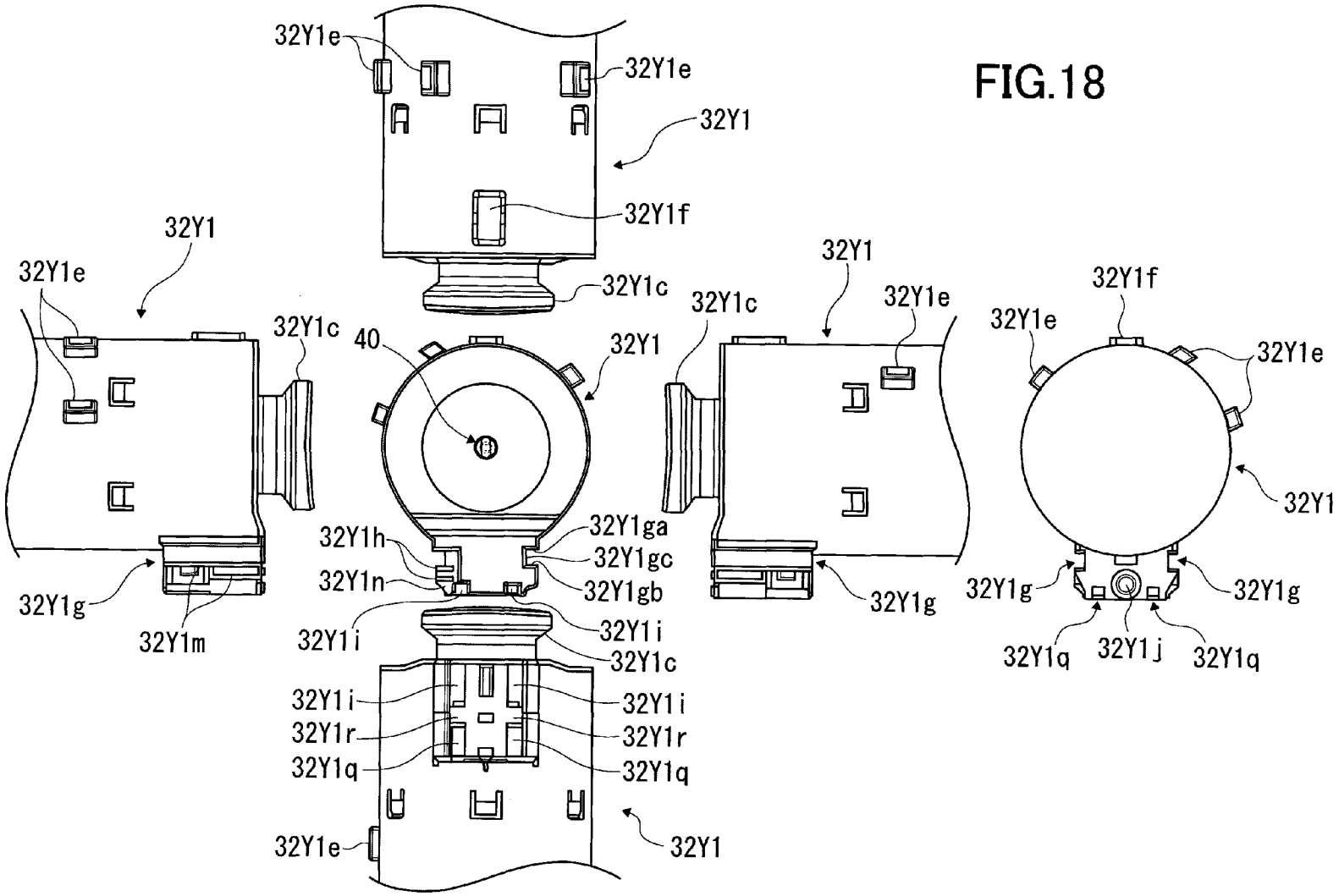
FIG. 18 is a six-sides view showing the one end.

As shown in FIG. 18, a second groove part 32Y1*i* is disposed at a bottom surface of the one end part 32Y1 in order that the claw member 75 of the image forming apparatus 100 engages thereto to move the plug member 32Y3 in a relative manner. Further, at the bottom surface of the one end part 32Y1, a third groove part 32Y1*q* arranged so as to linearly align with the second groove part 32Y1*i* (in series with the mounting direction of the toner container 32Y) is formed. Between the second groove part 32Y1*i* and the third groove part 32Y1*q*, a sliding surface 32Y1*r* pushing the claw member 75 downward by sliding with the claw member (refer to FIG. 3, etc.) of the toner container storage part 31 is disposed. The sliding surface 32Y1*r* prevents the claw member 75 from hindering the mounting of the toner container 32Y by pressing the claw member 75 downward. A slant surface pushing down the claw member 75 in a smooth manner is provided on an edge part of the third groove part 32Y1*q* side of the sliding surface 32Y1*r*.

The electronic substrate 32Y1*f* disposed on the upper surface of the one end part 32Y1 is RFID or the like which is configured to communicate information relating to the toner container 32Y and the image forming apparatus 100 with the image forming apparatus 100 (control part thereof) via the antenna base plate 74 (refer to FIG. 8) as described above. The electronic substrate 32Y1*f* is disposed opposite to the hole part 32Y1*b* across an axis of the toner container 32Y as viewed in a direction orthogonal to the axis. Such configuration prevents a toner adhering in a vicinity of the hole part from adhering to the electronic substrate 32Y1*f* and thereby deteriorating the communication sensitivity with the antenna base plate 74.

As described above, the gripping part 32Y1*c* is disposed at a front side in a mounting direction of the one end part 32Y1 (at a rear end side viewed in the mounting direction) in the toner container 32Y and, therefore, is located on a surface opposite to a surface where the nozzle insertion port 32Y1*j* is disposed in the one end part 32Y1. This suppresses a touch of the nozzle insertion port 32Y1 when the user grips the gripping part 32Y1*c*, and thereby prevents the user from being stained by the toner even when there is a toner adhering in a vicinity of the nozzle insertion port 32Y1*j*.

The color identification projection member 32Y1*e* (projection part) is provided, as described above, to prevent an erroneous mounting of a toner container into an insertion port 71M, 71C or 71K (refer to FIG. 8 and FIG. 9) other than the insertion port 71Y for yellow color in the toner supply device 60Y. That is, the color identification projection member 32Y1*e* is configured so as to be engageable (can be entered into) with a first guide groove 71Y1 (refer to FIG. 8 and FIG. 9) provided on the insertion port 71Y1 for yellow color when a toner container 32Y for yellow color is inserted into the insertion port 71Y appropriately in the mounting direction.

According to Embodiment 1, as shown in FIG. 20, an inner edge side of the toner discharge port 32Y1*a* is disposed at a position closer to the front side than an inner end part of the color identification projection member 32Y1*e*, as viewed from the front side to the inner side in the mounting direction with respect to the image forming apparatus 100. With such arrangement, even when a toner container 32Y of a different color is inserted into the toner container storage part 31, the toner container 32Y is inserted just up to an inner end part in a mounting direction of the color identification projection member 32Y1*e* due to an intervention between the color identification projection member 32Y1*e* and the toner container insertion port 71Y, whereby the toner discharge port 32Y1*a* is not opened by insertion of the nozzle 72. Accordingly, a drop of the toner into the toner container storage part due to toner leakage through the toner discharge port 32Y1*a* and a stain of a toner container storage part by a toner of different color can be prevented.

As shown in FIG. 13 and FIG. 14, when the toner container 32Y is mounted to the toner container storage part 31Y, the pressed part 32Y1*h* disposed in the toner discharge part 32Y1*d* is pressed to the claw member 76*a* of the toner container release lever 76 in the toner container storage part 31Y. That is, when the toner container 32Y pressed by the drive coupling 91 is held by the toner container release lever 76 and fixed with respect to the mounting and removing direction, the pressed part 32Y1*h* is disposed at a position thereof pressed by the toner container release lever 76. The pressed part 32Y1*h* comprises two projection members (ribs) which protrude from a surface 32Y1*n* perpendicular to a mounting and removing direction of the toner container 32Y at the one end part 32Y1 to a removing side. The pressed part 32Y1*h* is pressed to the toner container release lever 76 by a pressing force of the drive coupling 91 from an inner side to a front side, and the positioning precision relative to the mounting and removing direction of the toner container 32Y is improved at a vertex of two projection members.

In the toner discharge part 32Y1*d*, a slant part 32Y1*m* (rib) extending in a direction parallel with the mounting and removing direction, that is, in a direction parallel with a projecting direction of the pressed part 32Y1*h*, is disposed. The slant part 32Y1*m* is provided to hold a release position (a position not preventing the mounting and removal of the toner container) of the toner container release lever 76 by sliding with the toner container release lever 76 when the toner container 32Y is mounted or removed from the toner container storage part 31Y. The slant part 32Y1*m* has a function of ensuring the strength of a surface 32Y1*n* where the pressed part 32Y1*h* is formed. An upper rib out of two ribs as the slant part 32Y1*m* is configured as a horizontal surface 32Y1*gb* forming the first groove part 32Y1*g* engaging with a positioning member 78 of the toner container storage part 31.

Figure 21:
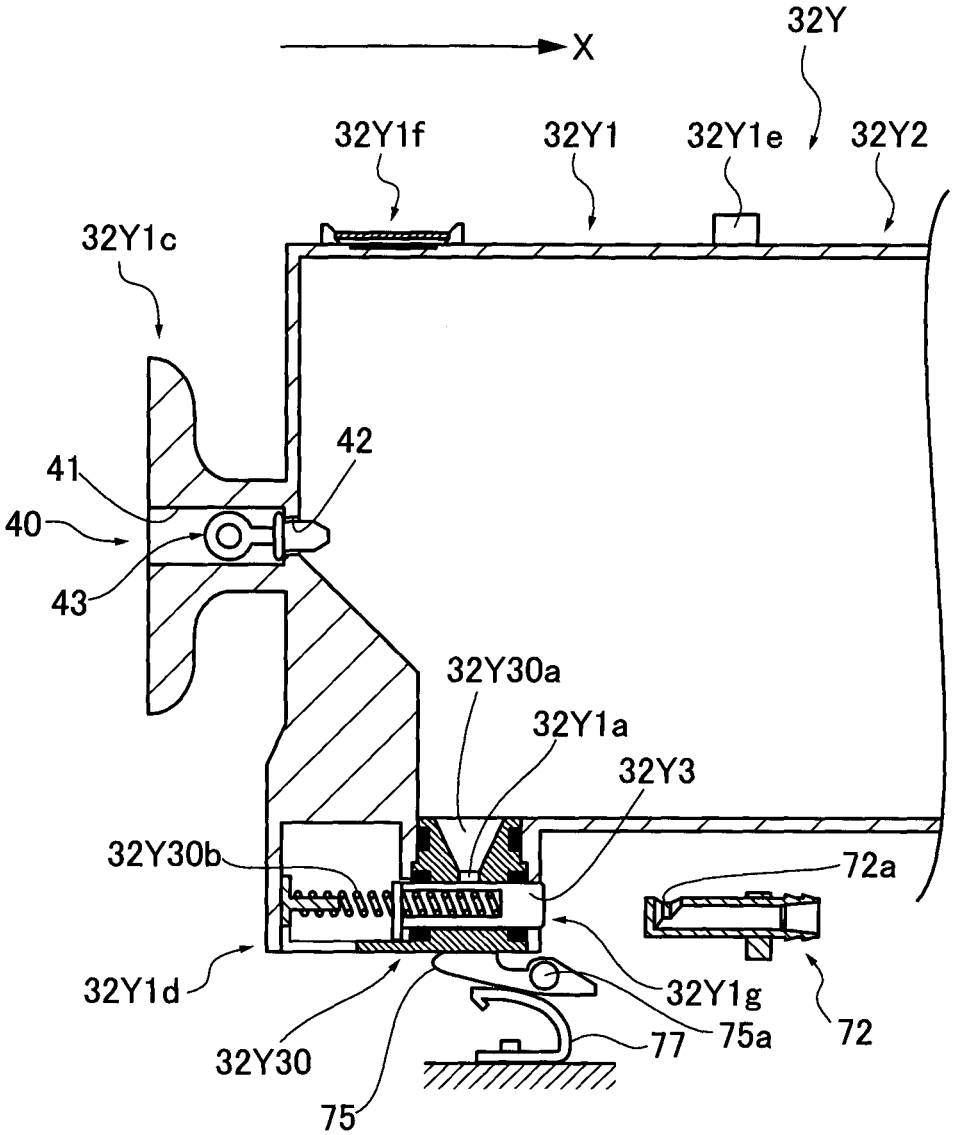
FIG. 21 is a cross-sectional view showing a state when the toner container is being inserted into the toner container storage part.
Figure 24:
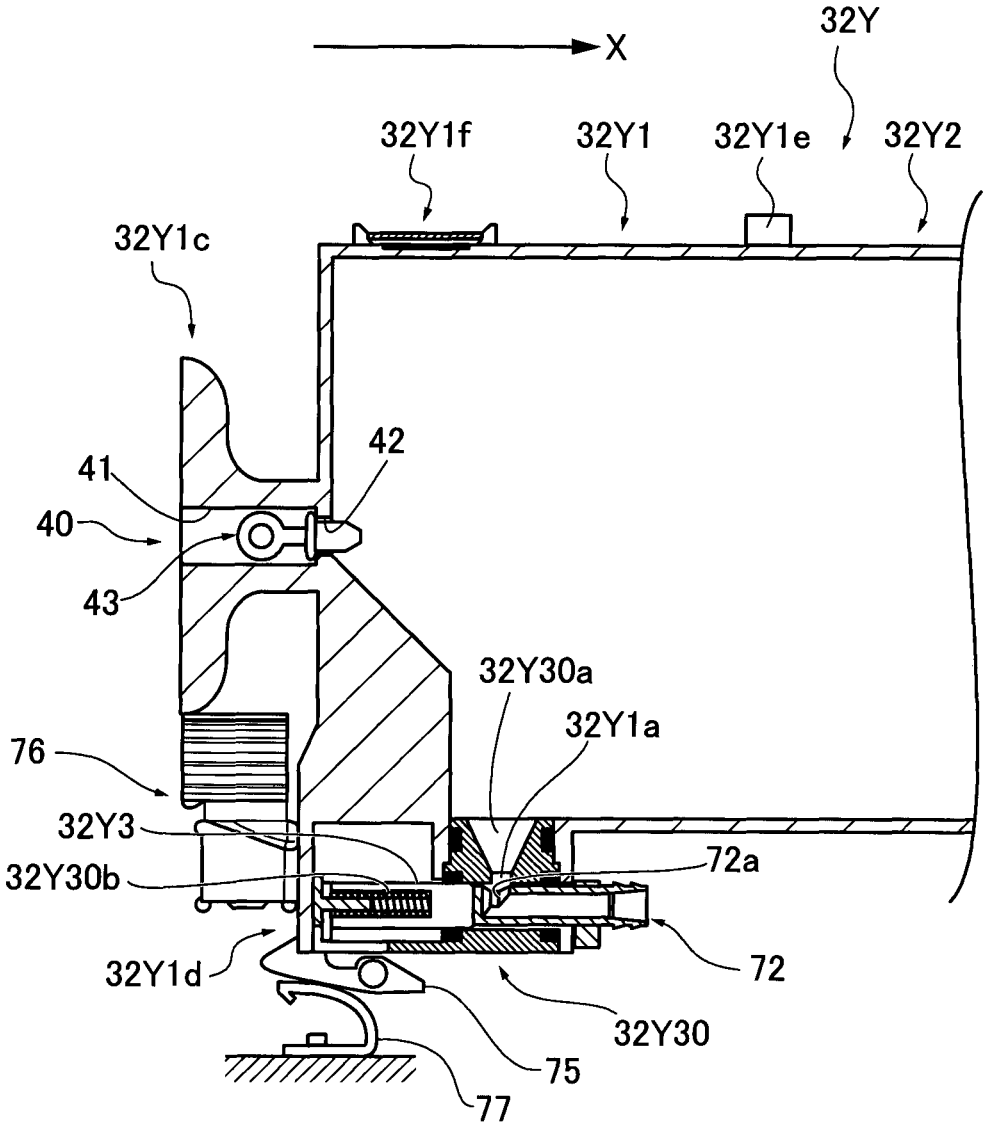
FIG. 24 is a cross-sectional view showing a state when the toner container is held to the toner container storage part.

Next, opening and closing operation of the toner discharge port 32Y1*a* when mounting or removing the toner container 32Y to or from the toner container storage part 31Y is described with reference to FIG. 21 to FIG. 24. FIG. 21 to FIG. 23 are illustrative views showing the toner container 32Y mounted to the toner container storage part 31Y (moved in X direction of arrow) as viewed at a cross section including the axial line of the toner container 32Y. FIG. 24 is an illustrative view similar with FIG. 21 to FIG. 23 showing the toner container 32Y mounted to the toner container storage part 31 (a state when the toner discharge port 32Y1*a* has completely been opened).

When mounting the toner container 32Y to the toner container storage part 31 of the image forming apparatus 100, firstly, a cover (not shown) provided on the front face of the image forming apparatus 100 is opened to expose the toner container storage part 31 forward.

Thereafter, gripping the gripping part 32Y1*c*, the user pushes the toner container 32Y into the toner container storage part 31 (refer to FIG. 4). That is, the toner container 32Y is mounted into the toner container storage part 31 along a longitudinal direction of the toner container 32Y in such a manner that a gripped gripping part 32Y1*c* (one end part 32Y1) is on the front side as viewed in the mounting direction from the front side.

At that time, an inner end part of the slant part (rib) 32Y1*m* in a mounting direction of the toner container 32Y is brought into contact with a claw part slant face 76*a*1 of the toner container release lever 76 at the toner discharge part 32Y1*d* of the one end part 32Y1 of the toner container 32Y. The slant surface 76*a*1 is slanted more toward an inner side in a mounting direction of the toner container 32Y by getting pushed to the toner container storage 32Y side. Thus, the toner container release lever 76 is pushed to an inner end of the rib 32Y1*m* as the toner container 32Y is inserted, and moves to a position (release position) not preventing the mounting of the toner container (refer to an arrow in FIG. 11). Further, when the toner container 32Y is moved to the inner side, the claw part 75 comes into a third claw part 32Y1*q* disposed at the bottom surface of the toner container 32Y (refer to FIG. 21). At that time, a first groove part 32Y1*g* of the one end part 32Y1 and a positioning member 78 of the toner container storage part 31Y engage with each other to start positioning.

As the toner container 32Y is moved into further inner side and the claw member 75 of the toner container storage part 31 abuts the sliding surface 32Y1*r* of the one end part 32Y1, the claw member 75 is pushed down due to a slant surface provided on an edge of the sliding surface 32Y1*r* and moves to a position (recess position) not preventing the mounting of the one end part 32Y1. Then, the claw member 75 moves into an inner side of the toner container 32Y (mounting) while sliding on the sliding surface 32Y1*r* and being pushed downward (refer to FIG. 22).

Thereafter, as the toner container 32Y is further moved into an inner side, the claw member 75 reaches the second groove part 32Y1*i*, displaces upward so as to enter into the second groove part 32Y1*i* from the recess position shown in FIG. 23 and moves to a position engaging with the plug member 32Y3 (rotation with a rotational support axis 75*a* as a center). That is, the claw part 75 is released from a pressure by the sliding surface 32Y1*r* and pushed up by the sheet spring 77. At that time, a cylindrical part of the plug member 32Y3 has its inner end part in a vicinity of the nozzle insertion port 32Y1*j* in the hole part 32Y1*b* of the nozzle insertion part 32Y30 and is in contact with the nozzle 72 of the toner container holding part 70 positioned in a vicinity of the nozzle insertion port 32Y1*j* of the nozzle insertion part 32Y30 (refer to FIG. 23). Thus, the plug member 32Y3 is sandwiched between the nozzle 72 and the claw member 75 and has a fixed position in the toner container storage part 31.

Thereafter, as the toner container 32Y further moves in a mounting direction (X direction indicated by arrow), a nozzle 72Y is inserted into a hole part 32Y1*b* through a nozzle insertion port 32Y1*j* with the first groove part 32Y1*g* and the positioning member 78 engaged with each other. Then, in the hole part 32Y1*b*, the plug member 32Y3 (its cylindrical part) is moved relatively and the toner discharge port 32Y1*a* is opened (refer to FIG. 24).

Thereafter, in the hole part 32Y1*b*, the plug member 32Y3 (cylindrical portion thereof) moves by pressure of the nozzle 72 to a position where the toner discharge port 32Y1*a* is fully opened, and the nozzle 72 is inserted up to a position where the toner receiving port 72*a* and the toner discharge port 32Y1*a* communicate with each other. At that time, the toner container release lever 76 sliding on the rib 32Y1*m* by moving to a release position reaches a front end side in a mounting direction of the rib 32Y1*m* and moves to a holding position by a pressing force of the spring 76*d* after being released from pressure of the rib 32Y1*m* (refer to FIG. 13). Thus, the mounting of the toner container 32Y ends. By operating the mounting procedure in a reverse order, the toner container 32Y can be removed from the toner container storage part 31Y of the image forming apparatus 100.

Figure 25:
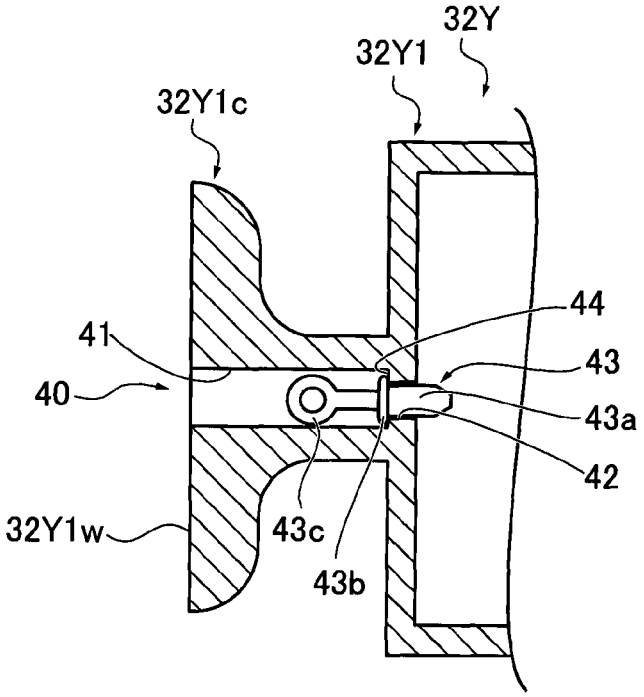
FIG. 25 is an illustrative view showing the toner loading port in a schematic profile.
Figure 26:
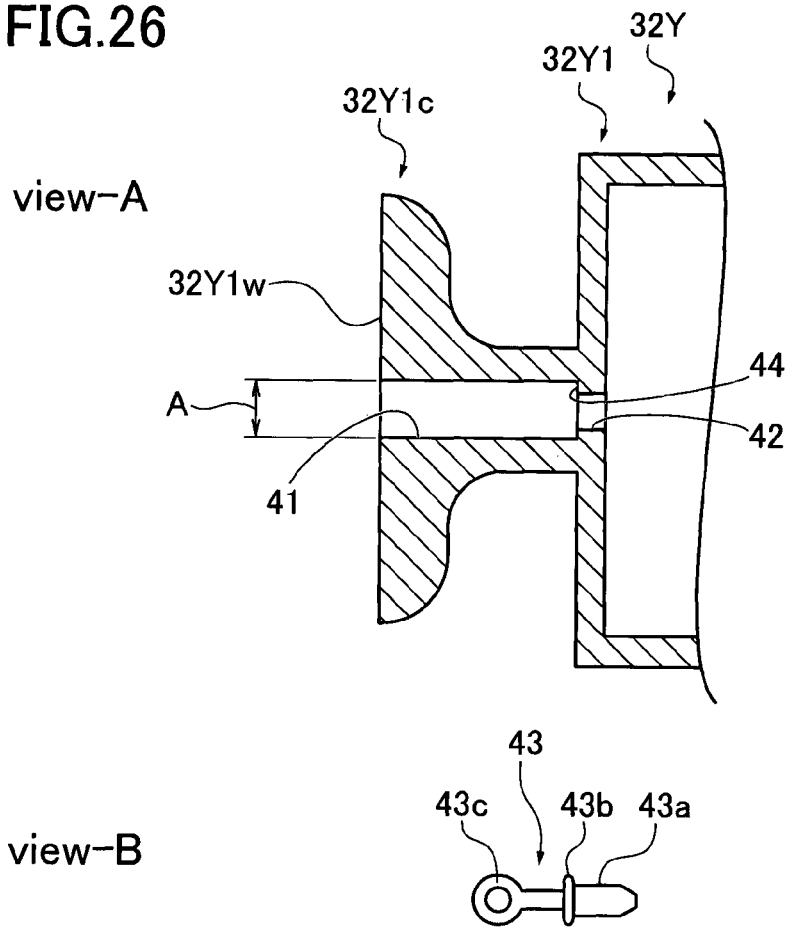
FIG. 26 is an illustrative view for explaining the configuration of the toner loading part, in which view-A shows the insertion hole and the toner loading port provided on the gripping part, and view-B shows the cap.

Next, characteristics of the present invention are described with reference to FIG. 25 and FIG. 26. FIG. 25 is an illustrative view showing the toner loading part 40 in a schematic cross-sectional view. FIG. 26 is an illustrative view for explaining a configuration of the toner loading part 40, in which view-A shows an insertion port 41 and a toner loading port 42 provided in the gripping part 32Y1*c*, and view-B shows a cap 43.

In the toner container 32Y according to the present invention, a toner loading part 40 (refer to FIG. 25) is provided in the gripping part 32Y1*c*. The toner loading part 40 forms a portion (powder loading port) which loads (stores) the toner (powder) into the toner container 32Y (its container main body 32Y2), and includes an insertion hole 41, a toner loading port (powder loading port) 42 and a cap 43. The insertion hole and the toner loading port 42 are through-holes provided by penetrating through the gripping part 32Y1*c* on the axial line of the toner container 32Y and communicate an inner space of the toner container 32Y (container main body 32Y2 thereof) with an outer portion of the projection end face 32Y1*w* at the gripping part 32Y1*c*.

As shown in view-A of FIG. 26, the insertion hole has a cylindrical shape with its one end opening the projection end face 32Y1*w* and the other end communicating with the toner loading port 42. The toner hole 41 has an opening area orthogonal to the axial line which is large enough to prevent insertion of user's finger. According to Embodiment 1, a diameter A is set to not more than 8 mm. Although the insertion hole 41 according to Embodiment 1 has a cylindrical shape with a circular opening orthogonal to the axial line, it may be of the other shape (for example, an opening shape orthogonal to the axial line may be a square column or an octagonal column) as far as it enables the mounting of the cap 43 to the toner loading port as described later, and is not limited to Embodiment 1.

The toner loading port has a cylindrical shape with its opening area orthogonal to the axial line formed smaller than the insertion hole 41, with its one end communicating with the toner loading port 42 and with its other end communicating with an inner space of the toner container 32Y (its container main body 32Y2). In other words, the toner loading port 42 is configured to open an inner wall of the insertion hole 41 and is enclosed by the gripping part 32Y1*c*. Thus, the gripping part 32Y1*c* and the container main body 32Y2 are communicated to each other by the insertion hole 41 and the toner loading port 42 via two concentric circular stepped through-holes as viewed from a rear end side in the mounting direction of the toner container 32Y.

The cap 43 can be inserted into the insertion hole 41 and is a long member having a size rotatable in the insertion hole 41 (refer to FIG. 25). As shown in view-B of FIG. 26, the cap 43 includes an insertion part 43*a* and a flange part 43*b*. The insertion part 43*a* has a cylindrical shape so as to be fitted into the toner loading port 42 and seals the toner loading port 42 by fitting thereto. According to Embodiment 1, the insertion part 43*a* has its tip of a tapered frustoconical shape configured to facilitate insertion into the toner loading port 42. Although the toner loading port 42 and the insertion part 43*a* according to Embodiment 1 have a cylindrically shaped circular opening orthogonal to the axial line, other shapes enabling to seal the toner loading port 42 opening by fitting to each other (for example, a square or octagonal shape orthogonal to the axial line) may be used, and therefore, not limited to Embodiment 1.

A flange part 43*b* has a planar shape extending in a direction orthogonal to an axial line of the insertion part 43*a*. The flange part 43*b* has a size which can abut to a latching end face 44 formed between the insertion hole 41 and the toner loading port 42 by a difference of diameters therebetween.

A hooking part 43*c* is disposed opposite to the insertion part 43*a* in the cap 43 and facilitates to hold the cap 43. The hooking part 43*c* has a circular shape having a center line orthogonal in an extending direction of the cap 43. The cap 43 has a size which ensures that a tip of the hooking part 43*c* is not protruded through the insertion hole 41 in a state where the insertion part 43*a* is fitted to the toner loading port 42 with the flange part 43*b* abutted to the latching end face 44. In other words, depth of the insertion hole 41 (length viewed in the extending direction) is not less than a length from the flange part 43*b* to the hooking part 43*c* in the cap 43. The cap 43 serves as a sealing member which is capable of sealing the toner loading port 42 as a powder loading port. In the cap 43, the flange part 43*b* and the hooking part 43*c* communicate with the insertion part 43*a*, and become a head portion where the insertion part 43*a* extends out from the sealed toner loading port 42.

In the toner loading part 40, the toner is loaded (stored) into the toner container 32Y (container main body 32Y2 thereof) through the insertion hole 41 and the toner loading port 42. Thereafter, the cap 43 with the hooking part 43*c* held by a fitting (not shown) is inserted through the insertion hole 41, the insertion part 43*a* is fitted to the toner loading port 42 to engage the flange part 43*b* to the latching end face 44, and thereby the toner loading port 42 is sealed. The fitting may be of a type which is capable of holding the hooking part 43*c* and being inserted into the insertion hole 41 by gripping thereof. According to Embodiment 1, a fitting capable of holding the hooking part 43*c* by hooking to a hole of the hooking part 43*c* is used as the hooking part 43*c* has a circular shape. Thus, a shape of the hooking part 43*c* is not limited to the shape according to Embodiment 1 as far as capable of holding the cap 43 by hooking thereto. Further, the toner container 32Y may be cleaned and re-loaded by removing the cap 43 from the toner loading port 42 in the re-cycling process.

In toner containers (32Y, 32M, 32C and 32K) according to the present invention, the toner loading port 42 for loading (storing) the toner into the toner container 32Y are enclosed by the gripping part 32Y1*c* and sealed by the cap 43 (its insertion part 43*a*), whereby release of the toner loading port 42 due to an erroneous removal of the cap 43 from the toner loading port 42 can be prevented.

Further, in toner containers (32Y, 32M, 32C and 32K), the toner loading part 40 seals the toner loading port 42 disposed at the gripping part 32Y1*c* at the insertion part 43*a* of the cap 43, and the cap 43 (hooking part 43*c* thereof) is configured not to protrude through the insertion hole 41 in the sealed state, whereby an erroneous touch of the cap 43 is prevented and thereby erroneous opening of the toner loading port 42 can be prevented.

Further, in toner containers (32Y, 32M, 32C and 32K), an opening area of the insertion hole 41 orthogonal to the axial line has a size (not more than 8 mm according to Embodiment 1) enough to prevent insertion of user's finger thereto, whereby user's touch to the cap 43 (hooking part 43*c* thereof) can be suppressed and thereby erroneous opening of the toner loading port 42 can be prevented effectively.

In toner containers (32Y, 32M, 32C and 32K), the toner loading part 40 comprising the toner loading port 42 and the cap 43 is disposed in the gripping part 32Y1*c*, whereby opening of the toner loading port 42 due to an erroneous removal of the cap 43 from the toner loading port 42 can be prevented.

In toner containers (32Y, 32M, 32C and 32K), the cap 43 (hooking part 43*c* thereof) is configured not to protrude beyond the insertion hole 41 when the toner loading port 42 is sealed by the cap 43 (insertion part 43*a* thereof), whereby an erroneous holding of the cap 43 can be prevented when the user is going to grip the gripping part 32Y1*c* for mounting or the like, and thereby interference of gripping the gripping part 32Y1*c* can be prevented and an erroneous opening of the toner loading port 42 can be prevented as well.

In toner containers (32Y, 32M, 32C and 32K), the hooking part 43*c* of the cap 43 has a circular shape having a center line orthogonal to an extending direction of the cap 43, whereby the cap 43 cannot be removed without using a fitting which can be inserted into a hole of the hooking part 43*c* in the insertion hole 41 having a small opening size, and thereby an erroneous opening of the toner loading port 42 can be prevented effectively.

In toner containers (32Y, 32M, 32C and 32K), the cap 43 sealing the toner loading port 42 is provided in the insertion hole 41, whereby even when an unintended impact is applied, breakage of the cap 43 or drop of the cap 43 from the toner loading port 42 can be prevented and thereby an erroneous opening of the toner loading port 42 can be prevented effectively.

In toner containers (32Y, 32M, 32C, and 32K), the toner loading port 42 opens a projection end face 32Y1*w* of the gripping part 32Y1*c* which is an end face as viewed in an axial direction via the insertion hole 41, whereby the toner can be loaded through the toner loading port 42 in a vertical direction when the container main body 32Y2 is raised up in a vertical direction (with the bottom of the toner container (an insertion end side when mounting) as a standing face), whereby the efficiency of toner loading operation can be improved.

In toner containers (32Y, 32M, 32C and 32K), the toner discharge port 32Y1*a* is disposed, in the container main body 32Y2, at the one end part 32Y1 where the gripping part 32Y1*c* comprising the toner loading port 42 is disposed, whereby when the toner is loaded in a vertical direction through the toner loading port 42 with the container main body 32Y2 rising up in a vertical direction, the toner discharge port 32Y1*a* is positioned at an upper side in the vertical direction, and thereby clogging of the toner at the toner discharge port 32Y1*a* due to degassing or the like during toner loading can be prevented.

Accordingly, the toner containers (32Y, 32M, 32C and 32K) as a powder storage container according to Embodiment 1 of the present invention are capable of preventing an erroneous opening of the toner loading port 42 as a powder loading port.

Embodiment 2

Next, toner containers (32BY, 32BM, 32BC and 32BK) according Embodiment 2 of the present invention are described with reference to FIG. 27 and FIG. 28. Embodiment 2 is different from Embodiment 1 in the configuration of a toner loading part 40B in toner containers (32BY, 32BM, 32BC and 32BK). The toner loading part 40B can be mounted to the image forming apparatus according to Embodiment 1. A basic configuration of toner containers (32BY, 32BM, 32BC and 32BK) according to Embodiment 2 is same as the configuration of toner containers (32Y, 32M, 32C and 32K) according to Embodiment 1. Therefore, detailed description of the toner containers is omitted by denoting equivalent parts with same reference numerals. Although four kinds of toner containers are used corresponding to respective colors (yellow, magenta, cyan and black), a basic configuration thereof is same as toner containers (32Y, 32M, 32C and 32K) according to Embodiment 1 except a type of stored toners and a color identification projection member (32Y1*e* (refer to FIG. 15, etc)). Therefore, hereinafter, a configuration of a toner container 32BY of yellow only is described, and description of other configurations is omitted.

Figure 27:
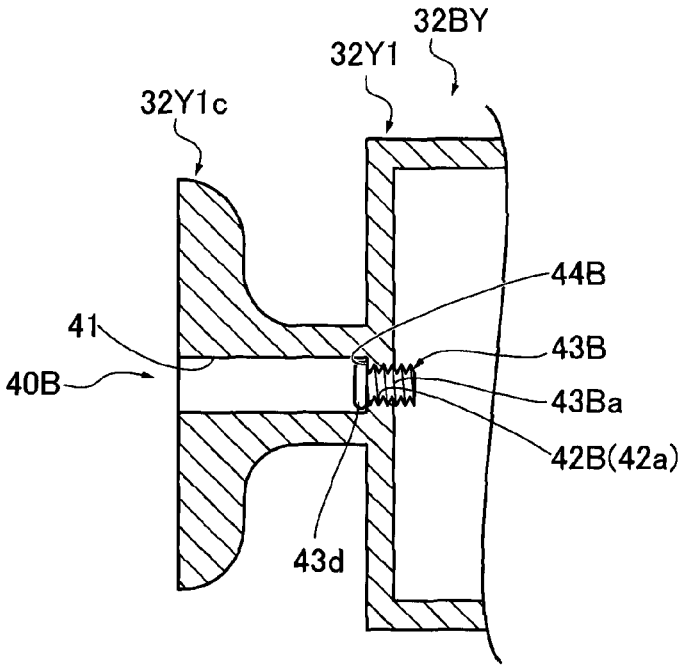
FIG. 27 is an illustrative view similar with FIG. 25, for explaining the configuration of the toner loading part of the toner container according to Embodiment 2.

FIG. 27 is an illustrative view similar with FIG. 25 for explaining a configuration of the toner container 32BY and a toner loading part 40B according to Embodiment 2. FIG. 28 is an illustrative view similar with FIG. 26 for explaining the configuration of the toner loading part 40B, in which view-A shows an insertion hole 41 and a toner loading port 42B disposed in a gripping part 32Y1*c*, and view-B shows a cap 43B.

Figure 28:
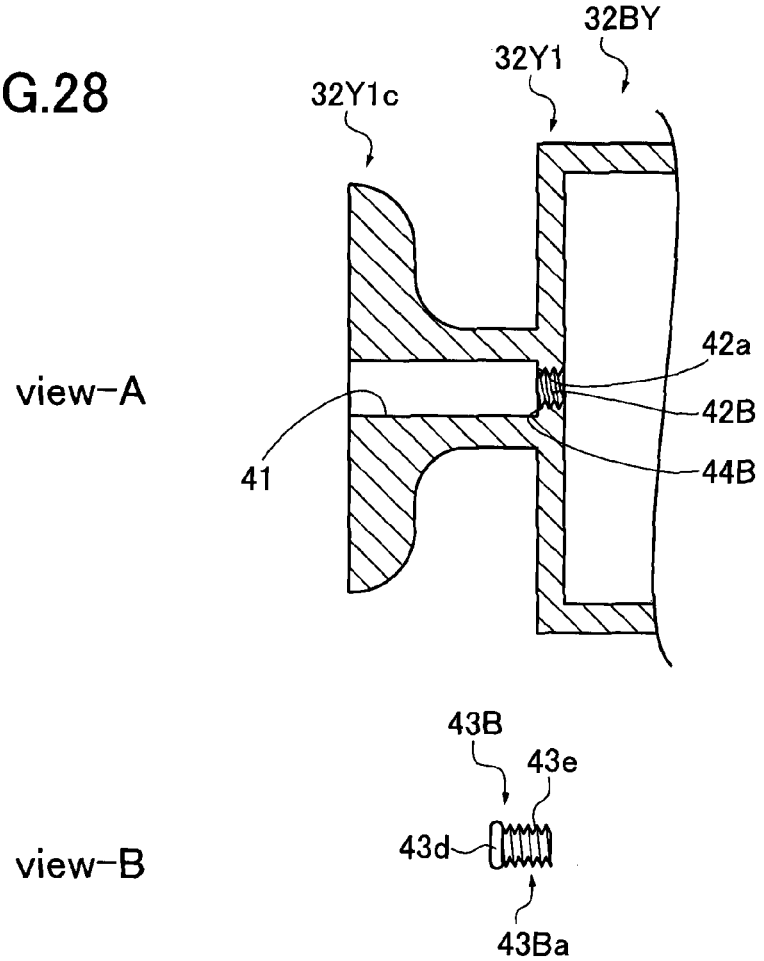
FIG. 28 is an illustrative view similar with FIG. 26 for explaining the configuration of the toner loading part according to Embodiment 2, in which view-A shows an insertion hole and a toner loading port provided on the gripping part, and view-B shows the cap.

The toner loading part 40B of the toner container 32BY according to Embodiment 2 is disposed in the gripping part 32Y1*c* as shown in FIG. 28 and includes the insertion hole 41, the toner loading port 42B and the cap 43B. As shown in view-A of FIG. 27, the configuration of the insertion hole 41 is same as the toner loading part 40 according to Embodiment 1. According to Embodiment 2, the insertion hole 41 has a cylindrical shape with a circular opening orthogonal to an axial line. However, it may be of other shapes (for example, an opening shape orthogonal to the axial line is a square column or an octagonal column) as far as it enables the mounting of the cap 43B to the toner loading port 43B as described later, and therefore is not limited to Embodiment 1.

At the toner loading port 42B of the toner loading part 40B, a female screw groove 42*a* serving as a female screw is disposed on an inner peripheral wall thereof. The toner loading port 42B has the same configuration as that of the toner loading port 42 according to Embodiment 1 except that the female screw groove 42*a* is disposed. The cap 43 is mounted to the toner loading port 42B.

As shown in view-B of FIG. 26, the cap 43 includes an insertion part 43Ba and a head part 43*d*. The insertion part 43Ba includes a male screw groove 43*e* serving as a male screw disposed on a cylindrically-shaped peripheral wall. The male screw groove 43*e* can be meshed with the female screw groove 42*a* of the toner loading port 42B. Thus, the insertion part 43Ba of the cap 43B can be screwed into the toner loading port 42B. Insertion of the insertion part 43Ba thus screwed into the toner loading port 42B seals the toner loading port 42B.

The head part 43*d* is disposed continuously to the insertion part 43Ba. The head part 43*d* has a size which can abut to a latching end face 44B formed between the insertion hole 41 and the toner loading port 42B by a difference of diameters therebetween. In the head part 43*d*, an engagement groove (not shown) is disposed on an upper end face (an end face on the left side as viewed from front side of view-B of FIG. 28) to rotate the cap 43B. The engagement groove is a lengthy groove disposed in a crisscross arrangement according to Embodiment 2.

The cap 43B has a size which ensures that a tip of the head part 43*d* is not protruded beyond the insertion hole 41 in a state where the insertion part 43Ba is screwed into the toner loading port 42B, and thereby the head part 43 is engaged with the latching end face 44. In other words, a depth of the insertion hole 41 (a length viewed in the extending direction) is not less than a thickness of the head part 43*d* in the cap 43B.

In the toner loading part 40B, the toner is loaded (stored) into the toner container 32BY (container main body 32Y2 thereof) through the insertion hole 41 and the toner loading port 42B. Thereafter, the cap 43B is inserted through the insertion hole 41, the insertion part 43Ba thereof (male screw groove 43*e* thereof) is screwed into the toner loading port 42B (its female screw groove 42*a*) by a fitting (not shown), and thereby the head part 43*d* is engaged with the latching end face 44 to seal the toner loading port 42B. The fitting may be of a type which can rotate the cap 43B in the insertion hole 41 by engaging with an engagement groove disposed in the head part 43*d*. According to Embodiment 2, an engagement groove (not shown) of the head part 43*d* is a crisscross-shaped groove. Therefore, a plus driver is used as the fitting. Further, the toner container 32BY may be cleaned and re-loaded by removing the cap 43B from the toner loading port 42B in the re-cycling process.

Toner containers (32BY, 32BYM, 32BC and 32BK) according to Embodiment 2 are capable of basically providing similar effects as Embodiment 1 since configuration thereof is basically same as toner containers (32Y, 32M, 32C and 32K) according to Embodiment 1.

In addition to the effects, toner containers (32BY, 32BM, 32BC, and 32BK) according to Embodiment 2 have the toner loading part 40B in which the cap 43B is held by being screwed into the toner loading port 42B. Thus, the toner loading port 42B can be sealed by the cap 43B with a high strength, whereby, for example, even when a big impact such as a drop of the toner container is applied, detachment of the cap 43B from the toner loading port 42B can be prevented and thereby an erroneous opening of the toner loading port 42B can be prevented effectively.

Accordingly, the toner containers as a powder storage container according to Embodiment 3 of the present invention (32BY, 32BM, 32BC and 32BK) are capable of preventing an erroneous opening of the toner loading port 42 as a powder loading port.

Embodiment 3

Next, toner containers (32CY, 32CM, 32CC and 32CK) according to Embodiment 3 of the present invention are described with reference to FIG. 29 to FIG. 31. The configuration of a toner loading part 40C in toner containers (32CY, 32CM, 32CC and 32CK) according to Embodiment 3 is different from the configuration according to Embodiments 1 and 2. The toner loading part 40C can be mounted to the image forming apparatus 100 according to Embodiment 1 described above. The basic configuration of toner containers (32CY, 32CM, 32CC and 32CK) is same as toner containers (32Y, 32M, 32C and 32K) according to Embodiment 1 described above. Therefore, detailed description thereof is omitted by denoting equivalent parts with same reference numerals. Although four kinds of toner containers are used corresponding to respective colors (yellow, magenta, cyan and black), a basic configuration thereof is same as toner containers (32Y, 32M, 32C and 32K) according to Embodiment 1 except a type of stored toners and a color identification projection member (32Y1*e* (refer to FIG. 15, etc)). Therefore, hereinafter, a configuration of a toner container 32CY of yellow only is described, and description of other configurations is omitted.

Figure 29:
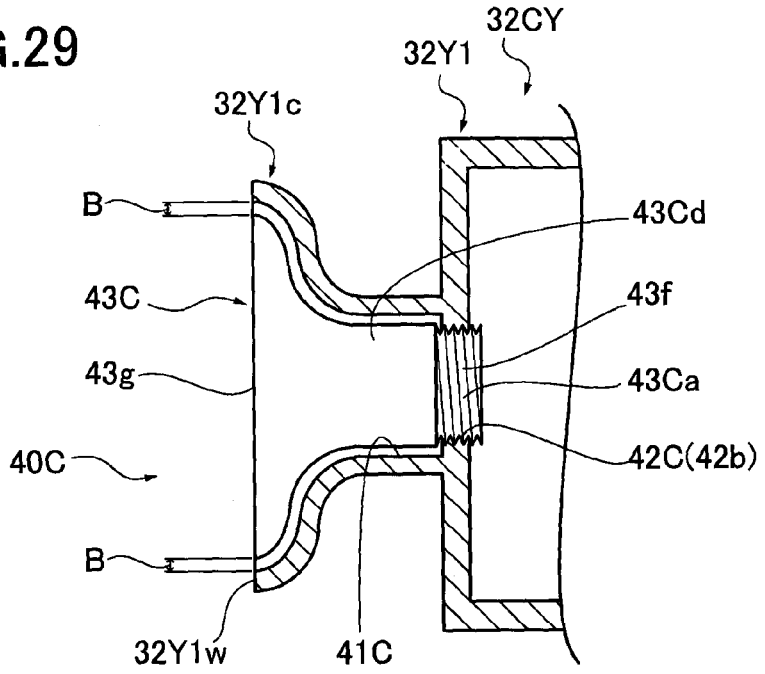
FIG. 29 is an illustrative view similar with FIG. 25 for explaining a configuration of the toner loading port according to Embodiment 3.

FIG. 29 is an illustrative view similar with FIG. 25 for explaining a configuration of a toner loading part 40C of a toner container 32CY according to Embodiment 3. FIG. 30 is an illustrative view similar with FIG. 26 for explaining the configuration of the toner loading part 40C, in which view-A shows an insertion hole 41C and a toner loading port 42C disposed in a gripping part 32Y1*c*, and view-B shows a cap 43C. FIG. 31 is an illustrative view for explaining an upper end face 43*g* of the cap 43C vied from a front side thereof.

The toner loading part 40C of the toner container 32CY according to Embodiment 3 is disposed in the gripping part 32Y1*c* as shown in FIG. 29 and includes the insertion hole 41C, the toner loading port 42C and the cap 43C. The insertion hole 41C has a hole-like shape following an external shape of the gripping part 32Y1*c*. The insertion hole 41C has a cylindrical shape configured to increase a diameter thereof, in the gripping part 32Y1*c*, toward a rear end side (front side in a mounting direction (left side as viewed from front side of view-A of FIG. 30) of the toner container. According to Embodiment 3, the insertion hole 41C has a cylindrical shape on a side of a container main body 32Y2 (right side as viewed from front side of view-A of FIG. 30) extending with a same diameter, and a curved cylindrical shape on a rear end side of the toner container 32CY thereof on the toner container 32CY with a change ratio of a diameter varying with respect to the axial direction. At the toner loading port continuous to the insertion hole 41C, a female screw groove 42*b* serving as a female screw is disposed on an inner peripheral wall.

Figure 30:
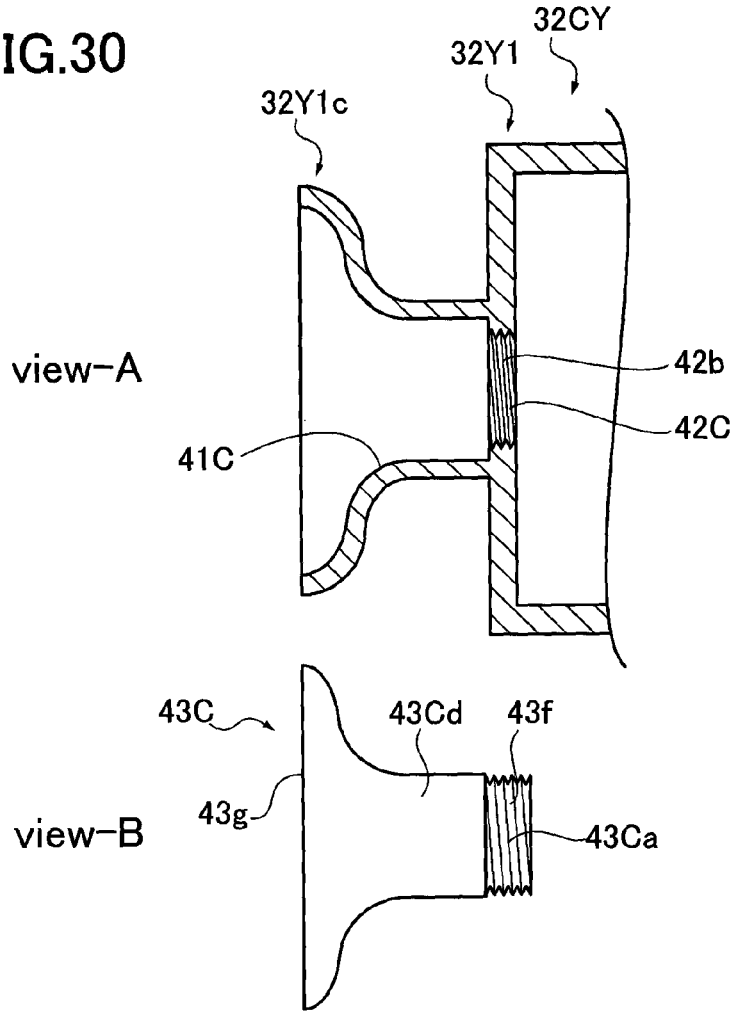
FIG. 30 is an illustrative view similar with FIG. 26 for explaining the configuration of the toner loading port according to Embodiment 3, in which view-A shows an insertion hole and a toner loading port provided in the gripping part, and view-B shows a cap.

As shown in view-B of FIG. 30, the cap 43C includes an insertion part 43Ca and a head part 43Cd. The insertion part 43Ca is configured with a male screw groove 43*f* serving as a male screw disposed on a cylindrical peripheral wall. The male screw groove 43*f* can mesh with a female screw groove 42*b* of the toner loading port 42C. Thus, the insertion part 43Ca of the cap 43C can be screwed into the toner loading port 42B. Insertion of the insertion part 43Ca thus screwed into the toner loading port 42C seals the toner loading port 42C.

The head part 43Cd is disposed continuous to the insertion part 43Ca. The head part 43Cd has a shape and a size which can be accommodated into an insertion hole 41C along an inner peripheral wall of the insertion hole 41C, with the insertion part 43Ca screwed into the toner loading port 42C, as shown in FIG. 29. In other words, the head part 43Cd has an outer peripheral wall following an inner peripheral wall (of hole-like shape) of the insertion hole 41C. That is, the head part 43Cd has a circular cross-sectional shape and a columnar shape with a diameter thereof increasing toward a rear end side (left side as viewed from front side of view-B of FIG. 30) of the toner container 32CY. According to Embodiment 3, the head part 43Cd has a predetermined clearance B (refer to FIG. 29 to FIG. 31) between inner and outer peripheral walls of the insertion hole 41C in a state where the insertion part 43Ca is screwed into the toner loading port 42C. The clearance B enables an appropriate screwing of the cap 43C to the toner loading port 42C and smoothens rotation of the head part 43Cd in the insertion hole 41C for the screwing. The clearance B has a size enough to prevent insertion of a user's finger, and is set not more than 8 mm according to Embodiment 3.

Figure 31:
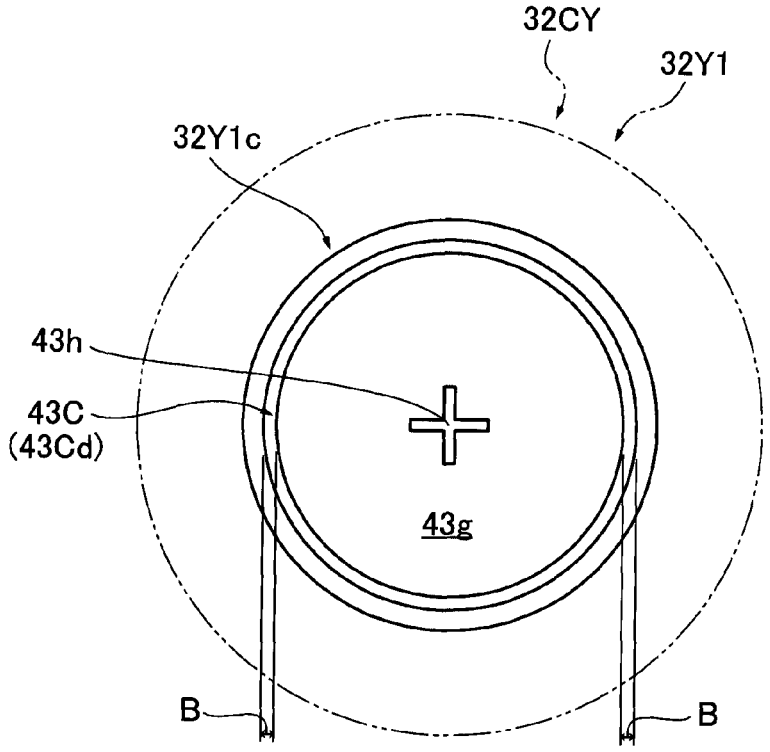
FIG. 31 is an illustrative view as viewed from the front side for explaining a configuration of an upper end face of the cap according to Embodiment 3.

As shown in FIG. 31, the head part 43Cd is provided with an engagement groove 43*h* disposed on an upper end face thereof (a left end face as viewed from front side of view-B of FIG. 30) for rotation of the cap 43C. According to Embodiment 3, the engagement groove 43*h* is a lengthy groove in a crisscross arrangement.

The cap 43C has a size which ensures, in a state where the insertion part 43Ca is screwed into the toner loading port 42C, that an upper end face 43*g* of the head part 43Cd comes to a position recessed from (upper end position of the insertion hole 41C) or on the same plane as the projection end face 32Y1*w* of the gripping part 32Y1*c*. In other words, a depth of the insertion hole 41C (length viewed in an extending direction) is not less than a height of the head part 43Cd in the cap 43. According to Embodiment 3, the depth of the insertion hole 41C is equal to the height of the head part 43Cd.

In the toner loading part 40C, the toner is loaded (stored) into the toner container 32CY (container main body 32Y2 thereof) through the insertion hole 41C and toner loading port 42C. Thereafter, the cap 43C is inserted through the insertion hole 41C, an upper end face 43*g* of the head 43Cd is engaged to the engagement groove 43*h* by a fitting (not shown), and thereby the insertion part 43Ca thereof (male screw groove 43*f* thereof) is screwed into the toner loading port 42C (its male screw groove 42*b*) to seal the toner loading port 42C. The fitting may be of a type which is capable of rotating the cap 43C in the insertion hole 41C by engaging the upper end face 43*g* of the head 43Cd to the engagement groove 43*h*. Since the engagement grove 43*h* of the head part 43Cd according to Embodiment 3 is a crisscross-shaped groove (refer to FIG. 31), a plus driver is used as the fitting. In the toner container 32CY, cleaning and toner re-loading can be performed in a recycling process by removing the cap 43C from the toner loading port 42C.

Toner containers according to Embodiment 3 are basically capable of providing the same effect as Embodiment 1 since the configuration thereof is basically same as toner containers according to Embodiment 1 (32Y, 32M, 32C and 32K).

In addition to the effects, toner containers (32CY, 32CBM, 32CC, and 32CK) according to Embodiment 2 have the toner loading part 40C in which the cap 43C is held by being screwed into the toner loading port 42C. Thus, the toner loading port 42C can be sealed by the cap 43C with a high strength, whereby, for example, even when a big impact such as a drop of the toner container is applied, detachment of the cap 43C from the toner loading port 42C can be prevented and thereby an erroneous opening of the toner loading port 42C can be prevented effectively.

In addition, in the toner containers according to Embodiment 3 (32CY, 32CM, 32CC and 32CK), the clearance B is provided between the outer peripheral wall of the head part 43Cd and the inner peripheral wall of the insertion hole 41C, and the clearance B is set to a small size (not more than 8 mm according to Embodiment 3), whereby erroneous detachment of the cap 43C is prevented. Accordingly, they are capable of preventing an erroneous opening of the toner loading port 42 as a powder loading port.

Further, in the toner containers according to Embodiment 3 (32CY, 32CM, 32CC and 32CK), the clearance B between the outer peripheral wall of the head part 43Cd and the inner peripheral wall of the insertion hole 41C is set to a small size (not more than 8 mm according to Embodiment 3), whereby erroneous detachment of the cap 43C is prevented and thereby a freedom degree of the size setting of the insertion hole 41C (diameter thereof) can be improved. Thus, the size of the insertion hole 41C (diameter thereof) can be set larger, whereby a size of the toner loading port 42C (its diameter) disposed on an inner wall thereof can be set larger and thereby the efficiency of toner loading can be improved.

Accordingly, the toner containers as a powder storage container according to Embodiment 3 of the present invention (32CY, 32CM, 32CC and 32CK) are capable of preventing an erroneous opening of the toner loading port 42 as a powder loading port.

Figure 32:
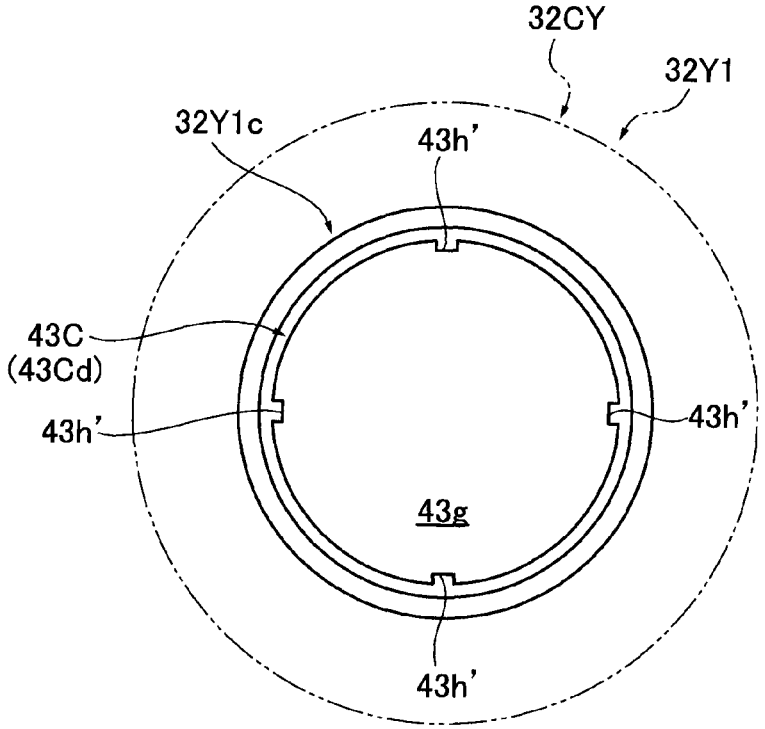
FIG. 32 is an illustrative view similar with FIG. 31 showing an example of the upper end face of the cap according to Embodiment 3, which is different from that of FIG. 31.

Further, in toner containers (32CY, 32CM, 32CC and 32CK) according to Embodiment 3, the engagement groove 43*h* on the upper end face 43*g* of the cap 43C in the toner loading part 40C is a crisscross-shaped groove. However, a groove of the other type (a lengthy slit or a groove (hole) having a hexagonal cross section) may be used as far as it allows rotation of the cap 43C in the insertion hole 41C engaged by the fitting or may be a groove (a cutout part) disposed on a peripheral portion of the upper end face 43*g*. Therefore, the type of the engagement groove 43*h* is not limited to Embodiment 3 described above. An engagement groove 43*h* as an example of the groove (cutout part) disposed on the peripheral portion of the upper end face 43*g*' is shown in FIG. 32. The engagement groove 43*h*' is formed at four locations so as to cut the peripheral portion of the upper end face 43*g* at intervals equal to each other as viewed around an axial line of the upper end face 43*g*. In such configuration, the number, location and cross-section shape of engagement grooves may be set in an appropriate manner so as to enable rotation of the cap 43*c* in the insertion hole 41C by an engagement with the fitting. This is same as the cap 43B according to Embodiment 2.

Embodiment 4

Figure 33:
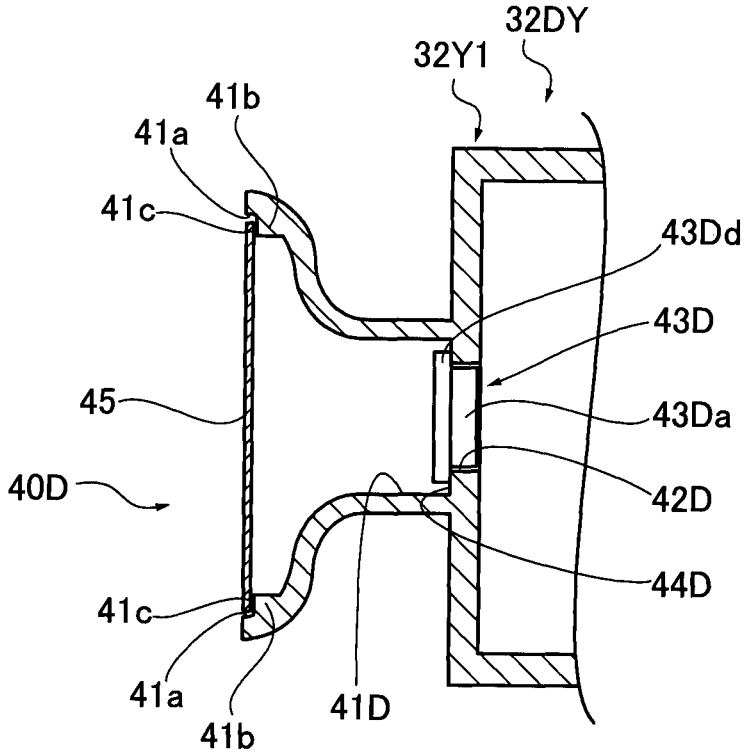
FIG. 33 is an illustrative view similar with FIG. 25 for explaining a configuration of a toner loading port of a toner container according to Embodiment 4.

Next, a toner container (32DY, 32DM, 32DC and 32DK) according to Embodiment 4 of the present invention is described with reference to FIG. 33. Embodiment 4 is different from first, second and Embodiment 3 in the configuration of a toner loading part 40D in toner containers (32DY, 32DM, 32DC and 32DK), and the toner loading part 40D can be mounted to the image forming apparatus 100 according to Embodiment 1 described above. Since a basic configuration of toner containers (32DY, 32DM, 32DC and 32DK) according to Embodiment 4 is same as toner containers (32Y, 32M, 32C and 32K) according to Embodiment 1 described above, equivalent parts are denoted with same reference numerals and description thereof is omitted. Although four kinds of toner containers are used corresponding to respective colors (yellow, magenta, cyan and black), a basic configuration thereof is same as toner containers (32Y, 32M, 32C and 32K) according to Embodiment 1 except a type of stored toners and a color identification projection member (32Y1*e* (refer to FIG. 15, etc)). Therefore, hereinafter, a configuration of a toner container 32DY of yellow only is described, and description of other configurations is omitted. FIG. 33 is an illustrative view similar with FIG. 25 for explaining a configuration of a toner loading part 40D of the toner container 32DY according to Embodiment 4.

The toner loading part 40D of the toner container 32DY according to Embodiment 4 is disposed in the gripping part 32Y1*c* as shown in FIG. 33 and includes an insertion hole 41D, a toner loading port 42D and a cap 43D. The insertion hole 41D has a hole-like shape following an external shape of the gripping part 32Y1*c*. The insertion hole 41D has a cylindrical shape configured to increase a diameter thereof, in the gripping part 32Y1*c*, toward a rear end side (front side in a mounting direction (left side as viewed from front side of FIG. 33) of the toner container 32DY. According to Embodiment 4, the insertion hole 41D has a columnar shape on the side of a container main body 32Y2 (right side as viewed from front side of FIG. 33) extending with a same diameter, and a curved columnar shape on a rear end side of the toner container 32DY with a change ratio of a diameter varying with respect to the axial direction. At the insertion hole 41D, a plurality of ribs 41*b* are disposed at an opening edge part 41*a*.

The ribs 41*b* are formed by being protruded inward from the opening edge part 41*a*, and restrict, in the insertion hole 41D, mount surfaces 41*c* which are surfaces orthogonal to an axial line thereof. The mount surfaces 41*c* are positioned on the same plane orthogonal to the axial line of the insertion hole 41D. According to Embodiment 4, fours ribs 41*b* are disposed at intervals equal to each other as viewed around the axial line of the opening edge part 41*a* (insertion hole 41D). Further, according to Embodiment 4, ribs 41*b* are set to be located at a position outer (outside in a diameter direction with the axial line as a center) than a columnar portion on the side of the container main frame 32Y2 (right side as viewed from front side of FIG. 33) in the insertion hole 41D, as viewed in the axial direction of the insertion hole 41D. The insertion hole 41D is continuous to the toner loading port 42D.

The toner loading port 42D has a columnar shape with an opening area orthogonal to the axial line formed smaller than the insertion hole 41D, with one end thereof continuous to the toner loading port 42, and the other end thereof continuous to an inner space of the toner container 32Y (container main body 32Y2 thereof). The cap 43D is fitted into the toner loading port 42.

The cap 43D is a disc-shaped member of a size which can be inserted into the insertion hole 41D. The cap 43D includes an insertion part 43Da and a flange part 43Dd. The insertion part 43Da has a columnar shape which can be fitted into the toner loading port 42D and seals the toner loading port 42D by being fitted into the toner loading port 42D. According to Embodiment 4, the toner loading port 42D and the insertion part 43Da have a columnar shape with a circular opening orthogonal to the axial line. However, the other shape (for example, a square or octagonal shape orthogonal to the axial line) may be used as far as the toner loading port 42D can be sealed by fitting to each other, and therefore, the shape is not limited to Embodiment 1.

The flange part 43Dd has a plate-like shape extended in a direction orthogonal to an axial line of the insertion part 43Da. The flange part 43Dd has a size which can be abutted to an engagement end face 44D formed between the insertion hole 41D and the toner loading port due to a difference in the diameter from each other. A shielding member 45 is disposed to shield the cap 43D. The cap 43D has a size which ensures that the flange 43Dd is not protruded out from the insertion hole 41D in a state where the insertion part 43Da is fitted into the toner loading port 42D and the flange part 43Dd is engaged to the engagement end face 44D. In other words, depth of the insertion hole 41D (length viewed in an extending direction) is not less than a thickness of the flange part 43Dd in the cap 43D. Thus, in the cap 43D, the flange part 43Dd is continuous to the insertion part 43Da, and the insertion part 43Da sealing the toner loading port 42D becomes a head part extended from the toner loading port 42D.

The shielding member 45 is disposed in contact with mount surfaces 41*c* of four ribs 41*b* disposed at the opening edge 41*a* of the insertion hole 41D. The shielding member 45 is capable of shielding the opening edge part 41*a* of the insertion hole 41D and has a thin film-like shape and a size which can be abutted to respective mount surfaces 41*c*. According to Embodiment 4, the shielding member 45 is a label seal indicating a color (yellow) or the like of the toner stored in the toner container 32DY and can cover across the opening edge part 41*a* of the insertion hole 41D by being adhered to respective mount surfaces 41*c*.

In the toner loading part 40D, the toner is loaded (stored) into the toner container 32DY (its container main body 32Y2) through the insertion hole 41D and the toner loading port 42D. Thereafter, the cap 43D is inserted through the insertion hole 41D, the insertion part 43Da is fitted into the toner loading port 42D with a fitting (not shown) or an operator's finger, and the flange part 43Dd is engaged to the engagement end face 44D to seal the toner loading port 42D. The fitting may be of a type which is capable of holding the cap 43D and shifting the held cap 43D in the insertion hole 41D. Thereafter, a label seal, which is the shielding member 45 is adhered to respective mount surfaces 41*c* at the opening edge part 41*a* of the insertion hole 41D so as to cover across the opening edge part 41*a* of the insertion hole 41D. Further, in the toner container 32DY, cleaning and re-loading of the toner can be performed in the recycling process by peeling off the shielding member 45 (label seal) and then removing the cap 43D from the toner loading port 42D.

Toner containers (32DY, 32DM, 32DC and 32DK) according to Embodiment 4 is basically capable of providing similar effects as Embodiment 1 since the configuration thereof is basically same as toner containers (32Y, 32M, 32C and 32K) according to Embodiment 1.

In addition to the above effect, in toner containers (32DY, 32DM, 32DC and 32DK) according to Embodiment 4, the opening edge part 41*a* of the insertion hole 41D is shielded by the shielding member 45 (label seal) in the toner loading port 40D, whereby user's awareness of the existence of the cap 43D can be prevented and thereby an erroneous opening of the toner loading port 42D can be prevented effectively.

Further, in toner containers (32DY, 32DM, 32DC and 32DK) according to Embodiment 4, the opening edge part 41*a* of the insertion hole 41D is shielded by the shielding member 45 (label seal) in the toner loading part 40D, whereby user's touch to the cap 43D can be prevented and thereby an erroneous opening of the toner loading port 42D can be prevented effectively.

Further, in toner containers (32DY, 32DM, 32DC and 32DK) according to Embodiment 4, a label seal is used as the shielding member 45 shielding the opening edge part 41*a* of the insertion hole 41D, whereby user's uncomfortable feeling about the shielding member 45 can be suppressed and thereby appearance can be enhanced and erroneous opening of the toner loading port 42D can be prevented effectively.

In toner containers (32DY, 32DM, 32DC and 32DK) according to Embodiment 4, erroneous detachment of the cap 43D is prevented by shielding the opening edge part 41*a* of the insertion hole 41D with the shielding member 45, whereby freedom degree of setting a size of the insertion hole 41D (diameter thereof) can be enhanced. Thus, a size of the insertion hole (its diameter) can be made larger and, in turn, a size of the toner loading port 42D (its diameter) disposed on the inner wall thereof also can be made larger, whereby efficiency of toner loading operation can be improved.

In toner containers (32DY, 32DM, 32DC and 32DK) according to Embodiment 4, ribs 41*b* restricting the mount surfaces 41*c* for adhering the shielding member 45 is set to locate at a position outer than a portion of the insertion hole 41D having a columnar shape on the side of the container main body 32Y2, whereby when the cap 43D is inserted into the insertion hole 41D, interference of the cap 43D with ribs 41*b* can be prevented and thereby fitting of the cap 43D (insertion part 43Da thereof) into the toner loading port 42D can be made smoothly.

Accordingly, the toner containers (32DY, 32DM, 32DC and 32DK) as a powder storage container according to Embodiment 4 of the present invention can prevent erroneous opening of the toner loading port 42 as the powder loading port can be prevented.

In toner containers (32DY, 32DM, 32DC, 32DK) according to Embodiment 4, four ribs 41*b* are disposed at the opening edge part 41*a* of the insertion hole 41D. The number and shape thereof may be set in an appropriate manner as far as flat mount surfaces 41 are defined on the same plane orthogonal to the axial line of the insertion hole 41D for disposing the shielding member 45 at the opening edge part 41*a*, or a single rib having a circular shape may be used. Therefore, the rib is not limited to Embodiment 4. Here, the rib of any type is preferably set to a position outer than a portion of the insertion hole 41D having a columnar shape on the side of the container main body 32Y2 so as to enable smooth fitting of the cap 43D (insertion part 43Da thereof) into the toner loading port 42D.

Further, in toner containers (32Dy, 32DM, 32DC and 32DK) according to Embodiment 4, a label seal is used as the shielding member 45. However, the label seal is not limited to Embodiment 4, and may be of a type which can be adhered to the mount surfaces 41*c* restricted by ribs disposed at the opening edge part 41*a* for shielding the opening edge part 41*a* of the insertion hole 41D.

Further, in toner containers (32DY, 32DM, 32DC and 32DK) according to Embodiment 4, the opening edge part 41*a* at the insertion hole 41D has a circular opening shape. However, the shape may be of the other type (for example, a square shape, an octagonal shape or the like) as far as it allows insertion of the cap 43D so as to enable fitting of the insertion part 43Da into the toner loading port 42D, and therefore is not limited to Embodiment 4.

In toner containers (32DY, 32DM, 32DC and 32DK) according to Embodiment 4, the insertion part 43Da and the toner loading port 42D are configured in such a manner that the insertion part 43Da of the cap 43D is fitted into the toner loading port 42D. However, the insertion port 43Da and the toner loading port 42D may be configured so as to be screwed with each other with threaded grooves provided on each wall thereof as far as the toner loading port 42D can be sealed by inserting the insertion port 43Da into the toner loading port 42D, and therefore the configuration is not limited to Embodiment 4.

The embodiments described above refer to the toner container as a powder storage container according to the present invention. However, the powder container storage is not limited to the above embodiments, as far as a powder storage container includes a powder storage part configured to store a developer used for image forming, a powder discharge part disposed at a one end part of the powder storage part to discharge the developer stored in the powder storage part, a gripping part configured to protrude through an end face of the one end part of the powder storage part, powder loading port configured to communicate an inner space and outer side of the powder storage part with each other, and a sealing part capable of sealing the powder loading port, and the powder loading port is enclosed by the gripping part.

In the embodiments described above, a coil-shaped conveyance member 33 is disposed in the toner container (32Y, etc.). The configuration is not limited to the above embodiments. If a toner stored in the container main body 32Y2 can be conveyed toward the toner discharge port 32Y1*a* in a longitudinal direction by rotating, for example, configuration (although not shown) in which a plurality of stirring blades are disposed on the rotary shaft fixed to the drive input part 34 may be used.

Further, although in Embodiments 1 to 3 described above, the toner loading part (40, 40B, 40C) comprises the insertion hole (41, etc.), the toner loading port (42, etc.) and the cap (43, etc.), the shielding member 45 (label seal) according to Embodiment 4 may be disposed on a protruded end face 32Y1*w* of the gripping part 32Y1*c*. Therefore, the configuration of the toner loading part is not limited to the first to Embodiment 3 described above. In this case, an opening edge part of the insertion hole (41, etc.) is shielded by the shielding member (label seal), whereby user's awareness of the existence of the cap (43, etc.) can be prevented and thereby erroneous opening of the toner loading port (42, etc.) can be prevented effectively.

In the embodiments described above, an example of the image forming apparatus 100 applied to an image forming apparatus (100, etc.) as a color printer is shown. However, the image forming apparatus 100 may be applied as an image forming apparatus for forming a monochromatic image, and therefore is not limited to the embodiments described above.

In the embodiments described above, an example of using a two-component developer comprising a carrier and a toner is shown. However, a one-component developer comprising a toner only may be used, and therefore the developer is not limited to the embodiments described above. That is, the powder storage container may store, as a powder used for image forming, a toner, a carrier adhering the toner in an electrostatic manner, or a mixture of the carrier and the toner at a predetermined ratio (that is, a pre-mixed toner). In either cases, similar effects as the prevent invention described above can be obtained.

Imaging parts 3Y, 3M, 3C, 3K disposed in the embodiments described above may be substituted by a process cartridge formed by integrating a part or a whole thereof into photosensitive drums 1Y, 1M, 1C, 1K. Therefore, the imaging parts are not limited to the embodiments described above.

Although an image forming apparatus according to the present invention is described above based on respective embodiments, a specific configuration thereof is not limited to the embodiments, and any modification, addition or the like of the design may be allowed without departing from the spirit of the present invention. Further, the number, location, shape or the like of component members described above are not limited to the embodiments, but a number, location, shape or the like, which is favorable in implementing the present invention, may be selected.

Embodiment 5

Schematic Configuration of Toner Container 32Y

A schematic configuration of the toner container 32Y is described with reference to FIG. 34. The toner container 32Y includes a container main body 32Y2 and a conveyance member 33. The container main body 32Y2 schematically includes a cylindrically-shaped cylindrical body 32Y2', a first cap member 140 as a bottle cap thereof, and a second cap member 134 as a bottle cap.

The cylindrical body 32Y2' is a component for comprising the container main body 32Y2 which stores a developer therein and is mounted to or removed from a main body of the image forming apparatus. The cylindrical body 32Y2' includes opening parts 32Y2*a*' and 32Y2*b*' at both ends thereof (refer to FIG. 37). The cylindrical body 32Y2' is described in detail later.

The first cap member 140 includes at least a discharge part configured to discharge a developer from inside of the container main body 32Y2 toward the main body of the image forming apparatus, and a cap part configured to seal an opening part 32Y2*a*' on the one end side. The first cap member 140 is a component mounted on the one end side of the cylindrical body 32Y2' for comprising the container main body 32Y2 in cooperation with the second cap member 134 and the cylindrical body 32Y2. The first cap member 140 is also described in detail later.

The conveyance member 33 includes at least conveyance blades and is disposed in the cylindrical body 32Y2' so as to extend from an opening part 32Y2*a*' on the one end side thereof toward an opening part 32Y2*b*' on the other end side. By rotating with respect to the cylindrical body 32Y2', the conveyance member 33 conveys the developer from the opening part 32Y2*b*' on the other end side toward the opening part 32Y2*a*' on the one end side while stirring the developer. A detailed configuration of the conveyance member 33 is also described later.

The second cap member 134 includes at least a driven coupling for transmitting a rotational drive force from the main body of the image forming apparatus to the conveyance member 33 and a lid part which seals the sealing part 32Y2*b*' on the other end side. The second cap member 134 is a component mounted on the opening part 32Y2*b*' at the other end side in a rotatable manner and forms the container main body 32Y2 in cooperation with the cylindrical body 32Y2' and the first cap member 140. A detailed configuration of the second cap member is also described later.

Figure 37:
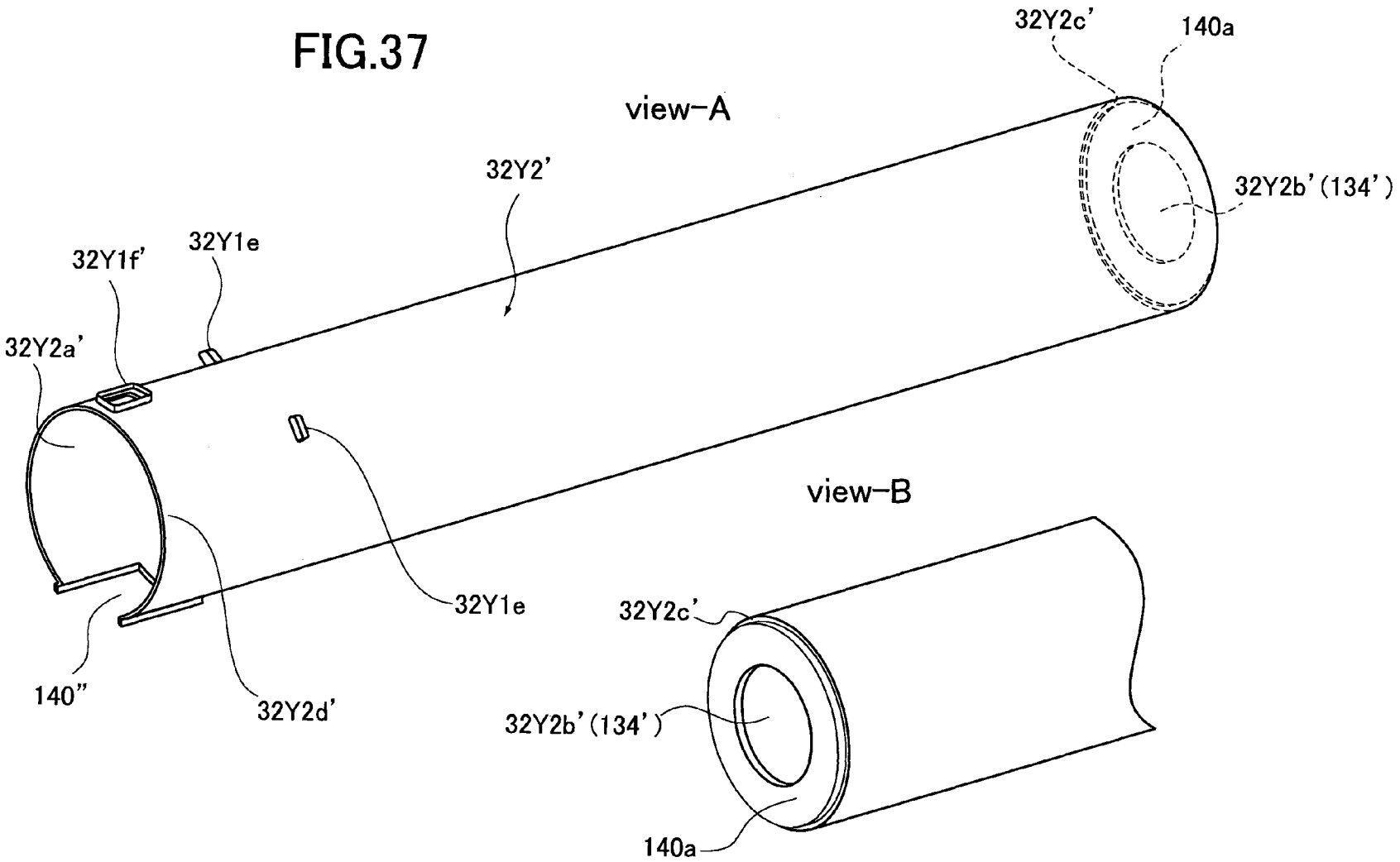
FIG. 37 is a perspective view showing an appearance of a cylindrical body as a component for comprising the container main body shown in FIG. 3, in which view-A is a perspective view showing its overall configuration, and view-B is a partial perspective view showing a state of the cylindrical body viewed from the other end side.

The opening part 32Y2*b*' on the other end side of the cylindrical body 32Y2' is the powder loading port 134' as shown in FIG. 37. The powder loading port 134' is provided to load the developer into the container main body 32Y2. The second cap member 134 is formed on the other end side of the conveying part 33 integrally or separately therefrom to seal the powder loading port 134'. Here, the second cap member is configured separately from the conveyance member 33.

The second cap member 134 includes a coupled projection part 134" which couples the conveyance member 33 and the image forming apparatus 100 to each other in such a manner that the conveyance member 33 is rotated with respect to the container main body 32Y2 by a rotational drive force from the image forming apparatus 100. The coupled projection part 134' forms a part of the driven coupling.

When the container main body 32Y2 is mounted to the image forming apparatus 100, the coupled projection part 134" is coupled to a rotational drive mechanism (refer to FIG. 5) as a drive coupling 91 existing in an inner part of the image forming apparatus 100 to convey a rotational force to the conveyance member 33. Here, the other end side of the container main body 32Y2 is defined as a bottom side or an inner side of the image forming apparatus 100, and the one end side of the container main body 32Y2 is defined as a front side of the image forming apparatus 100.

With this configuration, the conveyance member receives a drive force from the drive coupling 91 of the image forming apparatus 100 and thereby rotates in a predetermined direction to convey the toner stored in the cylindrical container main body 32Y2 in a longitudinal direction from the other end side toward the one end side. That is, in FIG. 34, the toner is conveyed from the bottom side or the inner side (right side) toward the front side (left side).

Accordingly, the toner is discharged through the toner discharge port 32Y1*a* of the toner container 32Y toward the nozzle tube 72. A detailed configuration and function of other components of the toner container 32Y is also described in detail later.

[Detailed Configuration of Toner Container 32Y]

As described with reference to FIG. 34, the toner container 34Y includes the container main body 32Y2 and the conveyance member 33. Hereinafter, a detailed configuration of the container main body 32Y2 and the conveyance member 33 is described with reference to the drawings.

[Detailed Configuration of Cylindrical Container Main Body 32Y2]

As described above, the container main body 32Y2 includes the cylindrical body 32Y2', the first cap member 140 as a bottle cap, and the second cap member 134 as a bottle cap.

[Detailed Configuration of Cylindrical Body 32Y2']

FIG. 37 is a perspective view showing the cylindrical body 32Y2'. On a configuration wall 32Y2*c*' forming the opening part 32Y2*b*' at the other end side of the cylindrical body 32Y2', a ring-shaped sealing member 140*a* is sealed so as to enclose the powder loading port 134' as shown in view-B of FIG. 37. The ring-shaped sealing member 140*a* is made of boron, felt or the like.

On the configuration wall 32Y2*d*' of the opening part 32Y2*a*' at the one end side of the cylindrical body 32Y2', a mount wall 32Y1*f* for mounting an electronic substrate 32Y1*f* on an upper side thereof is provided as shown in view-A of FIG. 37. The opening part 32Y2*a*' on the one end side of the cylindrical body 32Y2' serves as an opening for mounting the first cap member 140.

On the configuration wall 32Y2*d*' of the opening part 32Y2*a*' of the cylindrical body 32Y2', a cutout 140" for mounting the first cap member 140 is provided. The projection part 32Y1*e* described above is provided in a vicinity of the configuration wall 32Y2*d*' of the opening part 32Y2*a*' at the one end side of the cylindrical body 32Y2'. The mounting cutout 140" is configured by extending from an end face of the configuration wall 32Y2*d*' of the opening in a longitudinal direction of the cylindrical body 32Y2'.

The cylindrical body 32Y2' is preferably made of a high density polyethylene from the view point of the direct blow moldability, more specifically, drawdown resistance and impact resistance. Among high density polyethylenes, a polyethylene having MFR of 0.05 to 2.0 g/10 min (JIS K7210) and a density of 0.950 to 0.960/m3 (JIS K7112) is preferable from the view point of the drawdown resistance, impact resistance and stress cracking resistance.

From the view point of the fitting of the conveying part 33, the cylindrical body 32Y2' may be molded by injection molding. In this case, polypropylene is preferable from the view point of impact resistance, cold impact resistance, rigidity and moldability in the injection molding.

Among polypropylenes, elastomer blended polypropylene or block copolymer polypropylene is preferable. The elastomer blended polypropylene and the block copolymer polypropylene preferably have MFR of 5.0 to 50.0 g/10 min (JIS K7210) and a density of 0.900 to 0.910 kg/m3 (JIS K7112) from the view point of the moldability, impact resistance, and rigidity.

The elastomer blended polypropylene is a crystalline polypropylene being a single polymer of propylene mixed with an elastomer which is α-olefin and polypropylene copolymer.

The α-olefin includes ethylene, 1-butene, isobutene, 1-pentene, 2-methy-1-butene, 3-methyl-1-butene, 1-hexene, 2-methyl-1-pentene, 3-methyl-a-pentene, 4-methyl-1-pentene, 1-octen, 1-nonen, 1-decene, 1-undecene, 1-dodecene, and the like.

In view of balancing the impact resistance and rigidity, it is preferable to compound 10 to 60 parts of α-olefin and polypropylene copolymer by weight per 100 parts by the crystalline polypropylene. From the view point of the rigidity and heat resistance, the crystalline polypropylene has preferably an isotactic pentad ratio of not less than 0.97.

The block copolymer polypropylene is a composition comprising the crystalline polypropylene which is a monomer of polypropylene and an elastomer of ethylene and polypropylene copolymer, produced in a multi-step polymerization process.

The multi-step polymerization process is a process using a known Ziegler-Natta catalyst and metallocene catalyst, in which a polypropylene homopolymer is polymerized at a first step and ethylene and polypropylene are copolymerized and dispersed in a reactor at a second step. In this case, the crystalline polypropylene also preferably has the isotactic pentad ratio of not less than 0.97 from the view point of the rigidity and heat resistance.

Further, ethylene and propylene copolymer has 10 to 60 parts by weight per 100 parts by weight of crystalline polypropylene in order to balance impact resistance and rigidity. Ethylene and propylene copolymer elastomer preferably contains 40 to 60 weight % of a component derived from ethylene from the view point of impact resistance.

Further, from the view point of fitting improvement, heat resistance, linear expansion resistance and moldability improvement of injection molding, it is preferable to mix talc to elastomer blended polypropylene or block copolymer polypropylene.

The talc preferably has a mean grain diameter of 5 μm to not more than 2 μm in order to improve impact resistance of the container main body 32Y2. More preferably, the talc is a microparticle talc having a mean grain diameter of not more than 2 μm, and its content having a grain diameter of not less than 4 μm is a microparticle talc of not more than 4 weight %.

Compound ratio of the talc is preferably 3 to 20 parts by weight per 100 parts by weight of elastomer blended polypropylene or block copolymer polypropylene from the view point of the fitting improvement, linear expansion resistance and impact resistance. In particular, a material having a good linear expansion resistance suppresses expansion of the toner main body 32Y2 when the toner container 32Y is exposed to high temperature, and thereby ensures the fitting accuracy with respect to the conveyance member 33.

[Configuration of First Cap Member 140]

Figure 38:
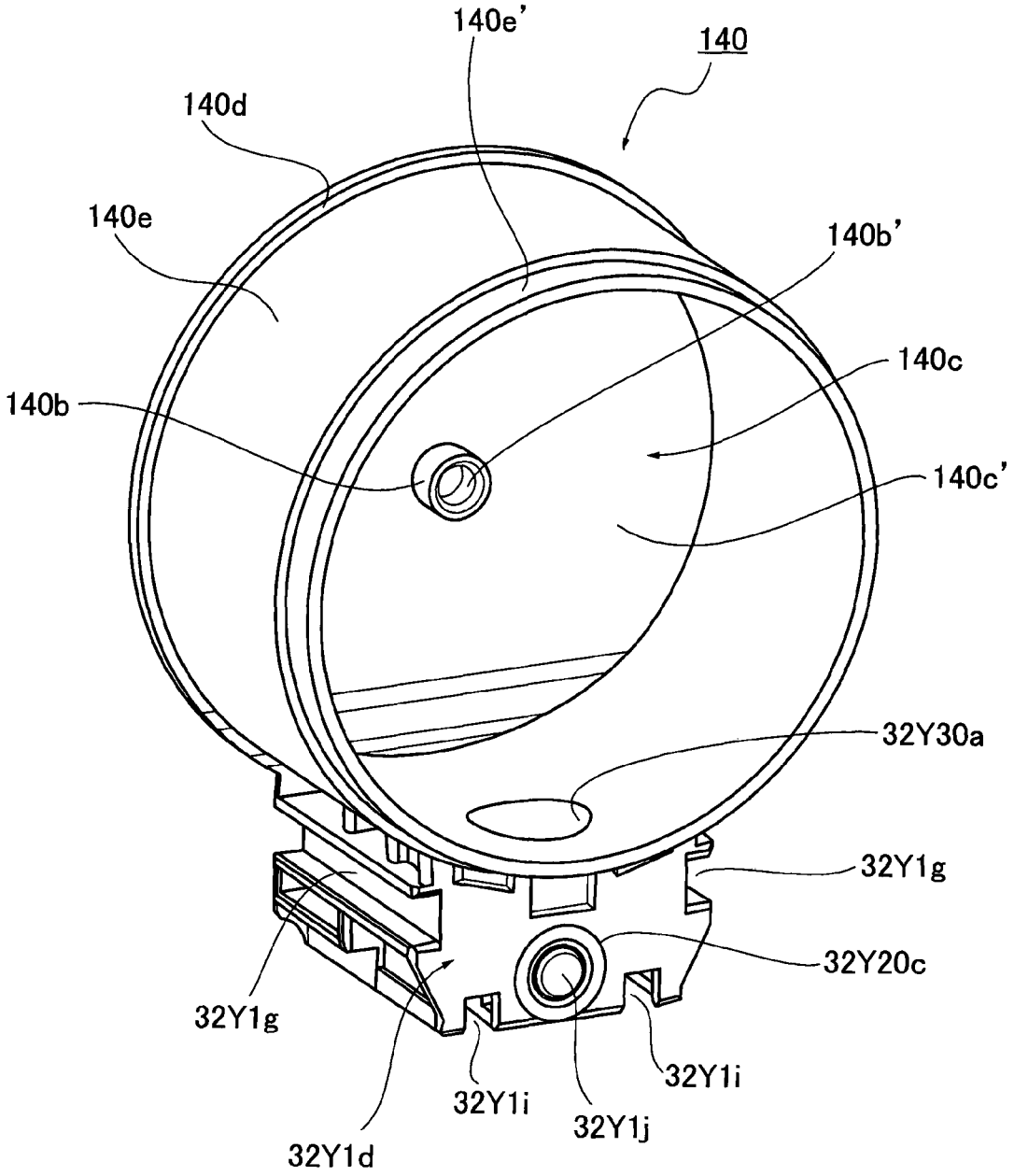
FIG. 38 is a perspective view showing a first cap element as a component for comprising the cylindrical container main body shown in FIG. 3.
Figure 39:
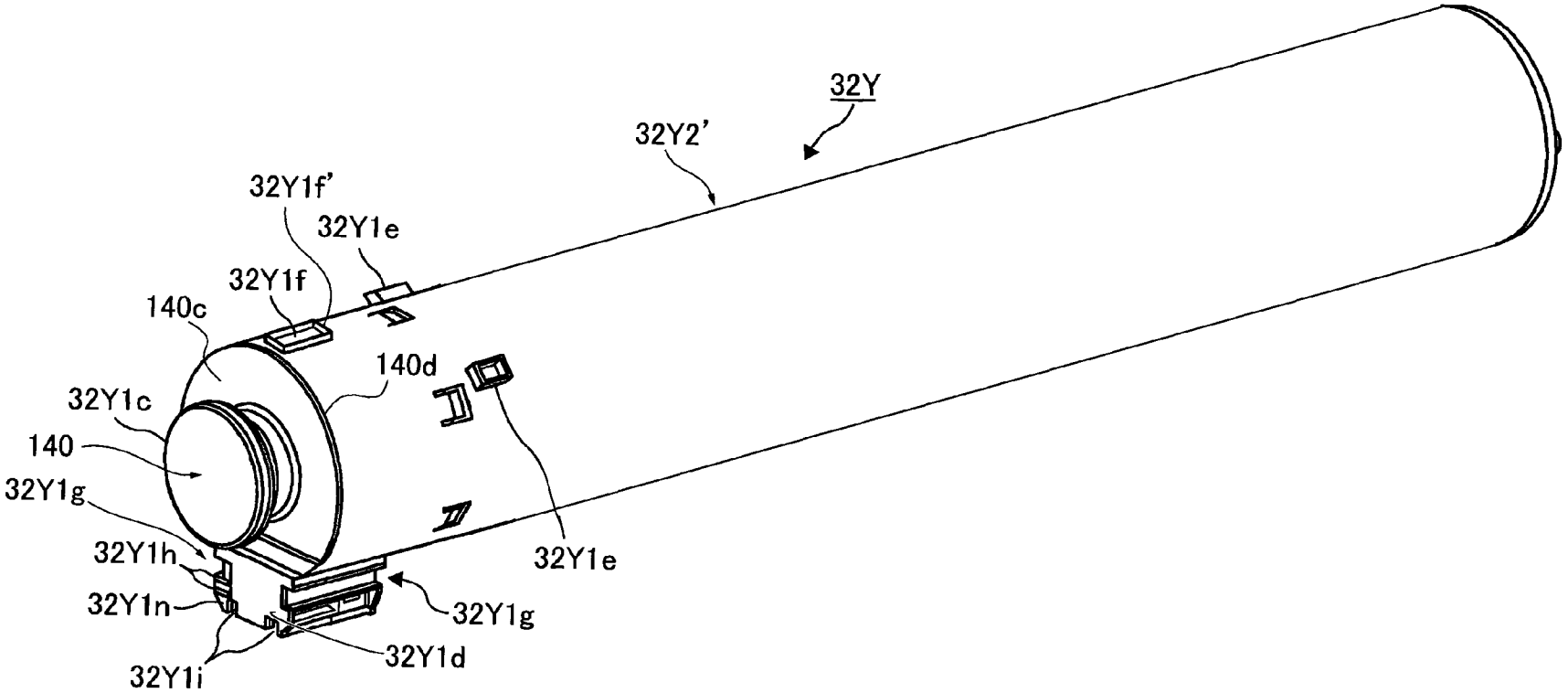
FIG. 39 is a perspective view showing an appearance of the toner container viewed from a different angle.

As shown in FIG. 38, the first cap member 140 includes a toner discharge part 32Y1*d* and a rotary shaft support tube 140*b* having a circular hole 140', a lid part 140*c*', and a gripping part 32Y1*c* shown in FIG. 39. The gripping part 32Y1*c* is integrated into the lid part 140 on a side opposite to the rotary shaft support tube 140*b*', as shown in FIG. 34, etc.

Figure 43:
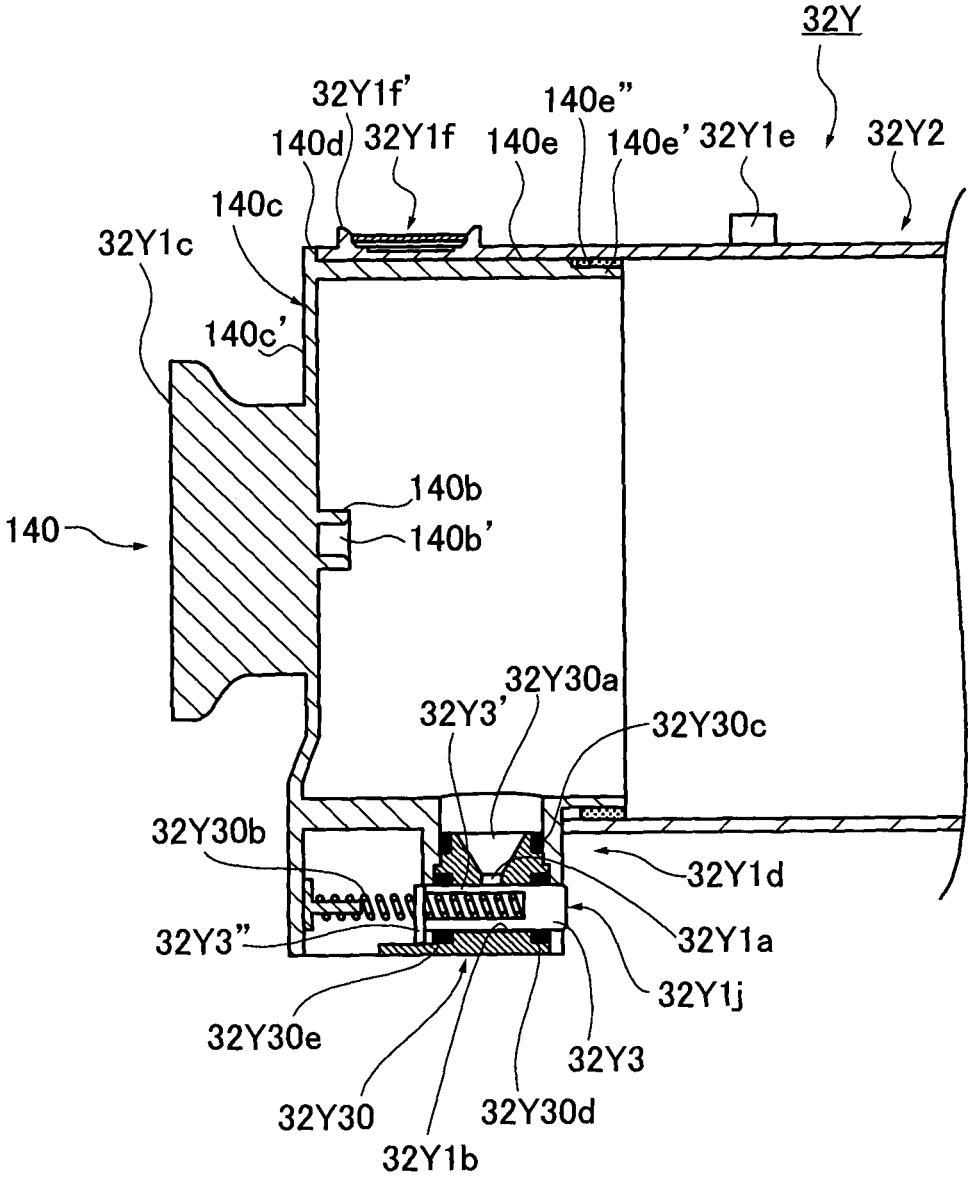
FIG. 43 is a partial cross-sectional view showing a state when the first cap element and the opening at the one end side of the cylindrical body are fitted to each other.
Figure 44:
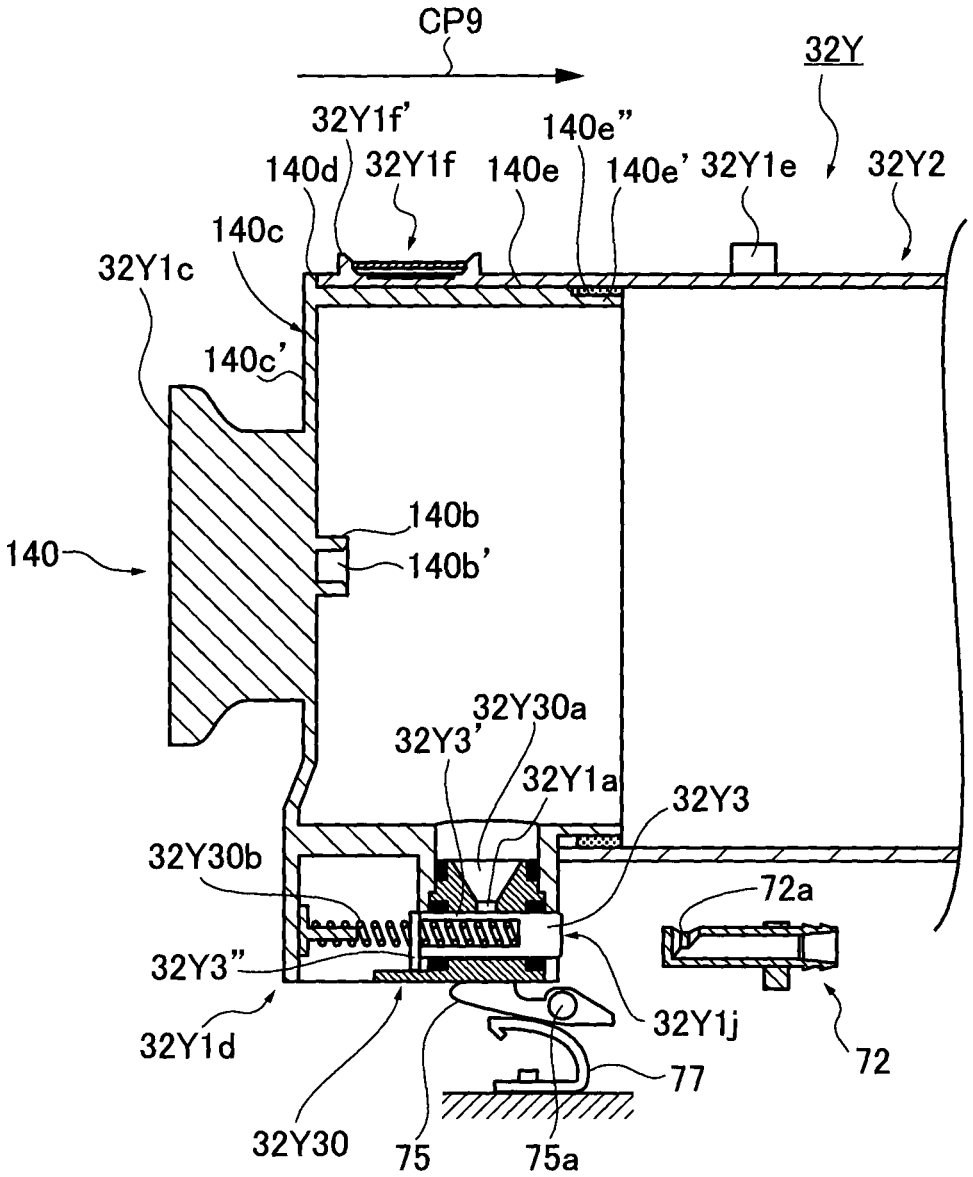
FIG. 44 is a partial cross-sectional view showing a state when the toner container is inserted into the toner container storage part.
Figure 45:
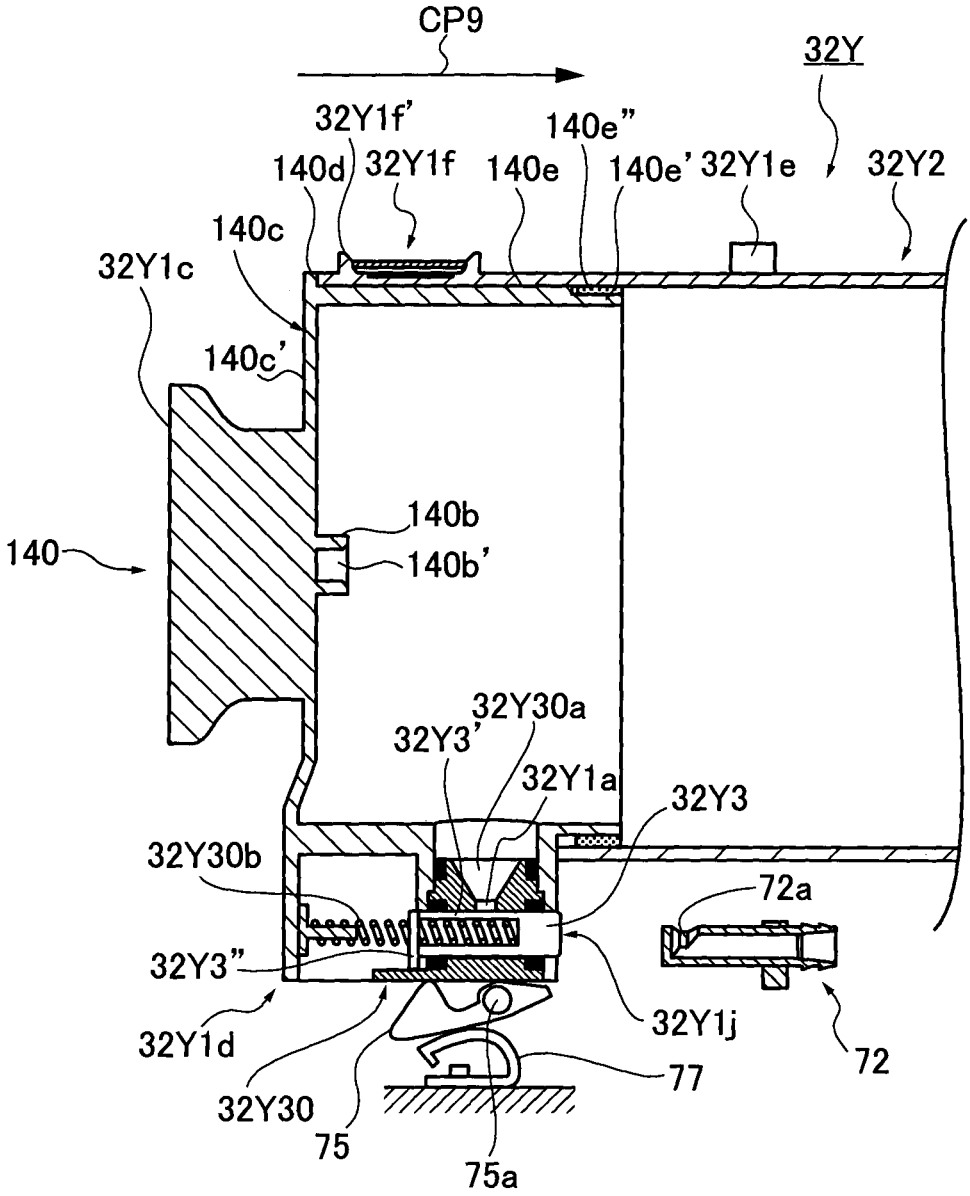
FIG. 45 is a cross-sectional view showing a state following FIG. 22 when the toner container is inserted.
Figure 46:
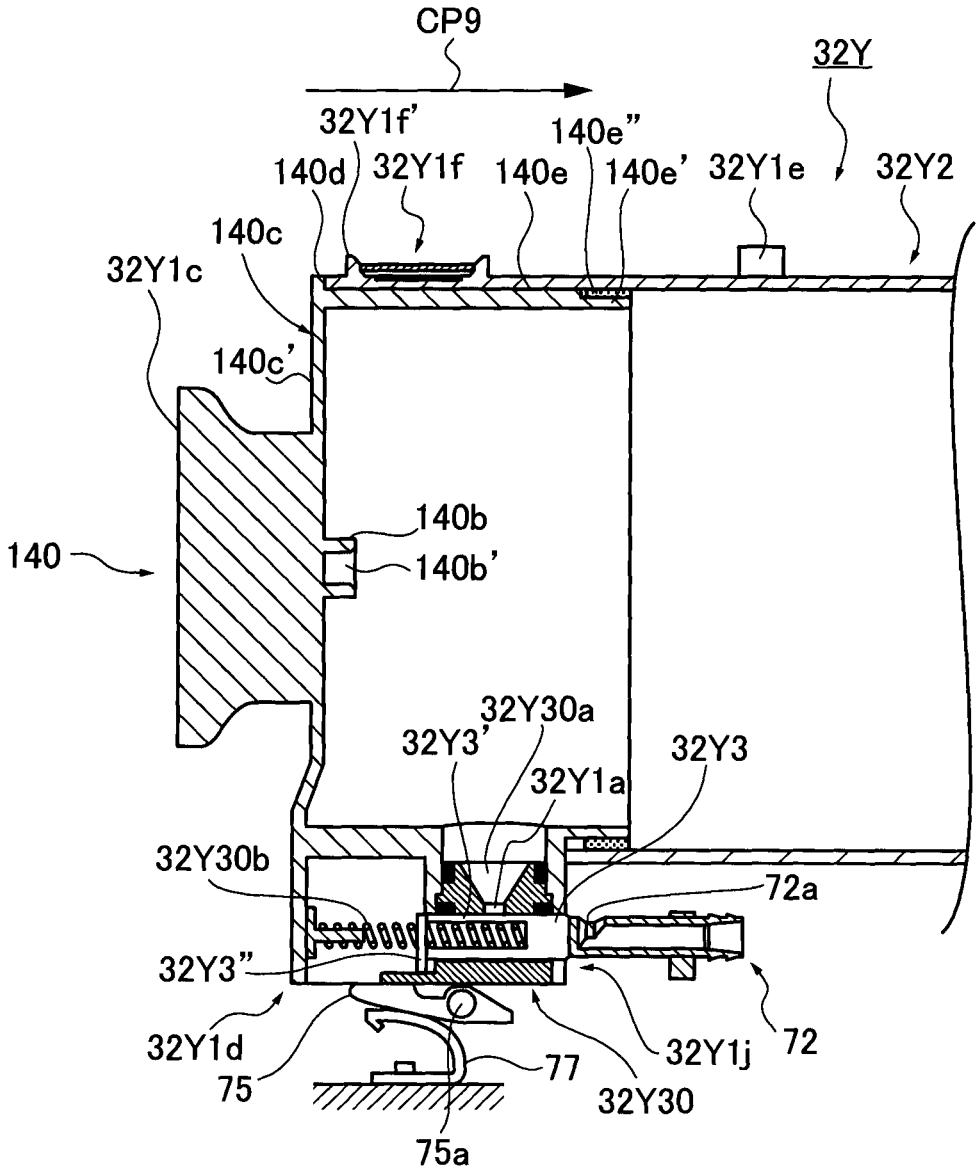
FIG. 46 is a cross-sectional view showing a state when a nozzle shown in FIG. 22 comes into contact with a cylindrical part of a plug member.
Figure 47:
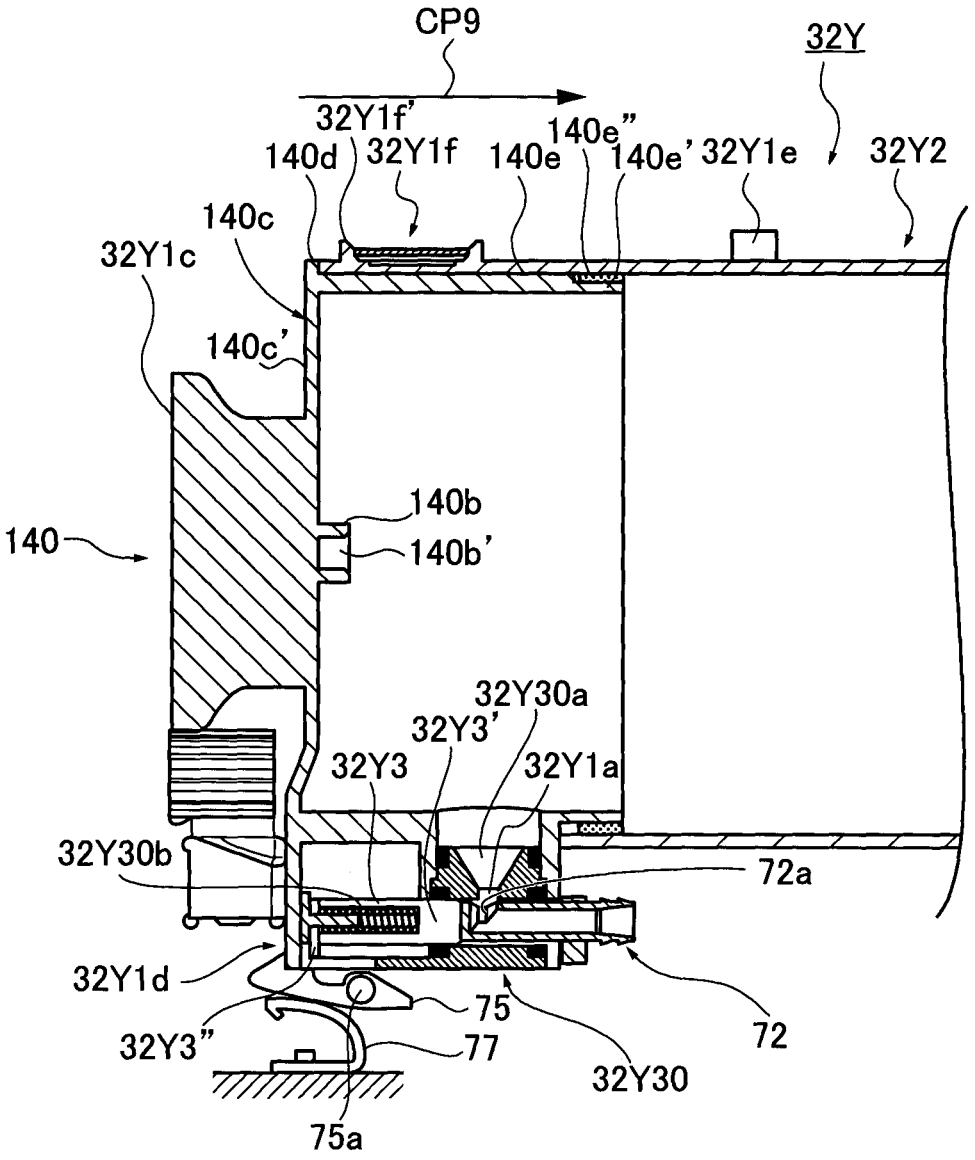
FIG. 47 is a cross-sectional view showing a state when the toner container is mounted to the toner container storage part.

The lid part 140*c* includes an annular flange part 140*d* and a fitting tube 140*e*. The toner discharge part 32Y1*d* is provided with a nozzle insertion part 32Y30 shown in FIG. 40. The fitting tube 140*e* has a small-diameter cylindrical part 140*e*' at a leading end thereof. An annular sealing member 140*e*" shown in FIG. 43 is mounted to the small-diameter cylindrical part 140*e*'. The annular sealing member 140*e*" is configured so as to come into contact with an inner peripheral surface of the configuration wall 140" when the first cap member 140 is mounted to an opening part 32Y2*a*'.

The rotary shaft support tube 140*b* is disposed at a lid plate part 140*c*' of the lid part 140*c* thereof in a direction protruding along the axis of the cylindrical body 32Y2'. The first cap member 140 is mounted to an opening part 32Y2*a*' of the cylindrical body 32Y2' in such a manner that the opening part 32Y2*a*' is sealed by an action of the annular sealing member 140*e*", when the fitting tube 140*e* of the lid part 140*c* is fitted into the configuration wall 32Y2*d*' of the opening part 32Y2' at the one end side of the cylindrical body 32Y2', the toner discharge part 32Y1*d* is inserted into the mounting cutout 40", and the annular flange part 140*d* is brought into contact with an end face of the configuration wall 32Y2*d*' of the opening part 32Y2*a*' at the one end side.

Figure 40:
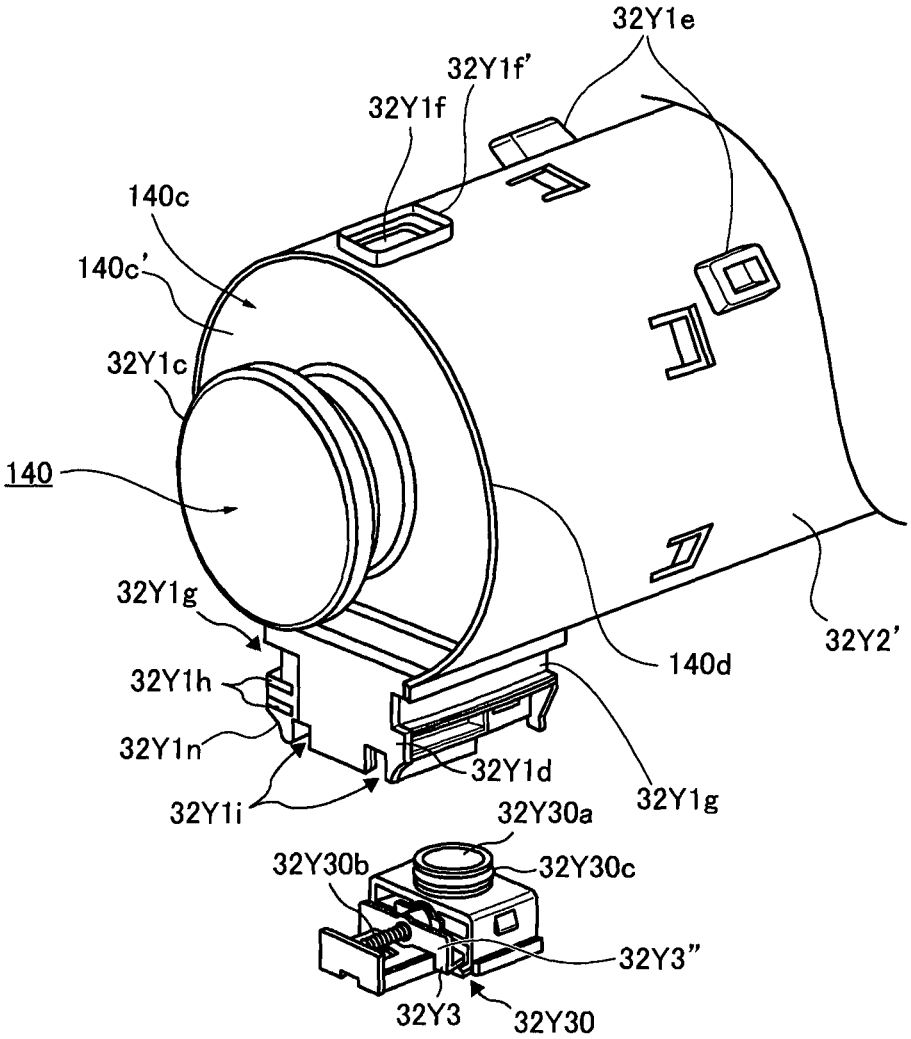
FIG. 40 is a partial detailed perspective view showing an appearance of a first cap element mounted to an opening at one end side of the container main body, a vicinity of an opening at one end side of the cylindrical body, and a nozzle insertion part fitted to a toner discharge port of the first cap element.

With this configuration according to the present embodiment, the opening part 32Y2*a*' at the one end side of the cylindrical body 32Y2' is sealed in such manner as to prevent toner leakage from the first cap member 140. The nozzle insertion part 32Y30 includes the toner discharge port 32Y1*a* (refer to FIG. 34) mentioned above. A first groove part 32Y1*g* is provided on both side faces of the toner discharge part 32Y1*d* as shown in FIG. 38 to FIG. 40.

Figure 42:
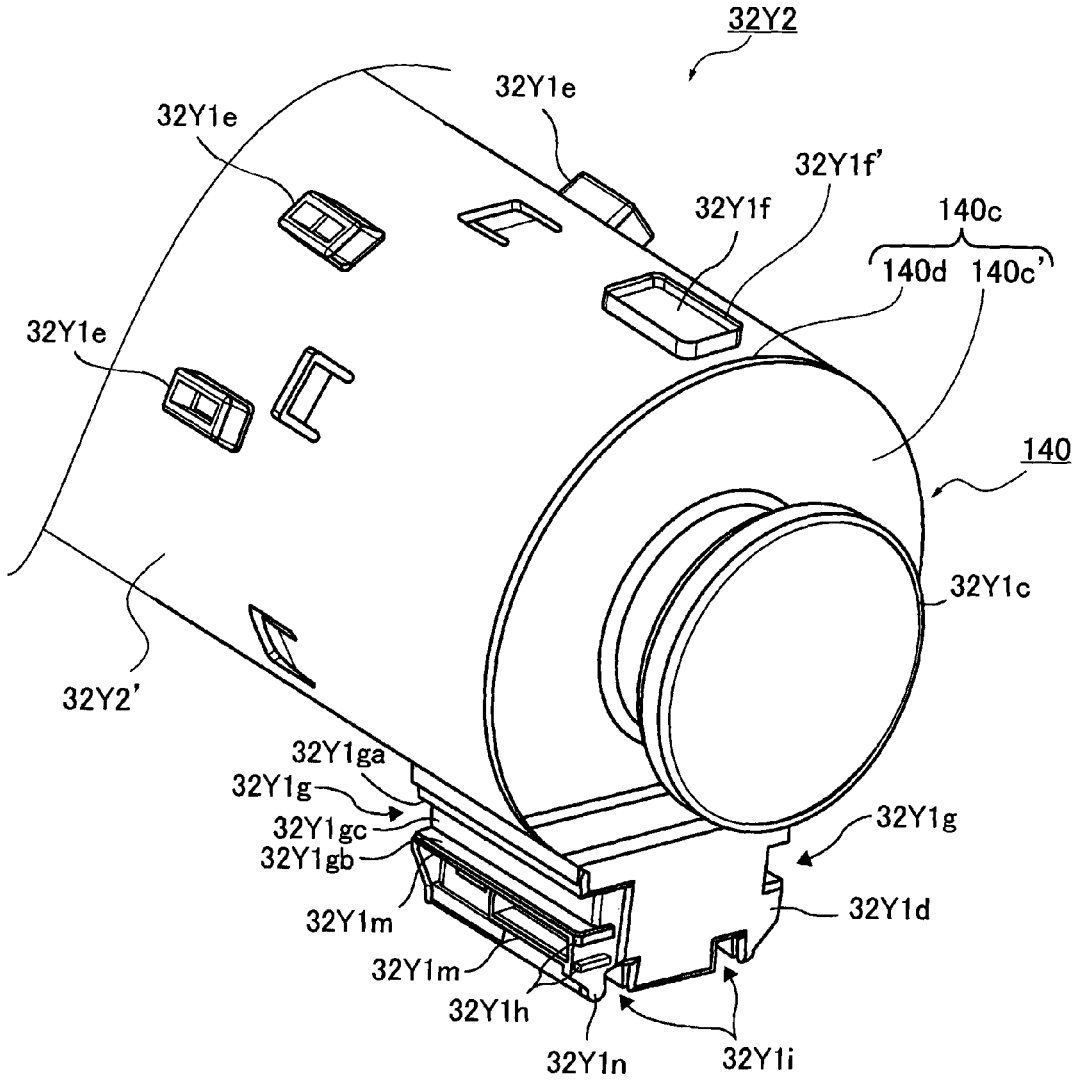
FIG. 42 is a partially enlarged perspective view showing a state when the first cap element is mounted to the opening at one end side of the cylindrical body.

The first groove part 34Y1*g* is configured so as to allow the engagement of a positioning member 78 (refer to FIG. 8) of the toner container storage part 31 thereto. In the first groove part 32Y1*g*, two horizontal surfaces 32Y1*ga* and 32Y1*gb* facing to each other and a vertical surface 32Y1*gc* disposed between the two horizontal surfaces 32Y1*ga* and 32Y1*gb* are provided as shown in FIG. 42.

The horizontal surfaces 32Y1*ga* and 32Y1*gb* and the vertical surface 32Y1*gc* extend in a direction where the toner container 32Y is mounted to or removed from the image forming apparatus 100. Since the first groove part 32Y1*g* is engaged into the positioning member 78, the toner container 32Y is held so as not to rotate with respect to the toner container holding part 70 of the toner container storage part 31 even when the conveyance member 33 rotates.

[Supplementary Description of Gripping Part 32Y1*c*]

The gripping part 32Y1*c* is disposed by protruding in the mounting and removing direction from the container main body 32Y2. The gripping part 32Y1*c* is used at such a time when the user replaces (mounts or removes) the toner container 32Y. This facilitates handling of the toner container 32Y.

Figure 41:
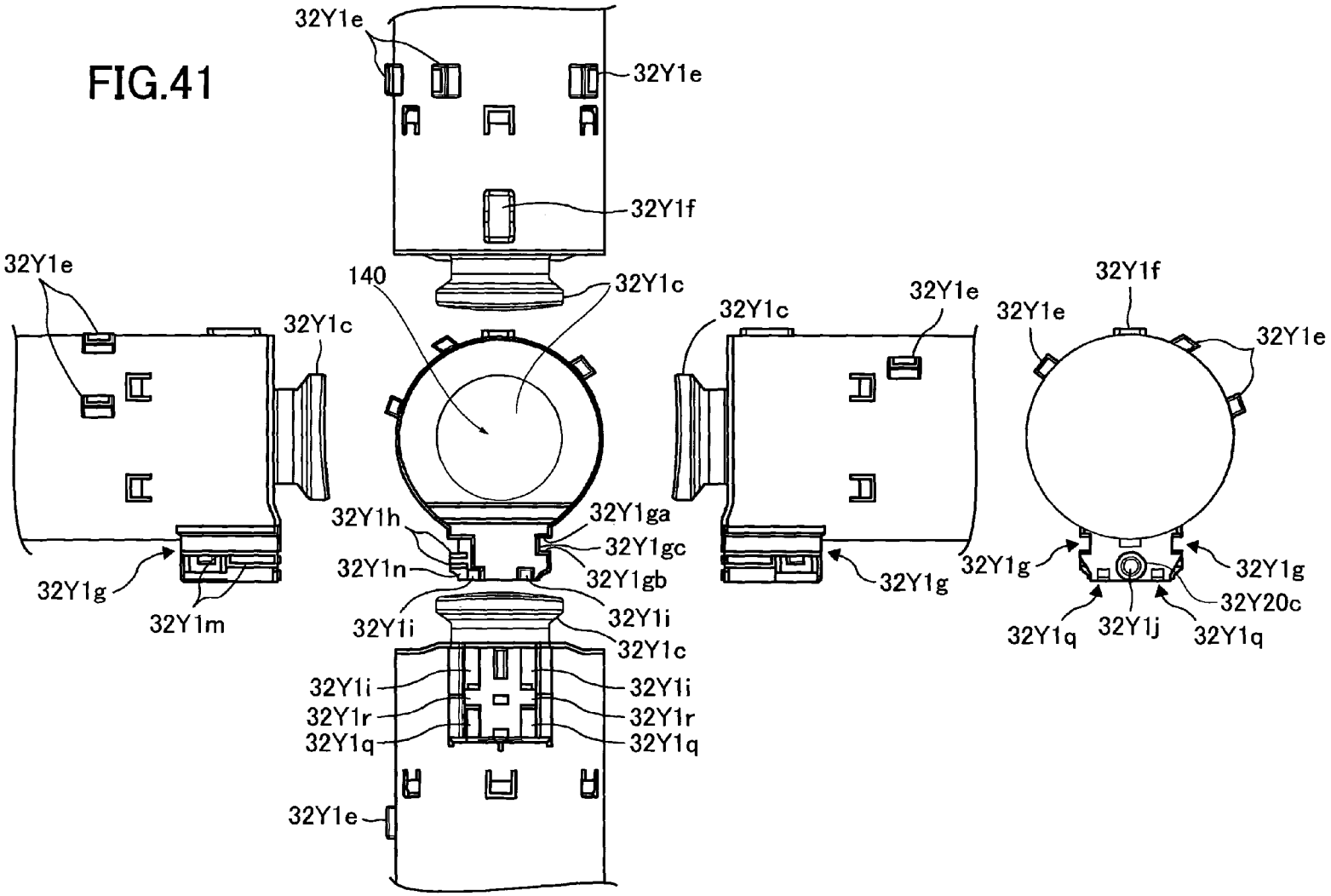
FIG. 41 is a six-sides view showing an appearance of the first cap element mounted to the opening at the one end side of the container main body, and a vicinity of the opening at the one end side of the cylindrical body.

In the toner discharge part 32Y1*d*, a pressed part 32Y1*h* shown in FIG. 39 to FIG. 42 and a nozzle insertion port 32Y1*j* shown in FIG. 38 and FIG. 41 are disposed. At an end part of the nozzle insertion port 32Y1*j*, a ring-shaped sealing member 32Y20*c* is disposed by enclosing an opening edge part thereof.

The ring-shaped sealing member 32Y20*c* prevents toner leakage through a clearance between the nozzle 72 and the nozzle insertion port 32Y1*j* shown in FIG. 34 when the toner container 32Y is mounted to the toner container storage part 31Y. The ring-shaped sealing member 32Y20*c* also has a function of absorbing impact when the toner container 32Y is completely mounted by sliding in the toner container storage part 31Y.

The toner discharge part 32Y1*d* is fitted into the mounting cutout 140" (refer to FIG. 37) of the cylindrical body 32Y2'. The toner discharge part 32Y1*d* includes a nozzle insertion part 32Y30 shown in FIG. 40. The nozzle insertion part 32Y30 includes a hole part 32Y1*b*, a toner discharge port 32Y1*a* and a toner discharge path 32Y30*a*. At the hole part 32Y1*b*, a columnar shape 32Y3' of the plug member 32Ys is disposed in a movable manner.

The toner discharge port 32Y1*a* is formed above the peripheral wall of the hole part 32Y1*b*. The hole part 32Y1*b* and the toner discharge path 32Y30*a* communicate to each other via the toner discharge port 32Y1*a*. The toner discharge path 32Y30*a* is disposed above the toner discharge port 32Y1*a*.

The toner discharge port 32Y1*a* and an inner space of the cylindrical body 32Y2' communicate with each other via the toner discharge path 32Y30*a*. The nozzle insertion part 32Y30 is configured to communicate the hole part 32Y1*b* with the nozzle insertion port 32Y1*j* of the toner discharge part 32Y1*d* when fitted into a concave portion disposed at the toner discharge part 32Y1*d*.

The plug member 32Y3 includes a columnar part 32Y3' inserted to the hole part 32Y1*b*, and a contact plate part 32Y3". The plug member 32Y3 has a function of opening and closing the toner discharge port 32Y1*a* when the columnar part 32Y3' is displaced in the hole part 32Y1*b*.

When the toner container 32Y is mounted or removed, a claw member 75 of the toner container storage part 31 contacts the contact plate part 32Y3", whereby the columnar part 32Y3' is displaced toward a closing position of the toner discharge port 32Y1*a*.

According to the present embodiment, the nozzle insertion part 32Y30 is provided with a spring 32Y30*b* which presses the plug member 32Y3 in a direction closing the toner discharge port 32Y1*a* as shown in FIG. 43 to FIG. 47. Similarly with the claw member 75, the spring 32Y30*b* has a function of displacing the columnar part 32Y3' to a closing position of the toner discharge port 32Y1*a* when the toner container 32Y is removed.

By providing the spring 32Y30*b* at the nozzle insertion part 32Y30, the plug member 32Y3 can be promptly displaced in a closing direction of the toner discharge port 32Y1*a*. Accordingly, a configuration having the spring 32Y30*b* at the nozzle insertion part 32Y30 can suppress toner leakage from the toner discharge port 32Y1*a* in a more reliable manner compared with a configuration not having the spring 32Y30*b* at the nozzle insertion part 32Y30. However, the spring 32Y30 needs not to be necessarily provided on the nozzle insertion part 32Y30.

As shown in FIG. 43, an O-ring 32Y30*d* and an O-ring 32Y30*e* are provided on both ends in a direction where the hole part 32Y1*b* passes through as shown in FIG. 43. The O-ring 32Y30*d* and the O-ring 32Y30*e* suppress toner leakage through a clearance between the plug member 32Y3 and the hole part 32Y1*b*. At the nozzle insertion part 32Y30, an O-ring 32Y30*c* is provided by enclosing an outer peripheral wall of the toner discharge path 32Y30*a*. The O-ring 32Y30*e* suppresses toner leakage through a clearance between the mounting cutout 140" and the nozzle insertion part 32Y30.

At the toner discharge part 32Y1*d*, a pair of second groove parts 32Y1*i* is provided as shown in FIG. 38 to FIG. 42. A pair of claw members 75 is guided to the second groove parts 32Y1*i*. On an extending line of the second groove part 32Y1*i*, a third groove part 32Y1*q* is disposed as shown in FIG. 21. A sliding surface 32Y1*r* is provided between the second groove part 32Y1*i* and the third groove part 32Y1*q*. The sliding surface 32Y1*r* has a function of pushing down the claw member 75 by smoothly contacting the claw member 75 of the toner container storage part 31.

The sliding surface 32Y1*r* prevents the claw member 75 from preventing the mounting of the toner container 32Y by pushing down the claw member 75. That is, a slanted surface smoothly pushing down the claw member 75 is provided on an edge of the sliding surface 32Y1*r* on the side of the third groove part 32Y1*q*.

The electronic substrate 32Y1*f* mentioned above is a RFID or the like. The electronic substrate 32Y1*f* is provided on an upper position of the cylindrical body 32Y2' opposite to the hole part 32Y1*b*. With this arrangement, the toner adhering in a vicinity of the hole part 32Y1*b* adheres on the electronic substrate 32Y1*f* and thereby suppresses deterioration of the communication sensitivity with the antenna base plate 74. As described above, the electronic substrate 32Y1*f* may be provided atop the lid part 140 of the first cap member 140 in a detachable manner.

The gripping part 32Y1*c* is provided on the front side of the first cap member 140. That is, the gripping part 32Y1*c* is located on a surface opposite to a surface where the nozzle insertion port 32Y1*j* is disposed. Accordingly, the gripping part 32Y1*c* prevents the user from touching the nozzle insertion port 32Y1*j* when gripping the gripping part 32Y1*c*. As a result, the user is prevented from being stained by the toner even when there is a toner adhering in a vicinity of the nozzle insertion port 32Y1*j*.

[Supplementary Description of Projection Part 32Y1*e*]

As mentioned above, the projection part 32Y1*e* is used for color identification. In other words, the projection part 32Y1*e* is used for identification of toner containers 32Y, 32M; 32C and 32K. The toner discharge port 32Y1*j* is disposed at a front side of the projection part 32Y1*e* as shown in FIG. 37 and FIG. 43 to FIG. 47.

With this configuration, even when a toner container 32Y of a different color is inserted into the toner container storage part 31 by mistake, the projection part 32Y1*e* hits the toner container insertion port 71Y before the nozzle 72 hits the columnar part 32Y3', whereby the toner container 32Y cannot be inserted further inward and thereby release of the toner discharge port 32Y1*a* by insertion of the nozzle 72 can be prevented.

Accordingly, even when a different toner container 32M, 32C or 32K is inserted into the toner container storage part 31, a drop of the toner into the toner container storage part 31Y or staining of the toner container storage part 31Y by a different color due to a toner leakage from the toner discharge port 32Y1*a* can be prevented.

[Supplementary Description of Pressed Part 32Y1*b*]

Figure 35:
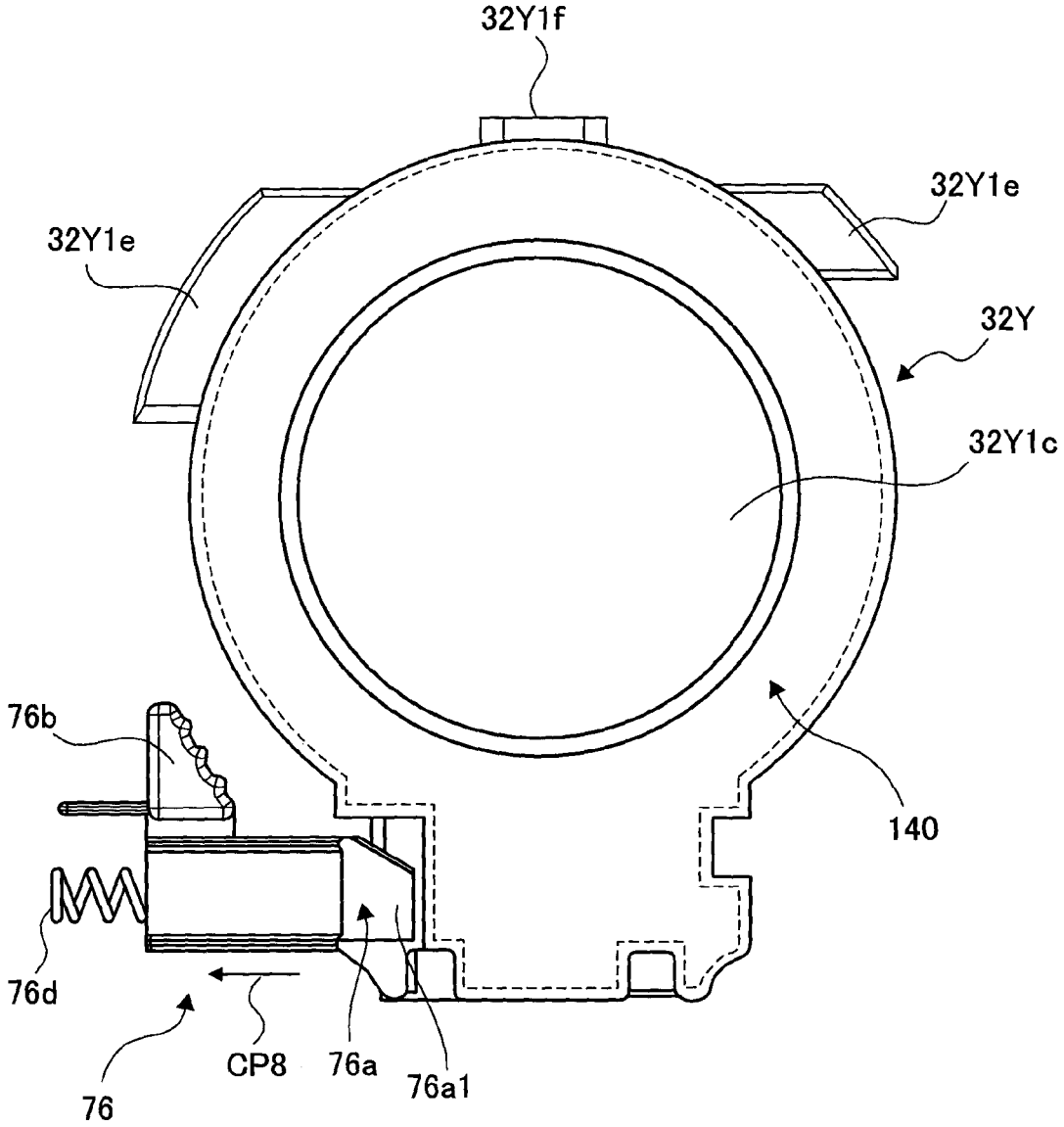
FIG. 35 is a front view showing a state of a toner container release lever when a toner container is mounted to a toner container storage part.
Figure 36:
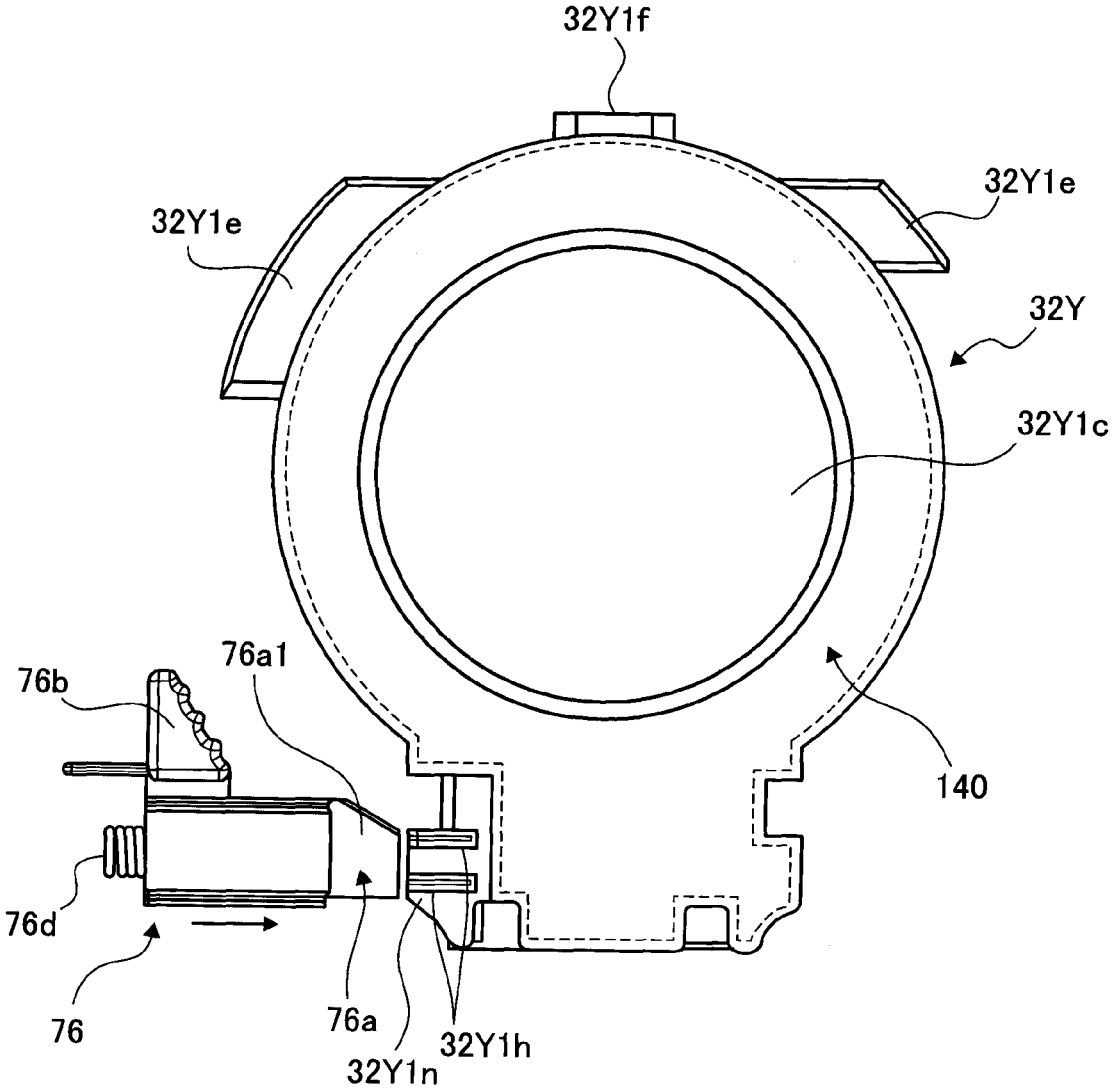
FIG. 36 is a front view showing a state of the toner container release lever when the toner container is mounted to or released from the toner container storage part.

As shown in FIG. 35 and FIG. 39, the pressed part 32Y1*h* is pressed so as to contact the claw part 76*a* of the toner container release lever 76 in the toner container storage part 31Y when the toner container 32Y is mounted to the toner container storage part 31Y. That is, when the toner container 32Y is pressed by the drive coupling 91 and held and fixed by the toner container release lever 76, the pressed part 32Y1*h* is located at a position pressed by the toner container release lever 76.

As shown in FIG. 39, the pressed part 32Y1*h* comprises two projection ribs which protrude from a surface 32Y1*n* perpendicular to the mounting and removing direction of the toner container 32Y toward a detachment side thereof. The pressed part 32Y1*h* is pressed to the toner container release lever 76 by a pressing force of the drive coupling 91 from the inner side to the front side.

In the toner discharge part 32Y1*d*, a sliding contact rib 32Y1*n* is disposed in a direction parallel with the mounting and removing direction as shown in FIG. 42. When the toner container 32Y is mounted to or removed from the toner container storage part 31Y, the sliding contact rib 32Y1*n* holds a release position of the toner container release lever 76 by making a sliding contact with the toner container release lever 76.

Further, the sliding contact rib has a function of ensuring strength of the surface 32Y1*n*. An upper rib out of two sliding contact ribs 32Y1*m* is configured as a horizontal surface 32Y1*g* which forms the first groove part 32Y1*g* engaging with the positioning member 78 of the toner container storage part 31Y.

Embodiment 6

Configuration of Conveyance Member 33

Figure 48:
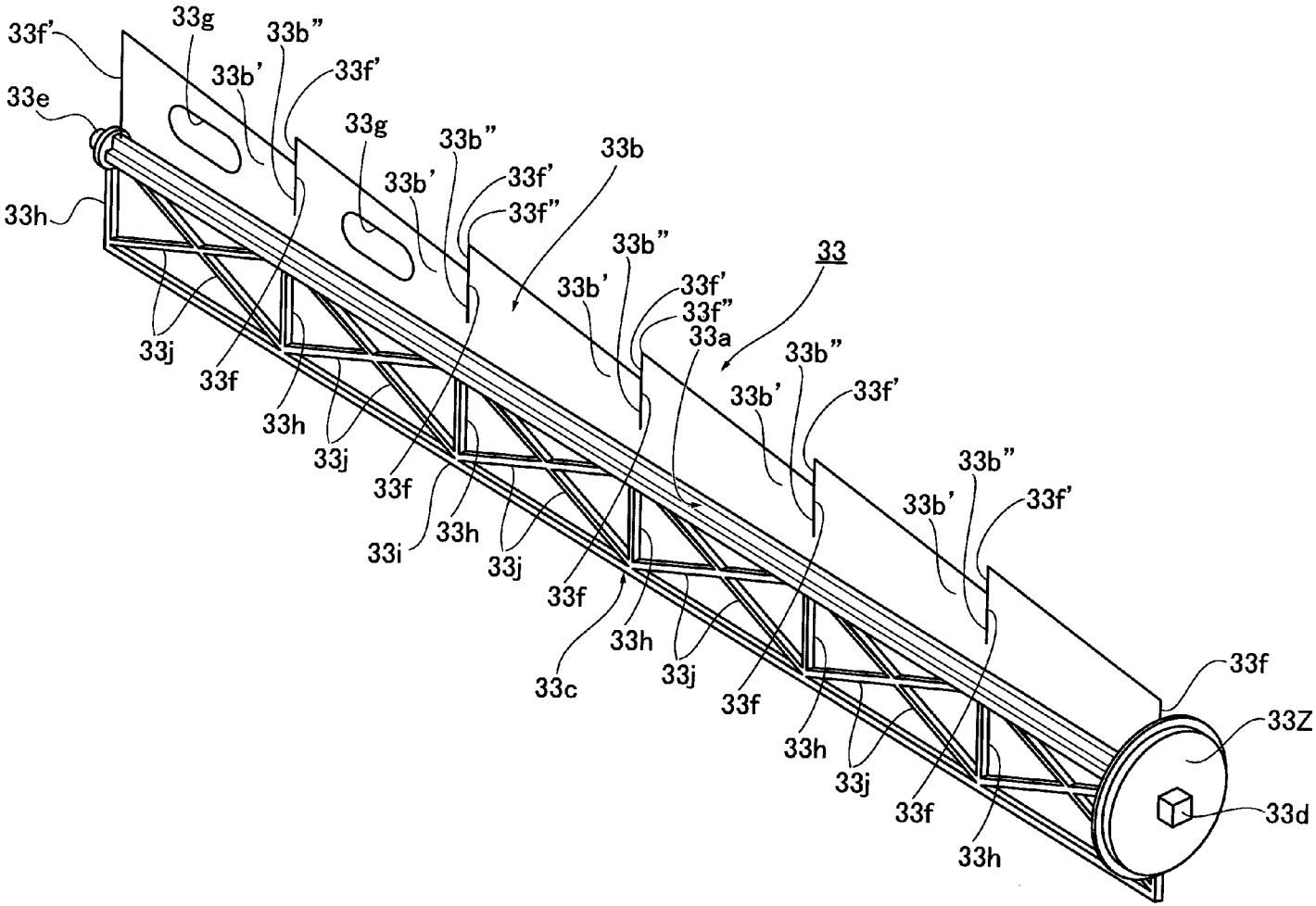
FIG. 48 is a perspective view showing an enlarged conveying element shown in FIG. 3.

As shown in FIG. 48, the conveyance member 33 includes a disc part 33*z*, a rotary shaft 33*a*, a flexible conveyance blade 33*b*, and a stirring rib 33*c*. The rotary shaft 33*a* is provided on a center of the disc part 33*z*. As shown in FIG. 34, the disc part 33*z* is located in a vicinity of an opening part 32Y2*b*' of the other end side of the container main body 32Y. The rotary shaft 33*a* extends in a longitudinal direction from an opening part 32Y2*a*' at the one end side of the container main body 32Y toward the opening part 32Y2*b*' on the other end side.

In the disc part 33*z*, a square-shaped connecting shaft part 33*d* is formed opposite to the rotary shaft 33*a*. That is, the connecting shaft part 33*d* coupled to a connecting shaft support part (described later) is formed at the other end side of the rotary shaft 33*a*.

At the one end side of the rotary shaft 33*a*, a columnar shaft part 33*c* fitted into a circular hole 140*b*' of the rotary shaft support tube 140*b* in a rotatable manner is formed. The shape of the connecting shaft part 33*d* is not limited to the square shape, but may be an elliptic, a triangle or a D-like shape.

The conveyance blade 33*b* comprises a plurality of flexible film plates 33*b*'. The film plates 33*b*' are formed with a plurality of cuts 33*b*" provided on intervals from the one end side of the rotary shaft 33*a* toward the other end thereof.

The film plate 33*b*' has a short side 33*f* which is close to the other end side of the rotary shaft 33*a*, and a long side which is close to the one end side of the rotary shaft 33*a*. The short side 33*f* of the film plate 33*b*' closest to the disc part 33*z* is held by a radial groove (not shown) provided in the disc part 33*z*.

An end edge 33*f*" of the long side 33*f*' is in contact with an inner peripheral wall of the container main body 32Y. Rotation of the rotary shaft 33*a* twists the film plate 33*b*", whereby the conveyance blade 33*b* is shaped to a spiral blade and thereby the toner in the container main body 32Y is conveyed from the other end side toward the one end side of the container main body 32Y.

Further, the conveyance blade 33*b* may be formed integrally with the rotary shaft 33*a*. If the conveyance blade 33*b* is formed separately, the conveyance blade 33*b* may be configured by fixing to the rotary shaft 33*a* by using a double-sided tape.

Further, in two film plates 33*b*' close to the opening part 32Y2*a*' at the one end of the cylindrical body 32Y, an elliptic opening 33*g* is formed to prevent the toner from residing at the one end side of the container main body 3Y.

A stirring rib 33*c* is provided in 180 degrees opposite direction with respect to the conveyance blade 33*b* with the rotary shaft 33*a* as a boundary. The stirring rib 33*c* includes longitudinal shallow members 33*h* which are provided on intervals from the one end side to the other end side of the rotary shaft 33*a* and extend in a radial direction, transverse coupling shallow members 33*i* which extend in a transverse direction from the one end side toward the other end side of the rotary shaft 33*a* and couple the longitudinal shallow members 33*h*, and diagonal shallow members 33*j* which extend in a direction crossing each other and couple the rotary shaft 33*a*, longitudinal shallow members 33*h* and transverse shallow members 33*i* to each other.

The stirring rib 33*c* is used to stir the toner by rotation of the rotary shaft 33*a*. A conveyance blade 33*b* of the conveyance member 33 comprising a flexible film plate 33*b*' rotates while touching an inner peripheral wall of the cylindrical body 32Y2' with a light force, whereby aggregation of the developer can be prevented.

[Configuration of Second Cap Member 134]

A specific configuration of the second cap member 134 can be considered in various manners. Hereinafter, a specific configuration of the second cap member 134 is described with reference to the drawings.

Specific Example 1 of Second Cap Member 134

Figure 49:
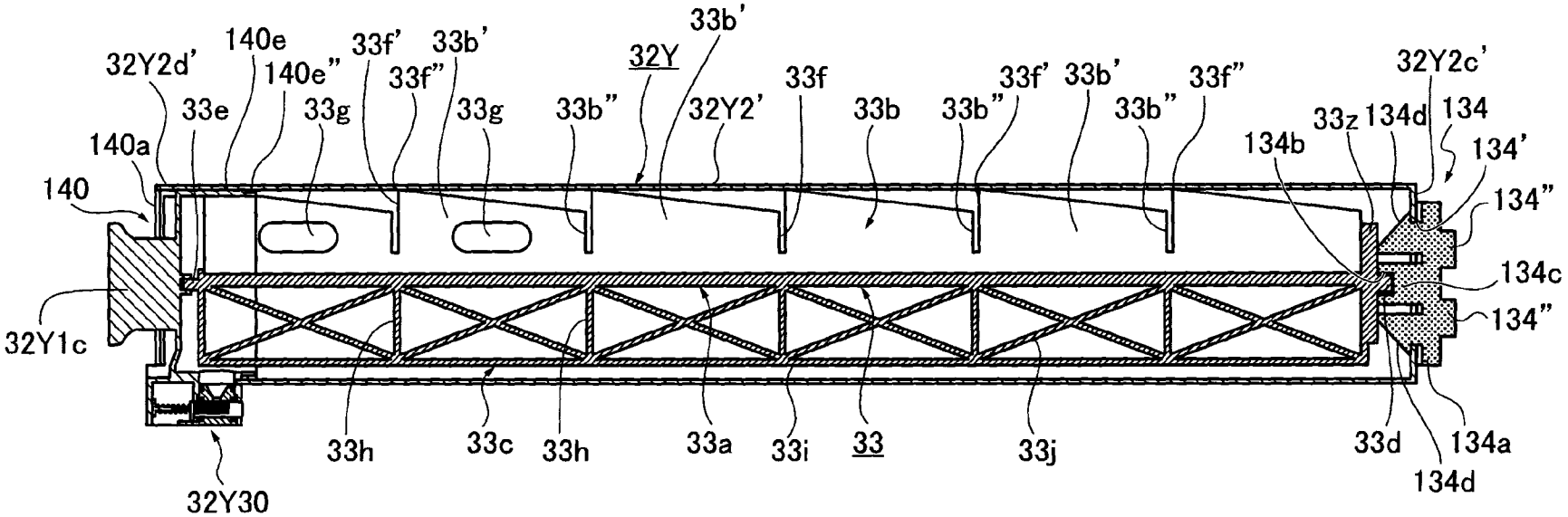
FIG. 49 is a cross-sectional view schematically showing a toner container comprising a cylindrical body, a first cap element, a second cap element, and a conveyance member.
Figure 50:
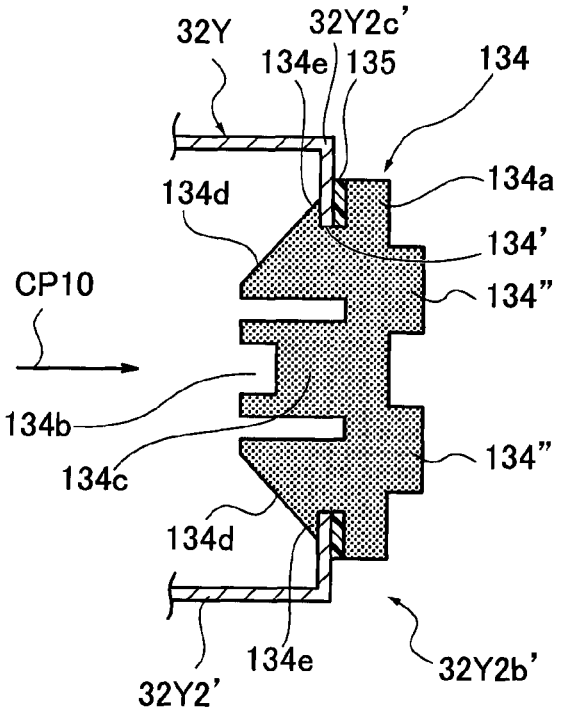
FIG. 50 is a view for explaining a specific example 1 of the second cap member mounted to an opening at the other end side of the cylindrical body, and is a cross-sectional view showing a vicinity of the opening at the other end side of the cylindrical body.
Figure 51:
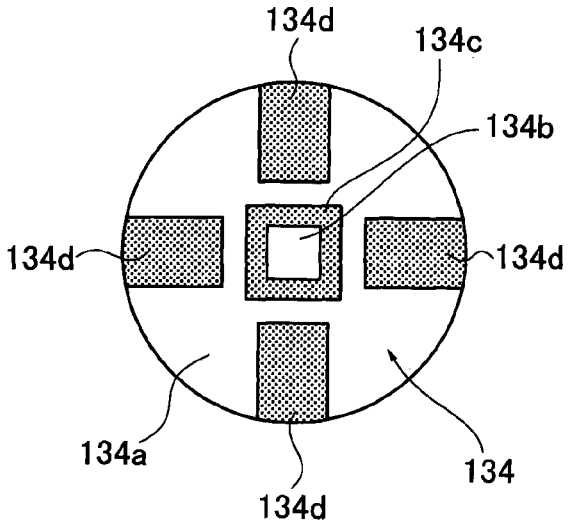
FIG. 51 is a plan view of the second cap member viewed in a direction of arrow CP10.

FIG. 49 and FIG. 50 show a specific example 1 of the second cap member 134. As shown in FIG. 50, the second cap member 134 includes a circular lid part 134*a* configured to seal an opening part 32Y2*b*' at the other end side of the cylindrical body 32Y2'. As shown in FIG. 51, a connecting shaft support part 134*c* having a square hole 134*b* into which a square-shaped connecting shaft part 33*d* is fitted is formed at the one end side of the circular lid part 134*a*. The connecting shaft support part 134C forms the driven coupling along with a connecting projection part 134". The connecting shaft support part 134*c* protrudes into the cylindrical body 32Y2'.

At the circular lid part 134*a*, four flexible claw parts 134*d* are integrally formed, along with the connecting shaft support part 134*c*, at a position 90 degrees symmetrical with the connecting shaft support part 134*c* as a center. The flexible claw parts 134*d* comprise undercuts. The connecting projection part 134" is formed at the other end side of the circular lid part 134*a*, by protruding in a direction opposite to the connecting shaft support part 134*c*. The connecting projection part 134" is connected by being brought into contact with the drive coupling 91 in the rotating direction.

Then, as shown in FIG. 49, the conveyance member 33 is inserted into the container main body 32Y, and a columnar shaft part 33*e* of the rotary shaft 33*a* is fitted into a circular hole 140*b*' of the shaft support tube 140*b*. The connecting shaft part 33*d* is fitted into a square hole 134*b*, and flexible claw parts 134*d* of the second cap member 134 are bent in a direction approaching to each other so as to be inserted into a powder loading port 134' as an opening part 32Y2*b*' at the other end side of the cylindrical body 32Y2'. Then, claws 134*e* of a flexible claw part 134*d* are hooked to a configuration wall 32Y2*c*' of the opening part 32Y2*b*' in the cylindrical body 22Y2' as shown in FIG. 50 by enlarging.

With this configuration, the second cap member 134 is mounted to the configuration wall 32Y2*c*' of the opening part 32Y2*b*' at the other end side of the container main body 32' in a rotatable manner. As a result, the rotary shaft 33*a* of the conveyance member 33 is bridged between the rotary shaft support tube 140*b* and the connecting shaft support part 134*c* in a rotatable manner.

In such a manner, the flexible claw parts 134*d* are formed on the second cap member 134, and the second cap member 134 is mounted to the configuration wall 32Y2*c*' of the opening part 32Y2*b*' at the other end side of the cylindrical body 32Y2'. With this configuration, the second cap member 134 is easily assembled to and disassembled from the container main body 32Y.

Further, when the second cap member 134 is mounted to the configuration wall 32Y2*c*' of the opening part 32Y2*b*' at the other end side of the container main body 32Y after loading the toner thereto, a ring sheet shaped sealing member 135 is held between the configuration wall 32Y2*c*' of the opening part 32Y2*b*' at the other end side of the cylindrical container main body 32Y and the circular lid part 134*a*, whereby the powder loading port 134' is sealed so as to prevent toner leakage from the powder loading port 134' even when the second cap member 134 rotates.

Embodiment 7

Specific Example 2 of Second Cap Member 134

Figure 52:
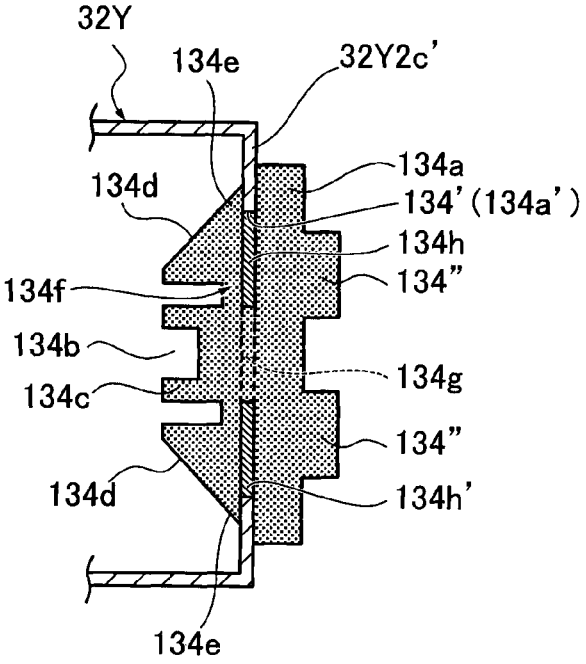
FIG. 52 is a view for explaining a specific example 2 of the second cap member, and is a cross-sectional view showing a vicinity of the opening at the other end side of the cylindrical body.

FIG. 52 shows a specific example 2 of the second cap member 134. The second cap member 134 comprises a circular lid part 134*a*, a flexible claw part 134*f*, and a columnar connecting plate part 134*g* which connects the circular lid part 134*a* and the flexible claw part 134*f* to each other.

Four flexible claw parts 134*d* are formed at flexible claw parts 134*f* similarly with the specific example 1. A connecting shaft support part 134*c* is formed integrally with a columnar connecting plate part 134*g*. The connecting shaft support part 134*c* has a square hole 134*b* similarly with the specific example 1.

A ring sheet shaped sealing member 134*h* is fitted into the columnar connecting sheet part 134*g*. The ring sheet shaped sealing member 134*h* is made of boron, felt, or the like, similarly with the ring sheet shaped sealing member 135.

The second cap member 134 is also inserted into the powder loading port 134' with the flexible claw parts 134*d* bent in a direction approaching to each other, and claws 134*e* of the flexible claw parts 134*d* are hooked to the configuration wall 32Y2*c*' at the opening part 32Y2*b*' of the cylindrical body 32Y2'. Thus, the second cap member 134 is mounted to the configuration wall 32Y2*c*' of the opening part 32Y2*b*' at the other end side of the container main body 32Y in a rotatable manner. At that time, an outer peripheral surface 134*h*' of the ring sheet shaped sealing member 134*h* is brought into contact with an inner peripheral wall 134*a*' forming the powder loading port 134'.

Accordingly, by mounting the second cap member 134 to the configuration wall 32Y2*c*' of the opening part 32Y2*b*' at the other end side after loading the toner into the toner container main body 32Y, the powder loading port 134' is sealed so as to prevent toner leakage from the powder loading port 134' even when the second cap member 134 rotates.

Embodiment 8

Specific Example 3 of Second Cap Member 134

Figure 53:
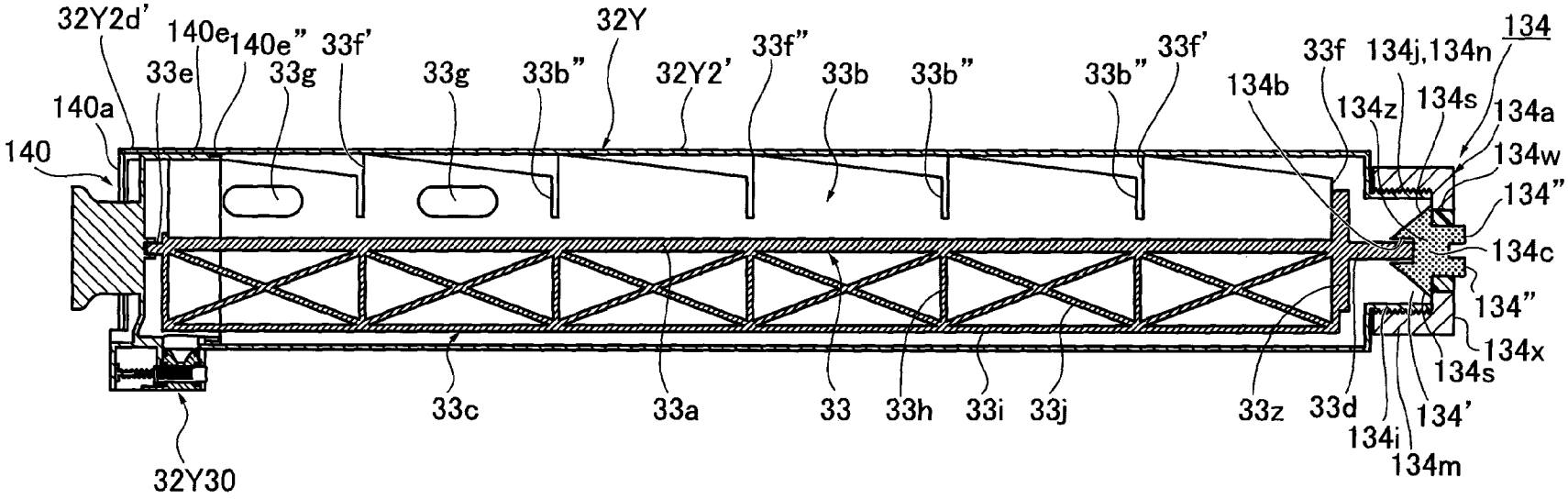
FIG. 53 is a view for explaining a specific example 3 of the second cap member, and is a cross-sectional view schematically showing a toner container which comprises a cylindrical body, a first cap member, a second cap member, and a conveyance member.
Figure 54:
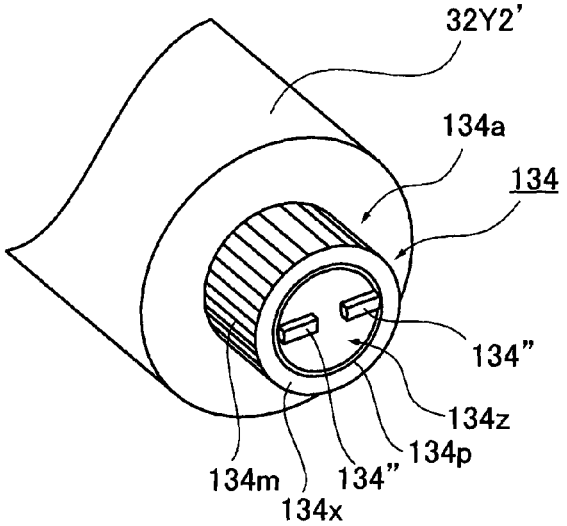
FIG. 54 is a partial perspective view showing a vicinity of the opening at the other end side of the cylindrical body shown in FIG. 31.
Figure 55:
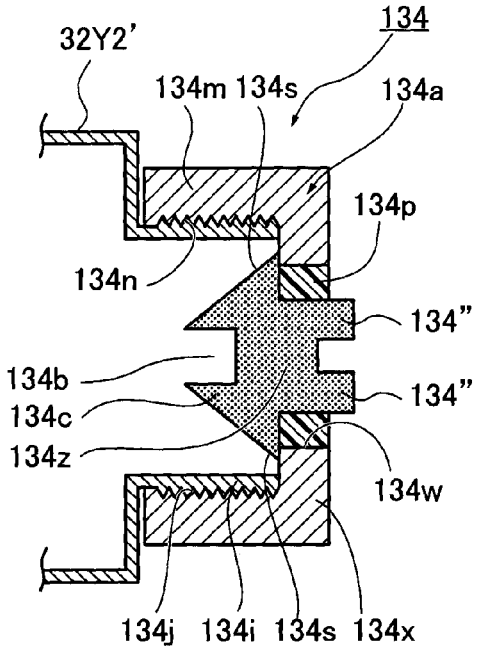
FIG. 55 is a partial cross-sectional view showing an enlarged second cap member mounted to a vicinity of the opening at the other end side of the cylindrical body shown in FIG. 32.

FIG. 53 to FIG. 55 show a specific example 3 of the second cap member 134. The configuration wall 32Y2*c*' of the opening part 32Y2*b*' at the other end side of the cylindrical body 32Y' is of a small-diameter tube 134*i*. The powder loading port 134' is formed in the small-diameter tube 134*i*. An outer peripheral thread part 134*j* is formed at an outer peripheral of the small-diameter tube 134*i*.

According to the specific example 3, the second cap member 134 includes a rotary element 134*z* comprising the lid part 134*a* and the driven coupling. The rotary element 134*z* is rotatable with respect to the lid part 134*a*. The lid part 134*a* comprises a top plate part 134*x* including a through hole 134*w* into which the rotary element 134*z* is inserted in a rotatable manner and a tube 134*m* enclosing the small-diameter tube 134*i* integrally with the top plate part 134*x*. In a peripheral wall 134*m* of the enclosing tube 134*m*, an inner peripheral thread part 134*n* screwed with an outer peripheral thread part 134*j* is formed.

However, the toner container described above has a problem that there is a possibility that the seal member may be removed by user's erroneous operation, and thereby the powder loading port is opened, and as a result, the toner stored inside is scattered out.

At the top plate part 134*x*, a cylindrical sealing member 134*p* is provided so as to enclose the through hole 134*w*. The rotary element 134*z* is brought into the sliding contact with the top plate part 134*x* in a rotatable manner. The connecting shaft support part 134*c* comprising a square hole 134*b* is formed at the one end side of the rotary element 134*z*.

At the other end side of the rotary element 134*z*, a connecting projection part 134" is formed. A claw part 134*s* is formed at the connecting shaft support part 134*c*. The rotary part 134*z* is prevented from dislodging from the lid part 134*a* by the claw part 134*z*. Accordingly, the rotating element 134*z* is pressed to the connecting shaft part 33*d* of the rotary shaft 33*a* by twisting the second cap member 134 into the small-diameter part 134*i*. Further, the powder loading port 134' is sealed so as to prevent toner leakage from the powder loading port 134' by an outer peripheral surface 134*x* brought into contact with a peripheral surface of the connecting shaft.

Then, the conveyance member 33 is inserted into the cylindrical container main body 32Y, the columnar shaft part 33*e* of the rotary axis 33*a* is fitted into a circular hole 140*b'* of the rotary shaft, and the small-diameter tube 134 is screwed while rotating the second cap member 134. In such a manner, the lid part 134*a* is fixed to the small-diameter tube 134*i*. As a result, the conveyance member 33 is bridged between the rotary shaft support tube 140*b* and the connecting shaft support part 134*c* in a rotatable manner.

Such configuration allows mounting and removing of the second cap member 134 and the cylindrical body 32Y2' by screws, whereby the toner container can be disassembled easily and the developer can be re-loaded through the toner loading port 134' easily.

Embodiment 9

Specific Example 4 of Second Cap Member 134

Figure 56:
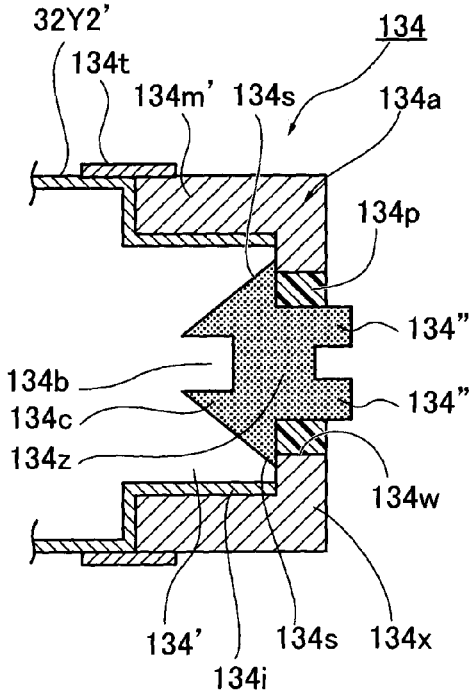
FIG. 56 is a view for explaining a specific example 4 of the second cap member, and is a partial cross-sectional view showing an enlarged second cap member.

FIG. 56 shows a specific example 4 of the second cap member 134. According to the specific example 4, a lid part 134*a* of the second cap member 134 includes a top plate part 134*x* comprising a through hole 134*w* into which a rotary element 134*z* is inserted, and a fitting tube part 134*m'* which is fitted into a small-diameter tube part 134*i* integrally with the top plate part 134*x*.

After fitting the fitting tube part 134*m'* into the small-diameter tube part 134*i*, the lid part 134*a* of the second cap member 134 is fixed to the cylindrical body 32Y2' by winding an adhesive tape 134*t* across a portion extending from an outer peripheral surface of the fitting tube part 134*m'* to an outer peripheral surface of the cylindrical body 32Y2'.

Other configurations of the second cap member 134 according to the specific example 4 are same as the specific example 3. Therefore, detailed description thereof is omitted. By fixing the second cap member 134 to the cylindrical body 32Y2' by using the tape 134*t*, time needed to remove the toner container 32Y2' can be reduced significantly.

In the embodiments described above, forming of the first cap member 140, the conveyance member 33 and the second cap member 134 by an injection molding and forming of the cylindrical body 32Y2' by the blow molding or the biaxial stretching blow molding facilitates material separation and recycling of the toner container 321

Further, the blow molding of the cylindrical body 32Y2' reduces the weight even when forming a large toner container 32Y, and also reduces the manufacturing cost of the toner container 32Y as well.

Further, since the second cap member 134 has two functions of sealing and driven coupling the opening part 32Y2*b'* of the cylindrical body 32Y2', the quantity and costs of parts can be reduced.

As described above, embodiments according to the present invention include inventions described hereinafter.

(A) A powder storage container includes:

a cylindrical body configured to store a developer therein and including an opening part at both ends thereof as a part for forming a powder storage part which is mounted to and removed from an image forming apparatus, a first cap member including at least a discharge part configured to discharge the developer from inside of the powder storage part toward a main body of the image forming apparatus, and a lid part configured to seal an opening part at a one end side, and mounted to the opening part at the one end side of the cylindrical body to form the cylindrical container body in cooperation with the cylindrical body, a conveyance member including at least a stirring blade, disposed in the cylindrical body so as to extend from an opening part at a one end side toward an opening part at the other end side thereof, and configured to convey the developer, while stirring, from the opening part at the other end side toward the opening part at the one end side by rotating with respect to the cylindrical body, and a second cap member including a drive coupling configured to transmit a rotational drive force from the main body of the image forming apparatus to the conveyance member, and a lid part configured to seal the opening part at the other end side to form the powder storage part in cooperation with the first cap member and the cylindrical body, wherein the opening part at the other end side forms a powder loading port for loading the developer into the powder storage container.

(B) The powder storage container according to (A), wherein a small-diameter tube part is formed at the other end side of the cylindrical body, the second cap member includes a rotary element forming the driven coupling and configured in such a manner rotatable with respect to a lid part of the second cap member, and the second cap member is mounted to the small-diameter tube part by fixing the lid part to the small-diameter tube part.

(C) The powder storage container according to (C), wherein the lid part of the second cap member includes a top plate part having a through hole into which the rotary element is inserted in a rotatable manner, and an enclosure tube part which encloses the small-diameter tube part, a threaded part is formed on an outer peripheral surface of the small-diameter tube part and on an inner peripheral surface of the enclosure tube part, and the lid part of the second cap member is fixed to the small-diameter tube part with the enclosure tube part screwed to the small-diameter tube part.

(D) The powder storage container according to (B), wherein the lid part of the second cap member includes a top plate part having a through hole into which the rotary element is inserted in a rotatable manner, and a fitting tube part which is fitted into the small-diameter tube part, and the lid part of the second cap member is fixed to the cylindrical body by attaching an adhesive tape around a portion extending from an outer peripheral surface of the fitting tube part to an outer peripheral surface of the cylindrical body.

(E) The powder storage container according to (A) or (B), wherein the first cap member, the second cap member and the conveyance member are formed by the injection molding, and the cylindrical body is formed by the blow molding or the biaxial stretching blow molding.

(F) The powder storage container according to (A) or (B), wherein a rotary shaft support tube protruding into the cylindrical body is formed at the lid part of the first cap member, a connecting shaft support part protruding into the cylindrical body is formed into the driven coupling, the conveyance member includes a rotary shaft extending from the one end side toward the other end side of the cylindrical body, the one end side of the rotary shaft is supported by the rotary shaft support tube in a rotatable manner, the conveyance blade comprises a flexible film plate and can be rotated integrally with the rotary shaft by being twisted by rotation of the rotary shaft.

(G) The powder storage container according to (F), wherein the conveyance blade is formed integrally with the rotary shaft.

(H) The powder storage container according to (F), wherein the conveyance blade is formed separately from the rotary shaft and is fixed to the rotary shaft with a double-sided tape.

(I) A powder storage container, wherein a rotary shaft support tube protruding into the cylindrical body is formed at a lid part of the first cap member, the driven coupling includes a connecting shaft support part which protrudes from a lid part of the second cap member into the cylindrical body, and a connecting projection part coupled to a drive coupling of the image forming apparatus being protruded in a direction reverse to a projection direction of the connecting shaft support part from the lid part, the conveyance member includes a rotary shaft extending toward the one end side toward the other end side, a columnar shaft part fitted to the rotary shaft support tube in a rotatable manner is formed at the one end side of the rotary shaft, a connecting shaft part coupled to the connecting shaft support part is formed at the other end side of the rotary shaft, at the lid part of the second cap member, the connecting shaft support part and a flexible claw part which protrudes into the cylindrical body and being hooked to a configuration wall of an opening part and the other end side are formed, the conveyance blade is integrated with the rotary shaft, a ring-shaped sealing member is intervened between the configuration wall of the opening part at the other end side of the cylindrical body and the lid part, an undercut is formed at the flexible claw part, at the conveyance member, the rotary shaft is bridged between the rotary shaft support tube and the connecting shaft support part, and the conveyance member is rotated and driven by an integral rotation the drive coupling and the lid part by the driven coupling with respect to the cylindrical body.

(J) The powder storage container according to (A), wherein a rotary shaft support tube protruding into the cylindrical body is formed at the lid part of the first cap member, the drive coupling part includes a connecting shaft support part which protrudes from the lid part of the second cap member into the cylindrical tube, and a connecting projection part which is coupled to the drive coupling of the image forming apparatus by being protruded in a direction reverse to a projection direction of the connecting shaft support part from the lid part, the conveyance member includes a rotary shaft extending from the one end side toward the other end side, a columnar shaft part fitted into the rotary shaft support tube in a rotatable manner is formed at the one end side of the rotary shaft, a connecting shaft part coupled to the connecting shaft support part is formed at the other end side of the rotary shaft, the conveyance blade is integrated into the rotary shaft, a ring-shaped sealing member is intervened between the configuration wall of the opening part at the other end side and the columnar connecting sheet part, the flexible claw part is formed by undercut, at the conveyance member, the rotary shaft is bridged between the rotary shaft support tube and the connecting shaft support part, and the conveyance member is rotated and driven by an integral rotation the drive coupling and the lid part by the driven coupling with respect to the cylindrical body.

(K) The powder storage container according to (B), wherein, a rotary shaft support tube protruding into the cylindrical body is formed at a lid part of the first cap member, a connecting shaft support part protruding into the cylindrical body is formed at the rotary element, the conveyance member includes a rotary shaft extending from the one end side toward the other end side, a columnar shaft part fitted into the rotary shaft support tube in a rotatable manner is formed at the one end side of the rotary shaft, a connecting shaft part coupled to the connecting shaft support part is formed at the other end side of the rotary shaft, at the rotary element, a claw part hooked to a peripheral wall of the through hole by protruding into the cylindrical body together with the connecting shaft support part and a connecting projection part coupled to a drive coupling of the image forming apparatus by protruding in a direction reverse to the connecting shaft support part from the top plate part, a cylindrical sealing member is provided between an outer peripheral portion of the rotary element and an inner peripheral wall of the through hole, the conveyance blade is integrated into the rotary shaft, at the conveyance member, the rotary shaft is bridged between the rotary shaft support tube and the connecting shaft support part, and the conveyance member is rotated and driven by rotation of the drive element by the drive coupling.

(L) A powder storage container includes a cylindrical body which includes an opening part at both ends and forms, by storing a developer there, a part of the powder storage part mounted to and removed from a main body of an image forming apparatus, a first cap member comprising a discharge port of the developer and mounted to an opening part at a one end side of the cylindrical body, a conveyance member configured to convey the developer, while stirring, from an opening part at the other end side toward the opening part at the one end side by rotating with respect to the cylindrical body, and a second cap member comprising a drive coupling which transmits a rotational drive force from the main body of the image forming apparatus to the conveyance member and mounted to the opening part at the other end side in a rotatable manner and so as to seal the opening part at the other end side, wherein the opening part at the other end side serves as a powder loading port for loading the developer into the powder storage container.

(M) An image forming apparatus including the powder storage apparatus according to any one of (M), (A) or (L).

According to the present invention described above, a powder loading port for loading a developer into a cylindrical container main body is provided on a second cap member comprising a drive coupling which transmits a rotational drive force from a main body of an image forming apparatus to a conveyance member, whereby when mounting a cylindrical container main body into the main body of image forming apparatus, the user is anticipated to hold the cylindrical container main body instead of the second cap member and thereby erroneous opening of the powder loading port can be suppressed.

Embodiment 10

As described above, in image forming apparatuses such as a copying machine, a toner container (toner bottle) fitted with a RFID chip as an electronic information storage member has been known (for example, refer to Patent Document 2).

Patent Document 2 discloses a toner container which is provided an IF tag (RFID chip) in which a variety of information such as the type and lot of the toner stored therein is stored. The ID tag (RFID chip) is capable of transmitting and receiving information via wireless communication with a communication circuit having an antenna provided in a main body of an image forming apparatus.

Further, information (information such as the type and lot of the toner) stored in the ID chip can be transmitted via wireless communication to a communication circuit having an antenna provided in a main body of an image forming apparatus.

Further, the toner container disclosed in Patent Document 2 is configured so as to be mounted in a main body of an image forming apparatus in a replaceable manner. A used toner container containing a residual toner of substantially zero is removed from the main body of the image forming apparatus and recovered to a recycling plant for a recycling process such as toner re-loading, etc.

In the meantime, the conventional toner container described above is provided with the RFID chip (ID tag) on an outer surface of the toner container by adhesion, heat welding or the like. Thus, when separating the RFID chip from the toner container during a recycling process, a dedicated tool is needed for disassembling which affects the work efficiency and takes a more time for the works.

Specifically, when re-using a main body of the toner container, a toner stain in the container must be cleaned off with high pressure by using water, air, or the like. If the RFID chip remains fitted to the toner container, the RFID chip may be broken by water or air. Thus, before cleaning the main body of the image forming apparatus, the RFID chip must be separated from an outer surface of the toner container. However, the working efficiency of removing the RFID chip fitted to the outer surface of the toner container by adhesion or heat welding or the like is not good due to necessity of a dedicated tool or the like.

Further, a removed RFID chip is re-used by fitting to an outer surface of a cleaned toner container by adhesion, heat welding or the like, while newly writing information such as the type and lot re-loaded toner on the RFID chip.

Further, when a toner container is re-used as a raw material source by pulverizing since it cannot be re-used as a product due to a flaw thereof or the like, the RFID chip can be re-used by re-writing information stored therein. Therefore, the RFID chip needs to be separated from the outer surface of the toner container. In this case, the working efficiency for separating the RFID chip fitted to the outer surface of the toner container by adhesion, heat welding or the like is not good due to necessity of a dedicated tool or the like as described above.

Hereinafter, a powder storage container and an image forming apparatus capable of efficiently and easily separating the RFID chip from the outer surface of the container in a re-cycling process are described.

[Detailed Description of Cylindrical Tube 32Y2']

As described with reference to FIG. 34, the toner container 32Y includes the container main body 32Y2 and the conveyance member 33. As described above, the container main body 32Y2 includes the cylindrical body 32Y2', the first cap member 240 connected to both ends thereof, and the second cap member 134.

View-A of FIG. 59 is a perspective view showing the cylindrical body 32Y2' with the first cap member removed therefrom.

At an end part 32Y2*a*' at a one end side open to the cylindrical body 32Y2', a first chip holding part 80 for holding a RFID chip 32Y1F in a removal manner is formed on a peripheral surface which becomes an upper part when mounted to the toner container storage part 31. Further, a second ship holding part 81 of a protrusion-piece shape having a flexibility of holding the RFID chip 32Y1*f* in a removable manner is formed together with the chip holding part 80. The configuration of the first chip holding part 80 and the second chip holding part 81 holding the RFID chip 32Y1*f* in a removable manner is described in detail later.

At the opening part 32Y2*a*' at the one end side of the cylindrical body 32Y2', a mounting cutout 240" to which the toner discharge part 32Y1*d* of the first cap member 240 is mounted is formed on a peripheral surface which is located on the lower side when mounted to the toner container storage part 31.

Figure 57:
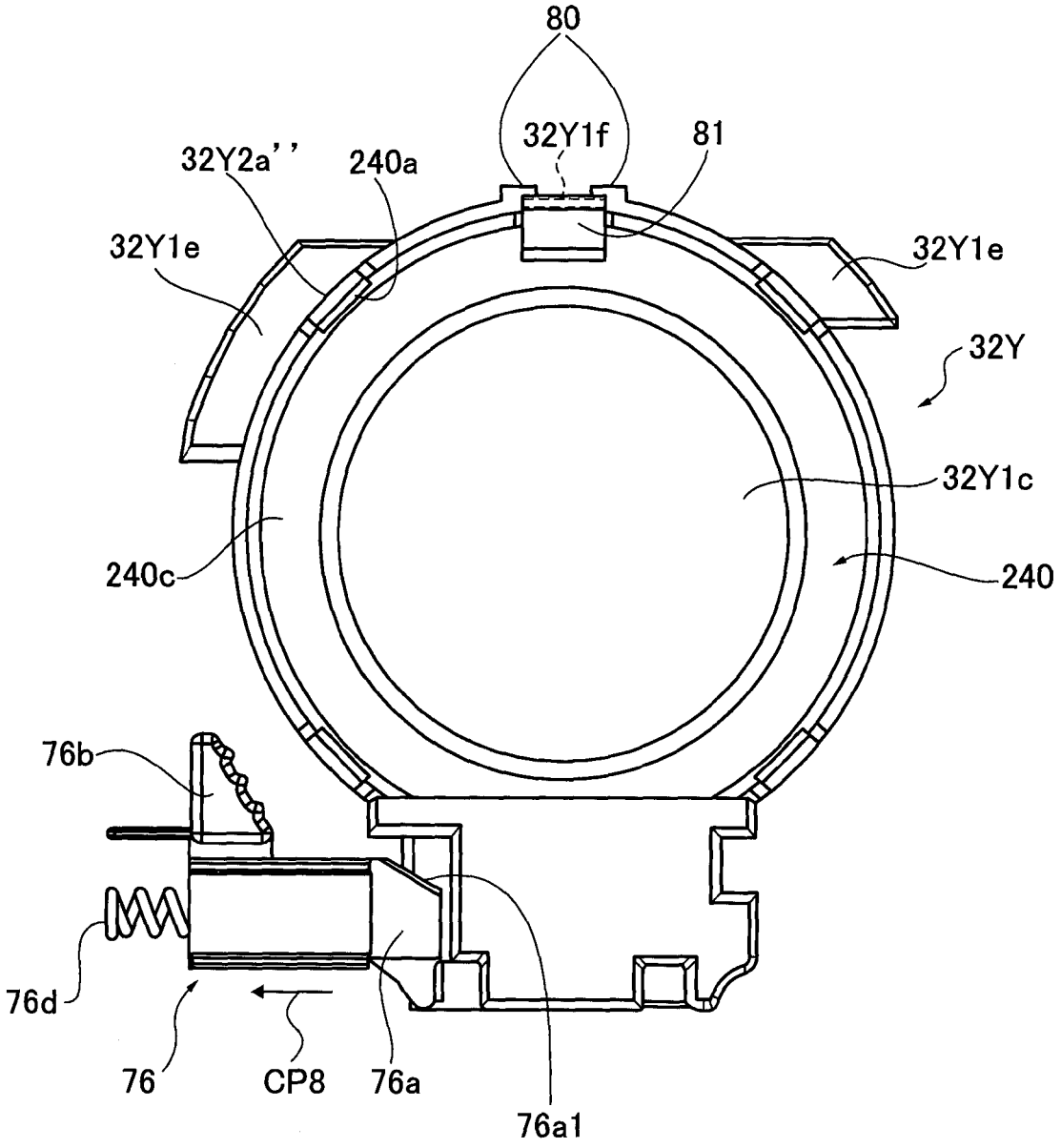
FIG. 57 is a front view showing a state of the toner container release lever when the toner container is mounted to the toner container storage part.
Figure 58:
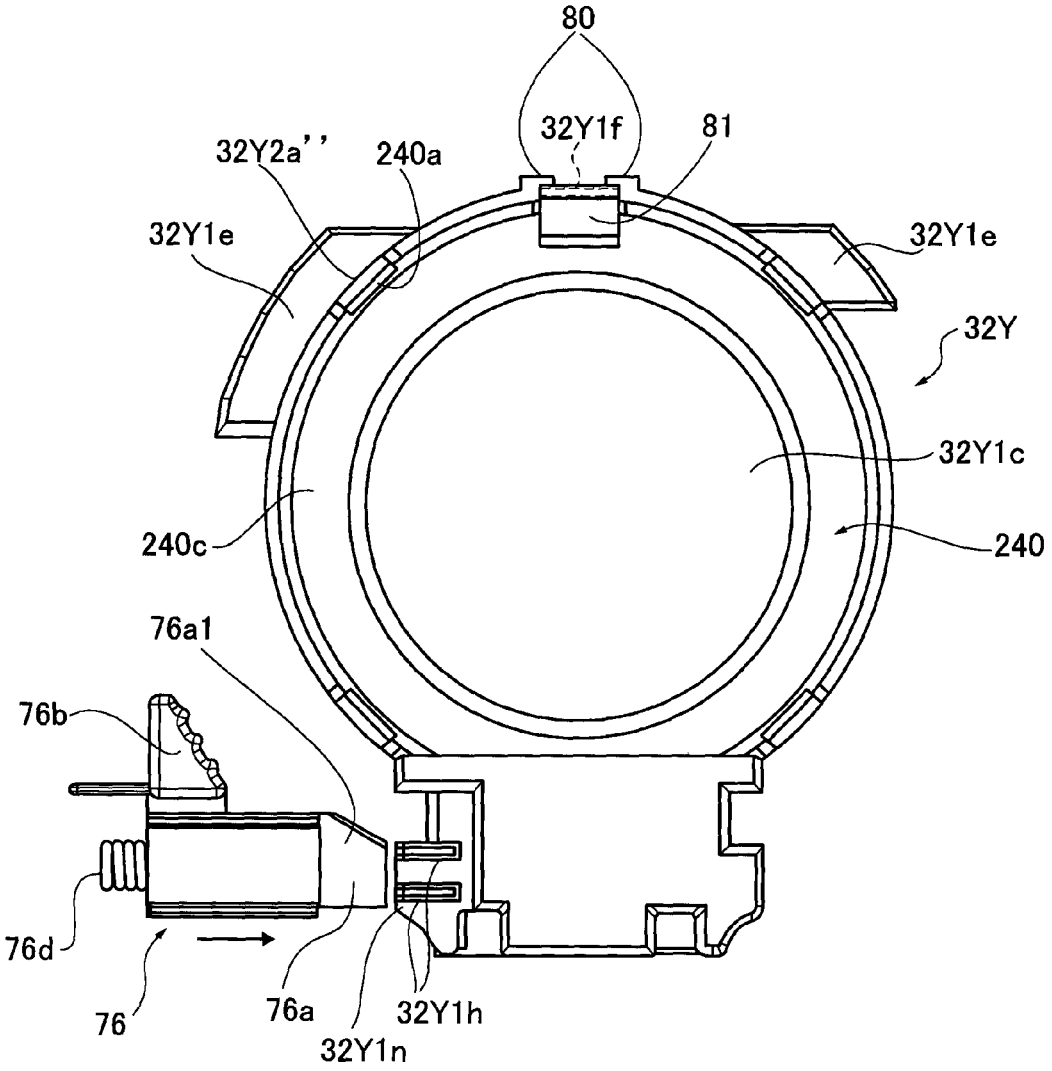
FIG. 58 is a front view showing a state of the toner container release lever when the toner container is mounted to or removed from the toner container storage part.

As shown in view-B of FIG. 59, a plurality of engagement claw parts 32Y2*a*" having elasticity is formed on an outer edge peripheral surface at the end part 32Y2*a*' of the cylindrical body. By mounting the first cap member 240 to the end part 32Y2*a*', engagement parts 240*a* formed by projecting on the peripheral surface of the first cap member are coupled to the engagement claw parts 32Y2*a*" by snap fitting (refer to FIG. 57 and FIG. 58).

The cylindrical body 32Y2' is preferably molded by the injection molding in view of the fitness between the first cap member 240 and the second cap member 134 mounted on both ends thereof. Further, the cylindrical body 32Y2' is preferably made of polypropylene in terms of the impact resistance, cold resistance, rigidity and moldability in the injection molding. Among the polypropylene, elastomer blended polypropylene and block copolymer polypropylene are preferable. The elastomer blended polypropylene and the block copolymer polypropylene preferably have the MFR of 5.0 to 50.0 g/10 min (JIS K7210) and the density of 0.900 to 0.910 kg/m3 (JIS K7112) in terms of moldability resistance, impact resistance, and rigidity.

The elastomer blended polypropylene is a crystalline polypropylene of homopolymer polypropylene to which elastomer of α-olefin and propylene copolymer is added. The α-olefin includes 1-butene, isobutene, 1-bentene, 2-methyl-1-butene, 3-methyl-a-butene, 1-hexene, 2-methyl-1-bentene, 3-methyl-1-bentene, 4-methyl-1-bentene, 1-octene, 1-nonen, 1-decene, 1-undecene, 1-dodecene, and the like.

Here, 10 to 60 parts by weight of 5-20 parts by weight of α-olefin and propylene copolymer is preferably compounded to 100 parts by weight of the crystalline polypropylene for balancing impact resistance and the rigidity. The crystalline polypropylene has preferably the isotactic pentad fraction of not less than 0.97 from the view point of the rigidity and heat resistance.

The block copolymer polypropylene is a compound comprising crystalline polypropylene being a homopolymer of polypropylene and ethylene and propylene copolymer elastomer, produced in a multistage polymerization process.

The multistage polymerization process is a process using a known Ziegler-Natta catalyst or metallocene catalyst, in which polypropylene homopolymer is polymerized at a first stage, and ethylene and propylene are copolymerized at a second stage and dispersed in a reactor. Also, in this case, the crystalline polypropylene has preferably the isotactic pentad fraction of not less than 0.97 from the view point of the rigidity and heat resistance.

Here, 10 to 60 parts of ethylene and propylene copolymer is preferably compounded to 100 parts by weight of the crystalline polypropylene for balancing impact resistance and the rigidity. From the view point of the impact resistance, the ethylene and propylene copolymer elastomer preferably has 40 to 60 weight % of a component derived from ethylene. Further, talc is preferably compounded into elastomer blended polypropylene or block copolymer polypropylene for improving heat resistance, linear expansion resistance and moldability of injection molding.

The talc preferably has a mean grain diameter of 5 μm to not more than 2 μm in order to improve impact resistance of the cylindrical body 32Y2'. More preferably, the talc is a microparticle talc having a mean grain diameter of less than 2 μm, and its content having a grain diameter of not less than 4 μm is not more than 4 weight %.

The mixing ratio of talc is preferably 3 to 20 parts to 100 parts by weight of the elastomer blended polypropylene or block copolymer polypropylene from the view point of the improvement in fitness with the first cap member 240 and the second cap member 134, linear expansion resistance and impact resistance. In particular, a material having a good linear expansion resistance can suppress expansion of the cylindrical body 32Y2' when the toner container main body is exposed to high temperature and thereby ensures the fitting accuracy between the first cap member 240 and the second cap member 134.

[Detailed Configuration of First Cap Member 240]

As shown in FIG. 60, the first cap member 240 includes a toner discharge part 32Y1*d*, a shaft support tube 240*b* having a circular hole 240*b*', a lid part 240*c* and a gripping part 32Y1*c* shown in FIG. 61.

The lid part 240*c* includes an annular flange part 240*d* and a fitting tube part 240*e*. A nozzle insertion part 32Y30 shown in FIG. 62 is disposed at the toner discharge part 32Y1*d*. The shaft support part 240*b* is formed at the lid part 240*c*' of the lid part 240*c* thereof in a direction protruding toward the cylindrical body 32Y2'.

The nozzle insertion part 32Y30 includes the toner discharge port 32Y1*a* (refer to FIG. 34) described above. As shown in FIG. 60 to FIG. 62, a first groove part 32Y1*g* is provided on both side faces of the toner discharge part 32Y1*d*. The first groove part 32Y1*g* is configured so as to be engageable with a positioning member 78 (refer to FIG. 8) of the toner container storage part 31. As shown in FIG. 63, two horizontal surfaces 32Y1*ga* and 32Y1*gb* facing to each other and a vertical surface 32Y1*gc* disposed between the two horizontal surfaces 32Y1*ga* and 32Y1*gb* are provided on the first groove part 32Y1*g*.

The horizontal surfaces 32Y1*ga* and 32Y1*gb* and the vertical surface 32Y1*gc* extend in a direction in which the toner container 32Y is mounted to and removed from the toner container storage part 31. Since the first groove part 32Y1*g* is engaged with the positioning member 78, the toner container 32Y is held so as not to rotate with respect to the toner container holding part 70 of the toner container storage part 31 even when the conveyance member 33 rotates.

The gripping part 32Y1*c* is formed by protruding in the mounting and removing direction from the cylindrical container main body 32Y2. The gripping part 32Y1*c* is used to facilitate handling of the toner container 32Y when the user replaces (mounts or removes) the toner container 32Y.

The toner discharge part 32Y1*d* is provided with a pressed part 32Y1*h* shown in FIG. 61 to FIG. 64 and a nozzle insertion port 32Y1*j* shown in FIG. 60 and FIG. 63. At an end part of the nozzle insertion port 32Y1*j*, a ring-shaped sealing member 32Y20*c* enclosing an opening edge thereof is provided.

The ring-shaped sealing member 32Y20*c* prevents toner leakage between the nozzle 72 shown in FIG. 34 and the nozzle insertion port 32Y1*j* when the toner container 32Y is mounted to the toner container storage part 31Y. Further, the ring-shaped sealing member 32Y20*c* has a function of absorbing impact applied when the toner container 32Y is completely mounted to the toner container storage part 31Y by sliding therein.

The toner discharge part 32Y1*d* is fitted into a mounting cutout 40" (refer to view-A of FIG. 59) of the cylindrical body 32Y2'. The toner discharge part 32Y1*d* includes the nozzle insertion part 32Y30 shown in FIG. 62. As shown in FIG. 65 and FIG. 66, the nozzle insertion part 32Y30 includes the hole part 32Y1*b*, the toner discharge port 32Y1*a*, and the toner discharge path 32Y30*a*. A columnar-shaped part 32Y3' of the plug member 32Y3 is disposed in the hole part 32Y1*b* in a movable manner.

The toner discharge port 32Y1*a* is formed at an upper part of a peripheral wall of the hole part 32Y1*b*. The hole part 32Y1*b* and the toner discharge path 32Y30*a* communicate with each other via the toner discharge port 32Y1*a*. The toner discharge path 32Y30*a* is formed at an upper part of the toner discharge port 32Y1*a*.

The toner discharge port 32Y1*a* and an inner space of the cylindrical body 32Y2' communicate with each other via the toner discharge path 32Y30*a*. The nozzle insertion part 32Y30 is configured in such a manner that the hole part 32Y1*b* communicates with the nozzle insertion port 32Y1*j* of the toner discharge part 32Y1*d* when the nozzle insertion part 32Y30 is fitted into a concave portion provided on the toner discharge part 32Y1*d*.

The plug member 32Y3 includes a columnar-shaped part 32Y3' inserted into the hole part 32Y1*b* and a contact plate part 32Y3". The plug member 32Y3 has a function of opening or closing the toner discharge port 32Y1*a* when the columnar-shaped part 32Y3' displaces in the hole part 32Y1*b*.

Further, the claw member 75 of the toner container storage part 31 contacts the contact plate part 32Y3" when removing the toner container 32Y, whereby the columnar-shaped part 32Y3' is displaced toward a close position of the toner discharge port 32Y1*a*.

In the nozzle insertion part 32Y30, a spring 32Y30*b* pressing the plug member 32Y3 in a direction closing the toner discharge port 32Y1*a* is provided as shown in FIG. 65 to FIG. 69. Similarly with the claw member 75, the spring 32Y30*b* has a function of displacing the columnar-shaped part 32Y3' to a close position of the toner discharge port 32Y1*a* when removing the toner container 32Y.

With the spring 32Y30*b* disposed at the nozzle insertion part 32Y30, the plug member 32Y3 can be displaced faster in the direction closing the toner discharge port 32Y1*a*. Accordingly, a configuration in which the spring 32Y30*b* is disposed at the nozzle insertion part 32Y30 can suppress toner leakage from the toner discharge port 32Y1*a* more reliably compared with a configuration in which the spring 32Y30*b* is not disposed at the nozzle insertion part 32Y30. The spring 32Y30*b* needs not to be necessarily disposed at the nozzle insertion part 32Y30.

At the hole part 32Y1*b*, an O-ring 32Y30*d* and an O-ring 32Y30*e* are provided each on both ends of a penetrating direction thereof as shown in FIG. 65. The O-ring 32Y30*d* and the O-ring 32Y30*e* suppress toner leakage between the plug member 32Y3 and the hole part 32Y1*b* Further, an O-ring 32Y30*c* is provided on the nozzle insertion part 32Y30 by enclosing an outer peripheral wall of the toner discharge path 32Y30*a*.

As shown in FIG. 60 to FIG. 64, a pair of second groove parts 32Y1*i* is provided on the toner discharge part 32Y1*d*. A pair of claw members 75 is guided to the second groove parts 32Y1*i*. As shown in FIG. 63, third groove parts 32Y1*q* are provided on a vertical line of the second groove parts 32Y1*i*. A sliding surface 32Y1*r* is provided between the second groove parts 32Y1*i* and the third groove parts 32Y1*q*. The sliding surface 32Y1*r* has a function of pressing the claw member 75 downward by smoothly contacting the claw part 75 of the toner container storage part 31.

The sliding surface 32Y1*r* prevents the claw member 75 from intervening mounting of the toner container 32Y, by pressing the claw member 75 downward. That is, an edge of the sliding surface 32Y1*r* on the side of the third groove part 32Y1*d* is provided a slant surface for smoothly pressing down the claw member 75.

At the toner discharge part 32Y1*d*, a sliding contact rib 32Y1*m* is provided in a direction parallel with the mounting and removing direction as shown in FIG. 64. The sliding contact rib 32Y1*m* holds a release position of the toner container release lever 76 by making a sliding contact with the toner container release lever 76 when the toner container 32Y is mounted to or removed from the toner container storage part 31Y.

Further, the sliding contact rib 32Y1*m* also has a function of ensuring strength of a surface 32Y1*n*. An upper rib out of two sliding contact ribs 32Y1*m* is configured as a horizontal surface 32Y1*gb* which disposes the first groove part 32Y1*g* engaging with the positioning member 78 of the toner container storage part 31Y.

[Configuration of First Chip Holding Part 80 and Second Chip Holding Part 81]

As shown in FIG. 70, a cutout part 82 is formed on a peripheral face of an end part of the one end side (first cap member 240 on the side of the lid part 240*c*) open to the cylindrical body 32Y2' along a longitudinal direction of the cylindrical body 32Y2', and at both sides of the cutout part 82, a pair of first chip holding parts 80 is formed integrally. In the cutout part 82, a second chip holding part 81 having a tip formed so as to have a flexibility is positioned at a slit part 83 (refer to FIG. 60) disposed on the peripheral wall at the end part of the first cap member 240.

Each of first chip holding parts 80 includes side wall parts 80*a* and projection parts 80*b* protruding so as to face upper parts of side walls 80*a* with each other. Each of the projection parts 80*b* is formed along the cutout part 82.

The second chip holding part 81 includes a plate-shaped chip storage part 81*a* located inside the cutout part 82, and a push-down part 81*b* which bends at a right angle downward from a tip of the chip storage part 81*a*, with a tip thereof protruding forward. On the surface of the chip storage part 81*a*, a concave mount part 81*c* (refer to FIG. 60) for storing and holding the RFID chip 32Y1*f* is formed. The push-down part 81*b* of the second chip holding part 81 is located at a position inner than an end face of the end part of the cylindrical body 32Y2'.

To hold the RFID chip 32Y1*f* between the first chip holding part 80 and the second chip holding part 81, firstly, the user pushes down the push-down part of the second chip holding part 81 as shown in FIG. 70, whereby the chip storage part 81*a* of the second chip holding part 81 elastically deforms and bends downward. In this state, the RFID chip 32Y1*f* is inserted into a predetermined clearance formed between the push-down part 81*b* and inner surface of projection parts 80*b* of the first chip holding part 80.

Then, insert the RFID chip 32Y1*f* into a deep position of the clearance in such a manner that the RFID chip is held by the mount part 81*c* of the chip storage part 81*a*. Thereafter, when a hand is released from the push-down part 81*b*, the chip storage part 81*a* returns to an original position by an elastic force, whereby the RFID chip 32Y1*f* is held between the first chip holding part 80 and the second chip holding part 81.

On the other hand, to remove the RFID chip 32Y1*f* being held, the user pushes down the push-down part 81*b* of the second chip holding part 81 to elastically deform the chip storage part 81*a* and produce a predetermined clearance between the push-down part 81*b* and an inner surface of projection parts 80*b* of the first chip holding part 80, whereby the RFID chip 32Y1*f* can be removed toward the front side (in a left direction of FIG. 71).

In such a manner, the toner container 32Y (32M, 32C and 32K) according to the present embodiment is capable of easily mounting (holding) and removing the RFID chip 32Y1*f* by pressing and bending the push-down part 81*b* of the second chip holding part 81, whereby the RFID chip 32Y1*f* can be detached easily and efficiently in a recycling process or the like of the toner container 32Y (32M, 32C and 32K).

Further, since the push-down part 81*b* of the second chip holding part 81 is located at a position inner than an end face at the end part of the cylindrical body 32Y2', casual touch of the push-down part 81*b* with the other member and erroneous pushing of the push-down part 81*b* can be prevented.

Further, with such configuration in which a peripheral surface of the first cap member 240 is connected by a snap-fit connection in a removable manner into the end part of the one end side open to the cylindrical body 32Y2', the first cap member 240 can be easily and efficiently removed from the cylindrical body 32Y2' in a recycling process and the like.

Embodiment 11

View-A and view-B of FIG. 72 are schematic perspective views showing a holding structure of the RFID chip 32Y1*f* according to the present embodiment. Other configurations are same as Embodiment 10.

According to the present embodiment, as shown in view-A of FIG. 72, a concave-shaped chip insertion guide groove part 83 extending in a longitudinal direction of the cylindrical body 32Y2' and a chip storage part 84 integrally formed so as to cross over the chip insertion guide groove part 83 at inner side thereof are provided on a peripheral surface of the end part at the one end side (the first cap member 240 on the side of the lid part 240*c*) of the cylindrical body 32Y2'. The chip insertion guide groove part 83 and the chip storage part 84 are disposed at a same location as the first chip holding part 80 according to Embodiment 1.

A bottom surface of the chip insertion guide groove part 83 is formed in a flat manner. A concave part 84*a* having a size allowing storage of the RFID chip 32Y1*f* therein without substantially leaving a clearance is disposed at the back surface (inner surface on the side of the chip insertion guide groove part 83) of the chip storage part 84.

Then, as shown in view-A and view-B of FIG. 72, the RFID chip 32Y1*f* is inserted through a leading end of the chip insertion guide groove part 83 and stored in the chip storage part 84. Thereafter, an adhesive tape 85 is placed over a range covering entire surface of the chip insertion guide groove part 83 and the chip storage part 84. The tape 85 may be of either transparent or non-transparent type.

An IC (not shown) or the like which stores information is arranged at the back surface of the RFID chip 32Y1*f* (a surface on the side of the chip insertion part 83). If the surface is uneven, the flatness thereof may be improved by attaching a tape at the rear surface of the RFID chip 32Y1*f*, whereby the RFID chip 32Y1*f* can be smoothly inserted into the chip storage part 84.

In such a manner, according to the present embodiment, an adhesive tape 85 is attached to a range including entire surface of the chip insertion guide groove part 83 and the chip storage 84 after the RFID chip has been stored in the chip storage part 84, whereby casual detachment of the RFID chip 32Y1*f* can be prevented even when mounting the toner container 32Y (32M, 32C and the 32K) or the like.

Further, the RFID chip 32Y1*f* can be easily removed just by peeling off the tape 85, whereby the RFID chip 32Y1*f* can be efficiently and easily removed in a recycling process and the like.

Embodiment 12

According to the present embodiment, as shown in view-A and view-B of FIG. 73, a square-shaped window part 84*b* open to an upper surface of the chip storage 84 according to Embodiment 11 is formed, and a tape 85 attached thereto is of a transparent type. Other configurations are same as Embodiments 10 and 11.

The window part 84*b* of the chip storage part 84 is formed to a size which allows to see a substantially exposed entire upper surface of the RFID chip 32Y1*f* stored therein.

In such a manner, according to the present embodiment, the RFID chip 32Y1*f* stored in the chip storage 84 can be easily seen through the window part 84*b*.

Embodiment 13

View-A and view-B of FIG. 74 are schematic perspective views showing a holding structure of the RFID chip 32Y1*f* according to the present embodiment. Other configurations are same as Embodiment 10.

According to the present embodiment, as shown in view-A of FIG. 74, a concave-shaped chip insertion guide face 85 extending in a longitudinal direction of the cylindrical body 32Y2' is formed on a peripheral face of the end part at the one end side (the first cap member 240 on the side of the lid part 240) of the cylindrical body 32Y2', and a guide groove part 86*a* is formed on both sides of the chip insertion groove part 86 along a longitudinal direction of the cylindrical body 32Y2'. The planar chip insertion guide face 86 is provided on a location same as the first chip holding part 80 according to Embodiment 10.

Further, according to the present embodiment, the chip storage member 87 inserted into the chip insertion guide face 86 is formed separately. In the chip storage member 87, guide projection parts 87*a* fitted in a slidable manner into guide groove parts 86*a* provided on a lower surface, a chip holding part 87*c* having a chip insertion port 87*b* open to the chip insertion guide face 86 on an insertion direction side thereof, and a square-shaped window part 87*d* open to an upper face thereof are formed.

The window part 87*d* of the chip storage member 87 is formed to a size allowing seeing a substantially exposed entire upper surface of the RFID chip 32Y1*f* stored therein.

Then, as shown in view-A and view-B of FIG. 74, firstly, the RFID chip 32Y1*f* is inserted through the chip insertion port 87*b* of the chip storage member 87 and stored in the chip holding part 87*c*. Then, guide projection parts 87*a* of the chip storage member 87 are fitted into guide groove parts of the chip insertion guide part 86, and the chip insertion port 87*b* of the chip storage member 87 is moved until contacting a deepest portion of the chip insertion guide part 86.

Further, guide projection parts 87*a* are fitted into the guide groove part 32Y1*f* without rattling, whereby the position of the chip storage member 87 is not moved.

In such a manner, according to the present embodiment, the RFID chip 32Y1*f* is stored in the chip storage member 87 from a side opposite to the end part at the one end side of the cylindrical body 32Y2', whereby casual detachment of the RFID chip 32Y1*f* from the chip storage member 87 can be prevented.

Further, the RFID chip 32Y1*f* can be easily removed by just removing the chip storage member 87 from the chip insertion guide part 86, whereby the RFID chip 32Y1*f* can be efficiently and easily removed in a recycling process and the like of the toner container 32Y (32M, 32C and 32K).

Further, as shown in FIG. 75, the chip storage member 87 can be held more reliably by attaching an adhesive tape 85 to a range including entire surface of the chip storage member 87. The tape 85 of a transparent type allows to see the RFID chip 32Y1*f* in the chip holding part 87*c* through the window part 87*d*.

As described above, embodiments of the present invention include the following inventions.

(a) A powder storage container storing a developer therein and mounted to a main body of an image forming apparatus in a removable manner, the powder storage container including:

a cylindrically-shaped body with at least one end side open, the cylindrically-shaped body including a conveyance member supported in a rotatable manner and configured to discharge the developer stored therein, while stirring, from a developer discharge port to the main body of the image forming apparatus along a longitudinal direction; and a cap member mounted so as to plug the open one end side of the body member, wherein at least an electronic information storage member storing information of the developer stored therein is held by an electronic information storage member holding part on a peripheral surface at an end part of the body member on a side where the cap member is mounted, the electronic information storage member holding part includes a plate-shaped holding part comprising a concave-shaped electronic information storage member mount part on the surface thereof and disposed in a cutout part formed along a longitudinal direction of the body member at a peripheral surface of the end part in such a manner that a leading end side thereof on the side of the end face of the end part has a flexibility; and projection parts formed on both sides of the cutout part so as to substantially touch or closely approach at least an upper surface on both sides of the holding part along a longitudinal direction of the body member, and a leading end side of the holding part is bent by pressing in a direction getting away from the projection parts, whereby the electronic information storage member is inserted between the holding part and projection parts and the electronic information storage member is held in the electronic information storage member mount part.

(b) The powder storage container according to (a), wherein a leading end side of the holding part is bent in a diameter direction of the end part of the body member, a push-down part for the pressing is formed at the leading end thereof by projecting in a longitudinal direction of the body member, and the push-down member is located at a position inner than the end part of the body member.

(c) A powder storage container storing a developer therein and mounted to a main body of an image forming apparatus in a removable manner, the powder storage container including:

a cylindrically-shaped body with at least one end side open, the cylindrically-shaped body including a conveyance member supported in a rotatable manner and configured to discharge the developer stored therein, while stirring, from a developer discharge port to the main body of the image forming apparatus along a longitudinal direction; and a cap member mounted so as to plug the open one end side of the body member, wherein at least an electronic information storage member storing information of the developer stored therein is held by an electronic information storage member holding part on a peripheral surface at an end part of the body member on a side where the cap member is mounted, the electronic information storage member holding part includes a concave-shaped electronic information storage member insertion guide groove part formed at a peripheral surface of the end part along a longitudinal direction of the body member and into which the electronic information storage member is inserted from the end part side; and an electronic information storage member storage part formed on an inner side in an insertion direction of the electronic information storage member of the electronic information storage member insertion guide groove part so as to cross over the electronic information storage member insertion guide groove part, and the electronic information storage member inserted into the electronic information storage insertion guide groove part from the end part side is stored and held in the electronic information storage member storage part.

(d) The powder storage container according to (c), wherein the electronic information storage member storage part is integrally formed on both sides of the electronic information storage member insertion guide groove part.

(e) The powder storage container according to (d), wherein the electronic information storage member storage part is formed separately from the electronic information storage member insertion guide groove and inserted from the end part side into the electronic information storage member insertion guide groove part in a slidable manner, and an opening part for storing the electronic information storage member is provided on the side of the electronic information storage member storage part inserted into the electronic storage member insertion guide groove part.

(f) The powder storage container according to any one of (c) to (e), wherein after the electronic information storage member is stored and held in the electronic information storage member storage part, the electronic information storage member storage part is sealed with an adhesive sealing member so as to cover at least surface of the electronic information storage member storage part along a longitudinal direction of the body member.

(g) The powder storage container according to any one of (c) to (f), wherein an open window part is provided on an upper surface of the electronic information storage member storage part.

(h) An image forming apparatus including the powder storage container according to any one of (a) to (g).

As described above, the powder storage container according to the present invention is capable of easily removing a held electronic information storage member from an electronic information storage member mount part by being a holding part by pushing, whereby the electronic information storage member can be efficiently and easily removed in a recycling process and the like of the powder storage container.

CITATION LIST

Patent Literature

[PTL 1] Japanese Patent Application Publication No. 2007-316309

[PTL 2] Japanese Patent Application Publication No. 2007-178969

The invention claimed is:

1. A powder storage container comprising:

a powder storage part configured to store a developer used for image forming, a powder discharge part provided on one end part of the powder storage part to discharge the developer stored in the powder storage part, a gripping part protruding through an end face on the one end part side of the powder storage part, a powder loading port causing an inner space of the powder storage part and an outer portion of the powder storage part to communicate with each other, and a sealing member capable of sealing the powder loading port, wherein the powder loading port is enclosed by the gripping part.

2. The powder container storage part according to claim 1, wherein an insertion hole with one end thereof releasing a projected end face of the gripping part is provided on the gripping part, the powder loading port is provided by opening an wall at the bottom of the insertion hole, the sealing member comprises an insertion part inserted into the powder loading port to seal the powder loading port, and a head part provided continuous to the insertion part and extended from the powder loading port in a state where the insertion part seals the powder loading port, and the head part has a length, viewed in a direction extending from the powder loading port, smaller than a length of the insertion hole viewed in an axial direction.

3. The powder storage container according to claim 2, wherein the insertion hole has a diameter of not more than 8 mm, the diameter being orthogonal to the axial direction.

4. The powder storage container according to claim 2, wherein the head part comprises a hook part capable of holding the sealing member with a predetermined fitting hooked thereat, and the hook part can be inserted into the insertion hole together with the hooked fitting.

5. The powder storage container according to claim 2, wherein a female screw groove serving as a female screw is provided on the powder loading port, and a male screw groove capable of engaging with the female screw groove at the powder loading port is provided on the insertion part.

6. The powder storage container according to claim 2, wherein the insertion hole has a hole shape following an external shape of the gripping part, the head part has an external shape following the hole shape of the insertion hole, a female screw groove serving as a female screw is provided on the insertion part, a male screw groove capable of meshing with the female screw groove at the powder loading port is provided on the insertion part, and the head part has a size enough to form a predetermined clearance between an inner peripheral wall of the insertion hole and an outer peripheral wall of the head part in a state where the insertion part is screwed into the powder loading port.

7. The powder storage container according to claim 6, wherein the predetermined clearance is set to not more than 8 mm.

8. The powder storage container according to claim 2, wherein the insertion hole has a hole shape following an external shape of the gripping part, and a shielding member for shielding the open edge part is provided on the insertion hole.

9. An image forming apparatus to which the powder storage container according to claim 1 is mounted, and which is capable of supplying the developer via the powder discharge part.

10. A powder storage container comprising:

a cylindrical body configured to store a developer therein and including an opening part at both ends thereof as a part for forming a powder storage part which is mounted to and removed from an image forming apparatus, a first cap member including at least a discharge part configured to discharge the developer from inside of the powder storage part toward a main body of the image forming apparatus, and a lid part configured to seal an opening part at a one end side, and mounted to the opening part at the one end side of the cylindrical body to form the cylindrical container body in cooperation with the cylindrical body, a conveyance member including at least a stirring blade, disposed in the cylindrical body so as to extend from an opening part at a one end side toward an opening part at the other end side thereof, and configured to convey the developer, while stirring, from the opening part at the other end side toward the opening part at the one end side by rotating with respect to the cylindrical body, and a second cap member including a drive coupling configured to transmit a rotational drive force from the main body of the image forming apparatus to the conveyance member, and a lid part configured to seal the opening part at the other end side to form the powder storage part in cooperation with the first cap member and the cylindrical body, wherein the opening part at the other end side forms a powder loading port for loading the developer into the powder storage container.

11. The powder storage container according to claim 10, wherein a small-diameter tube part is formed at the other end side of the cylindrical body, the second cap member includes a rotary element forming the driven coupling and configured in such a manner rotatable with respect to a lid part of the second cap member, and the second cap member is mounted to the small-diameter tube part by fixing the lid part to the small-diameter tube part.

12. The powder storage container according to claim 11, wherein the lid part of the second cap member includes a top plate part having a through hole into which the rotary element is inserted in a rotatable manner, and an enclosure tube part which encloses the small-diameter tube part, a threaded part is formed on an outer peripheral surface of the small-diameter tube part and on an inner peripheral surface of the enclosure tube part, and the lid part of the second cap member is fixed to the small-diameter tube part with the enclosure tube part screwed to the small-diameter tube part.

13. The powder storage container according to claim 11, wherein the lid part of the second cap member includes a top plate part having a through hole into which the rotary element is inserted in a rotatable manner, and a fitting tube part which is fitted into the small-diameter tube part, and the lid part of the second cap member is fixed to the cylindrical body by attaching an adhesive tape around a portion extending from an outer peripheral surface of the fitting tube part to an outer peripheral surface of the cylindrical body.

14. The powder storage container according to claim 10, wherein the first cap member, the second cap member and the conveyance member are formed by an injection molding, and the cylindrical body is formed by a blow molding or a biaxial stretching blow molding.

15. An image forming apparatus to which the powder storage container according to claim 10 is mounted, and which is capable of supplying the developer via the discharge part.

16. A powder storage container comprises a cylindrical body which includes an opening part at both ends and forms, by storing a developer there, a part of the powder storage part mounted to and removed from a main body of an image forming apparatus, a first cap member comprising a discharge port of the developer and mounted to an opening part at a one end side of the cylindrical body, a conveyance member configured to convey the developer, while stirring, from an opening part at the other end side toward the opening part at the one end side by rotating with respect to the cylindrical body, and a second cap member comprising a drive coupling which transmits a rotational drive force from the main body of the image forming apparatus to the conveyance member and mounted to the opening part at the other end side in a rotatable manner and so as to seal the opening part at the other end side, wherein the opening part at the other end side serves as a powder loading port for loading the developer into the powder storage container.

17. An image forming apparatus to which the powder storage container according to claim 16 is mounted, and which is capable of supplying the developer via the discharge port.

* * * * *